US012365511B1

(12) United States Patent
Zabaleta et al.

(10) Patent No.: US 12,365,511 B1
(45) Date of Patent: Jul. 22, 2025

(54) SEALING CAP HAVING TAMPER EVIDENCE RING FOR SEALING RESEALABLE CONTAINER AND METHOD OF USE

(71) Applicants: Daniel A Zabaleta, Cooper City, FL (US); Sam D Hackett, Fort Lauderdale, FL (US)

(72) Inventors: Daniel A Zabaleta, Cooper City, FL (US); Sam D Hackett, Fort Lauderdale, FL (US)

( * ) Notice: Subject to any disclaimer, the term of this patent is extended or adjusted under 35 U.S.C. 154(b) by 0 days.

(21) Appl. No.: 17/902,797

(22) Filed: Sep. 2, 2022

Related U.S. Application Data

(60) Continuation-in-part of application No. 17/223,221, filed on Apr. 6, 2021, now Pat. No. 11,952,164,
(Continued)

(51) Int. Cl.
*B65D 17/28* (2006.01)
*B65D 41/04* (2006.01)
(Continued)

(52) U.S. Cl.
CPC ..... *B65D 17/4014* (2018.01); *B65D 17/401* (2018.01); *B65D 41/04* (2013.01);
(Continued)

(58) Field of Classification Search
CPC .. B65D 17/4014; B65D 17/401; B65D 41/04; B65D 47/243; B65D 47/305;
(Continued)

(56) References Cited

U.S. PATENT DOCUMENTS 253,075 A 1/1882 Lyon
986,847 A 3/1911 Nair et al.
(Continued)

FOREIGN PATENT DOCUMENTS

AU 2012244852 B2 7/2014
CA 476789 9/1951
(Continued)

OTHER PUBLICATIONS

Customized Logo 401# Stretch Tin Can Lids for Food and Wine Paper Tube, curiousexpeditions.org, 2 pages. Found online Nov. 11, 2015 at http://papercanspackaging.sell.curiousexpeditions.org/iz6fge2df-customised-logo-401-stretch-tin-can-lids-for-food-and-wine-paper-tube-images.
(Continued)

*Primary Examiner* — James N Smalley
(74) *Attorney, Agent, or Firm* — Allen D Hertz, P.A.; Allen D. Hertz

(57) ABSTRACT

A plug styled closure cap for resealing a resealable container. The cap includes a body comprising a sidewall, a motion translating feature formed on an exterior surface of the sidewall of the plug style closure cap body that translates a rotational motion to an axial motion when engaged with a mating translating feature formed on an interior surface of a container opening, a sealing surface that engages with a mating sealing surface of the container opening, and a tamper evidence feature integral with the cap body. The sealing surface can include an elastomeric element. The tamper evidence feature can include at least one segment defined by frangible elements. A method of use enables resealing of the container and indication when the container is no longer factory sealed.

28 Claims, 35 Drawing Sheets

Related U.S. Application Data which is a continuation-in-part of application No. 29/777,334, filed on Apr. 5, 2021, now Pat. No. Des. 103,216, which is a continuation-in-part of application No. 29/777,331, filed on Apr. 5, 2021, now Pat. No. Des. 103,215, which is a continuation-in-part of application No. 29/777,270, filed on Apr. 5, 2021, now Pat. No. Des. 103,217, which is a continuation-in-part of application No. 16/035,583, filed on Jul. 13, 2018, now Pat. No. 10,968,010, said application No. 17/223,221 is a continuation of application No. 16/035,583, filed on Jul. 13, 2018, now Pat. No. 10,968,010, which is a continuation-in-part of application No. 15/494,498, filed on Apr. 22, 2017, now Pat. No. 10,427,832, which is a continuation-in-part of application No. 29/560,269, filed on Apr. 5, 2016, now Pat. No. Des. 795,693, and a division of application No. 15/056,216, filed on Feb. 29, 2016, now Pat. No. 9,637,269, which is a continuation-in-part of application No. 14/665,102, filed on Mar. 23, 2015, now Pat. No. 9,272,819, said application No. 29/560,269 is a continuation-in-part of application No. 29/491,268, filed on May 19, 2014, now Pat. No. Des. 752,978, said application No. 14/665,102 is a continuation-in-part of application No. 29/491,268, filed on May 19, 2014, now Pat. No. Des. 752,978, and a division of application No. 13/787,012, filed on Mar. 6, 2013, now Pat. No. 8,985,371, said application No. 29/491,268 is a division of application No. 13/787,012, filed on Mar. 6, 2013, now Pat. No. 8,985,371, which is a continuation-in-part of application No. 13/572,404, filed on Aug. 10, 2012, now Pat. No. 8,844,761.

(51) Int. Cl.
*B65D 47/24* (2006.01)
*B65D 47/30* (2006.01)

(52) U.S. Cl.
CPC ..... *B65D 47/243* (2013.01); *B65D 47/305* (2013.01); *B65D 2251/0015* (2013.01); *B65D 2517/002* (2013.01); *B65D 2517/0041* (2013.01); *B65D 2517/0043* (2013.01); *B65D 2517/0062* (2013.01); *B65D 2517/0082* (2013.01); *B65D 2517/5091* (2013.01); *Y10S 220/906* (2013.01)

(58) Field of Classification Search
CPC ..... B65D 2251/0015; B65D 2517/002; B65D 2517/0041; B65D 2517/0043; B65D 2517/0062; B65D 2517/0082; B65D 2517/5091; B65D 17/506; Y10S 220/906
See application file for complete search history.

(56) References Cited

U.S. PATENT DOCUMENTS 1,596,367 A 8/1926 Miller
1,602,126 A 10/1926 Russell
1,687,887 A 10/1928 Pletcher
1,691,276 A 11/1928 Freundt
1,696,388 A 12/1928 Curtis
1,765,383 A 6/1930 Punte
1,798,246 A 3/1931 Braner
2,004,964 A 6/1935 Behr et al.
2,026,304 A 12/1935 Joseph
2,038,524 A 4/1936 Carvalho
2,102,666 A 12/1937 Annen
2,112,231 A 3/1938 Edwin et al.
2,117,407 A 5/1938 Davis
2,128,959 A 9/1938 Nicholls
2,207,564 A 7/1940 Wackman
2,303,205 A 11/1942 Frankenberg
2,337,456 A 12/1943 Draper
2,349,587 A 5/1944 Herbert
2,359,775 A 10/1944 McManus et al.
2,384,810 A 9/1945 Calleson
2,409,788 A 10/1946 Osborne
2,419,616 A 4/1947 White
2,426,550 A 8/1947 Coyle
2,430,036 A 11/1947 Thornburgh et al.
2,505,641 A 4/1950 Howe
2,661,863 A 4/1950 Howe
2,559,658 A 7/1951 Pottle
2,602,565 A 7/1952 Fdiek
2,661,862 A 12/1953 Howe
2,679,878 A 6/1954 Stine
2,683,579 A 7/1954 Stanley
2,706,065 A 4/1955 Saul
2,997,199 A 8/1961 Ramon
3,026,507 A 4/1962 Gaggini
3,029,507 A 4/1962 Gaggini
3,142,409 A 7/1964 Ross
3,176,872 A 4/1965 Zundel
3,191,564 A 6/1965 Fraze
3,225,957 A 12/1965 Huth
3,253,727 A 5/1966 Hart
3,255,917 A 6/1966 Fraze
3,270,544 A 9/1966 Maeder et al.
3,303,960 A 2/1967 Fraze
3,349,949 A 10/1967 Brown
3,349,950 A 10/1967 Wanderer
3,361,291 A 1/1968 Fraze
3,409,168 A 11/1968 Chmielowiec
3,439,640 A 4/1969 Fraze
3,439,833 A 4/1969 Fraze
3,446,389 A 5/1969 Brown
3,460,711 A 8/1969 Al-Roy
3,480,175 A 11/1969 Khoury
3,520,441 A 7/1970 Fitzgerald
3,601,273 A * 8/1971 Kutcher ..... B65D 41/348 215/253
3,638,597 A 2/1972 Fraze
3,643,833 A 2/1972 Fraze et al.
3,688,718 A 9/1972 Schrecker
D224,963 S 10/1972 Saunders
3,726,432 A 4/1973 Gentile
3,752,353 A 8/1973 Slade
D229,824 S 1/1974 Erickson
3,795,342 A 3/1974 Ashton
3,812,646 A 5/1974 Baldyga et al.
3,812,991 A * 5/1974 Wurl ..... B65D 41/348 215/252
3,844,443 A 10/1974 Cudzik
3,856,184 A 12/1974 Luviano
3,871,314 A 3/1975 Stargell
3,877,604 A 4/1975 Brown
3,880,318 A 4/1975 Fraze
3,910,453 A 10/1975 Kneusel
D238,150 S 12/1975 Cudzik
3,924,777 A 12/1975 Peyser
3,938,693 A 2/1976 Patel et al.
3,952,911 A 4/1976 Bozek et al.
3,967,752 A 7/1976 Cudzik
3,973,921 A 8/1976 Ward et al.
D243,231 S 2/1977 Smith
4,007,848 A 2/1977 Snyder
4,007,851 A 2/1977 Walker
4,042,144 A 8/1977 Henning
4,054,229 A 10/1977 Arfert
4,065,025 A 12/1977 Potts
4,078,695 A 3/1978 Potts
4,094,435 A 6/1978 Kennedy
4,098,058 A 7/1978 Carrigan et al.
4,116,360 A 9/1978 McKernan et al.
4,116,361 A 9/1978 Stargell
4,122,971 A 10/1978 Potts

(56) References Cited

U.S. PATENT DOCUMENTS 4,172,532 A 10/1979 Paisson
4,182,460 A 1/1980 Holk
4,197,956 A 4/1980 Murayama
4,262,815 A 4/1981 Klein
4,286,728 A 9/1981 Fraze et al.
D263,803 S 4/1982 Fraze
4,332,332 A 6/1982 Ingemann
4,386,713 A 6/1983 Baumeyer
4,399,925 A 8/1983 Fundom
4,411,707 A 10/1983 Brennecke et al.
D273,846 S 5/1984 Fraze
4,476,987 A 10/1984 Nolan
D277,826 S 3/1985 Brown, Sr.
4,561,561 A 12/1985 Ichikawa et al.
4,567,746 A 2/1986 Fraze et al.
4,574,975 A 3/1986 Cudzik et al.
4,679,699 A 7/1987 Mals et al.
4,685,849 A 8/1987 LaBarge et al.
4,705,186 A 11/1987 Barrash
4,711,611 A 12/1987 Fraze
4,717,039 A 1/1988 Ayyoubi
4,723,687 A 2/1988 Kutterer
4,726,489 A 2/1988 Padovani
4,732,031 A 3/1988 Bulso, Jr. et al.
4,785,963 A * 11/1988 Magley ..... B65D 39/088 220/284
4,793,510 A 12/1988 Arfert et al.
4,809,861 A 3/1989 Wilkinson
4,821,912 A 4/1989 Wells
4,823,537 A 4/1989 Duke
RE32,927 E 5/1989 Taylor
4,865,215 A 9/1989 Wells
4,872,597 A 10/1989 Hanafusa
4,880,131 A 11/1989 Gallagher et al.
4,928,244 A 5/1990 Vermesse
4,928,844 A 5/1990 La Barge
H803 H 8/1990 Sherrington
4,946,063 A 8/1990 Heyes et al.
4,982,862 A 1/1991 La Barge
5,052,576 A 10/1991 Budenbender
5,078,290 A 1/1992 Ochs
5,121,851 A 6/1992 Lyon et al.
5,125,212 A 6/1992 Smyth
5,138,858 A 8/1992 Johnson et al.
5,207,341 A 5/1993 Yeager
D337,521 S 7/1993 McNulty
D338,621 S 8/1993 Balson
5,240,138 A 8/1993 Gallagher
5,248,053 A 9/1993 Lundgren
5,292,025 A 3/1994 Dubreul
5,293,765 A 3/1994 Nussbaum
D348,137 S 6/1994 Campbell
5,339,977 A 8/1994 Schormair et al.
5,356,030 A 10/1994 Budenbender
5,381,924 A 1/1995 Kiefel
D355,735 S 2/1995 Shaffer
D356,456 S 3/1995 Henry
5,421,480 A 6/1995 Cudzik
5,443,175 A * 8/1995 Kelly ..... B65D 51/007 220/366.1
5,507,406 A 4/1996 Urciuoli et al.
5,511,920 A 4/1996 Artrip
5,529,202 A 6/1996 Shamis
5,582,319 A 12/1996 Heyes
5,605,244 A 2/1997 Bradshaw
D382,481 S 8/1997 McEldowney
D387,987 S 12/1997 Neiner
5,692,633 A 12/1997 Gordon
5,704,240 A 1/1998 Jordan
5,711,447 A 1/1998 Plester
5,713,235 A 2/1998 Diekhoff
5,718,352 A 2/1998 Diekhoff
5,772,799 A 6/1998 Sun et al.
5,779,086 A 6/1998 Barrash
5,778,723 A 7/1998 Diekhoff
5,785,198 A 7/1998 Credle
D397,062 S 8/1998 Hollington
5,799,775 A 9/1998 Spring
5,806,707 A 9/1998 Boehm et al.
5,816,428 A 10/1998 Plester
5,820,016 A 10/1998 Stropkay
5,822,843 A 10/1998 Diekhoff
5,875,906 A 3/1999 Price et al.
5,881,593 A 3/1999 Bulso, Jr. et al.
5,911,551 A 6/1999 Moran
5,947,315 A 9/1999 Valyi et al.
5,947,318 A 9/1999 Palm
D415,026 S 10/1999 Turner
D415,425 S 10/1999 Turner
5,975,322 A 11/1999 Reid
6,010,026 A 1/2000 Diekhoff et al.
6,010,028 A 1/2000 Jordan et al.
D424,438 S 5/2000 Turner
6,065,634 A 5/2000 Brifcani et al.
6,082,944 A 7/2000 Bachmann
6,102,225 A * 8/2000 Lynn ..... B65D 51/1688 215/354
6,105,807 A 8/2000 McCrossen
6,123,212 A 9/2000 Russell et al.
D434,983 S 12/2000 Hurst
6,164,472 A 12/2000 Folchini
6,174,274 B1 1/2001 Hawkins et al.
6,202,872 B1 3/2001 Smeyak et al.
6,206,222 B1 * 3/2001 Cudzik ..... B65D 1/165 413/15
6,216,904 B1 4/2001 Cagan
6,234,338 B1 5/2001 Searle
6,301,766 B1 10/2001 Kollé
D452,155 S 12/2001 Stodd
6,330,954 B1 12/2001 Turner et al.
6,332,551 B1 12/2001 Copeland
6,450,358 B1 9/2002 Berro
6,460,723 B2 10/2002 Nguyen et al.
D470,050 S 2/2003 Renz
D471,453 S 3/2003 Stodd
6,575,325 B2 6/2003 Dickie et al.
D476,889 S 7/2003 Fields
6,609,634 B2 8/2003 De Laforcade et al.
6,626,310 B2 9/2003 Taha
6,626,314 B1 9/2003 McHenry et al.
D480,304 S 10/2003 Stodd
6,651,833 B2 11/2003 Sciarini
6,688,484 B2 * 2/2004 Boulange ..... B65D 39/08 220/284
6,688,487 B2 2/2004 Oakes et al.
6,729,495 B2 5/2004 Gardiner
6,739,471 B2 5/2004 Goetz et al.
6,779,677 B2 8/2004 Chupak
6,877,941 B2 4/2005 Brifeani et al.
6,889,862 B2 5/2005 Vaughan
6,910,598 B2 5/2005 Goetz et al.
6,959,830 B1 11/2005 Kanou et al.
6,981,601 B2 1/2006 Laveault et al.
7,014,060 B2 3/2006 Richardson
D518,885 S 4/2006 Stout, Jr.
D525,127 S 7/2006 Cogley
7,100,789 B2 9/2006 Nguyen
7,147,123 B2 12/2006 Yamashita
D559,680 S 1/2008 Jacober et al.
7,344,041 B2 3/2008 Heinicke et al.
D587,118 S 2/2009 Sadiq et al.
7,500,376 B2 3/2009 Bathurst et al.
7,500,577 B2 3/2009 Wichelhaus
7,555,927 B2 7/2009 Hanafusa et al.
7,743,635 B2 6/2010 Jentzsch
7,798,357 B2 9/2010 Hanafusa et al.
7,823,740 B2 11/2010 Perra
7,824,750 B2 11/2010 Takegoshi et al.
7,841,222 B2 11/2010 Cook et al.
7,861,874 B2 1/2011 Cook et al.
7,891,517 B2 2/2011 Simmons
7,905,130 B2 3/2011 Marshall et al.
7,918,359 B2 4/2011 Paris et al.
7,918,363 B2 4/2011 Morabito et al.

(56) References Cited

U.S. PATENT DOCUMENTS 7,942,028 B2 5/2011 Gillest et al.
D639,164 S 6/2011 Walsh
D641,239 S 7/2011 Ramsey
D641,622 S 7/2011 Fields
8,016,148 B2 9/2011 Walsh
D647,400 S 10/2011 Fields
8,037,728 B2 10/2011 Hosoi
D649,049 S 11/2011 Fields
D651,452 S 1/2012 Hillebrenner
D653,109 S 1/2012 Stammen
8,091,402 B2 1/2012 Hanafusa et al.
8,210,377 B2 7/2012 Martin et al.
8,215,513 B1 7/2012 Grissom
8,302,768 B2 11/2012 Sibley
8,328,041 B2 12/2012 Brifcani
8,336,726 B2 12/2012 Ramsey et al.
8,336,728 B2 12/2012 Forrest
8,360,266 B2 1/2013 Adams et al.
D681,176 S 4/2013 Chacko
D684,470 S 6/2013 Concin et al.
8,474,634 B1 7/2013 Branson et al.
8,496,131 B2 7/2013 Forrest et al.
8,534,490 B2 9/2013 Chapin
8,556,106 B1 10/2013 Bayat et al.
D692,757 S 11/2013 Concin et al.
D692,758 S 11/2013 Concin et al.
D696,113 S 12/2013 Stein
8,608,007 B2 12/2013 Seo
8,613,369 B2 12/2013 Kitto
8,622,230 B2 1/2014 Grissom
8,720,717 B2 5/2014 Kaanta
D706,908 S 6/2014 Knapp
D708,943 S 7/2014 Van Goolen
D708,944 S 7/2014 Van Goolen
8,844,761 B2 9/2014 Zabaleta et al.
8,863,947 B2 10/2014 Sibley
8,866,617 B2 10/2014 Kurosawa et al.
8,939,311 B2 1/2015 Christopoulos et al.
8,985,371 B2 3/2015 Zabaleta et al.
9,016,504 B2 4/2015 McClung
D728,757 S 5/2015 Graham
D730,734 S 6/2015 Rapparini
9,145,239 B2 9/2015 Wohlgenannt
9,162,796 B2 10/2015 Bratsch
9,228,684 B2 1/2016 Knapp
9,265,287 B2 2/2016 Sims et al.
9,272,819 B1 3/2016 Zabaleta et al.
D752,978 S 4/2016 Zabeleta et al.
9,339,864 B2 5/2016 Hosoi
D761,398 S 7/2016 Murphy
D767,329 S 9/2016 Mock
D770,895 S 11/2016 Brown
9,493,274 B2 11/2016 Ledun et al.
9,505,527 B1 11/2016 Campbell
D777,034 S 1/2017 Sill
9,550,604 B2 1/2017 Burleson, Jr.
9,555,936 B2 1/2017 Martindale et al.
D782,907 S 4/2017 Sowieja
9,617,043 B2 4/2017 McGirr et al.
D786,673 S 5/2017 Moffat
9,637,269 B1 5/2017 Zabaleta et al.
9,676,524 B2 6/2017 Conley et al.
D792,220 S 7/2017 Simons
D793,861 S 8/2017 Siegel
D795,693 S 8/2017 Zabeleta
D798,656 S 10/2017 Steel
D799,215 S 10/2017 Pacha
9,821,926 B2 11/2017 Robinson et al.
9,868,564 B2 1/2018 McGirr et al.
9,878,821 B2 1/2018 Sibley
D809,868 S 2/2018 Eyal
D812,474 S 3/2018 Rust
D813,606 S 3/2018 O'Nan
9,938,043 B2 4/2018 Chasteen et al.
10,040,593 B2 8/2018 Ross et al.
D828,753 S 9/2018 Zabaleta
10,095,901 B1 10/2018 Fogarty
10,124,941 B2 11/2018 Sibley et al.
10,214,323 B2 2/2019 Conley et al.
10,232,990 B2 3/2019 Sang et al.
D860,716 S 9/2019 Abante et al.
10,427,832 B1 10/2019 Zabaleta et al.
10,486,864 B2 11/2019 Van Goolen
D871,133 S 12/2019 Bullock et al.
10,494,152 B2 12/2019 Ramsey
10,513,375 B2 12/2019 Karll
10,519,016 B2 12/2019 Kelly et al.
10,597,205 B2 3/2020 Sibley et al.
10,875,076 B2 12/2020 Scott
10,926,925 B2 2/2021 Seiders et al.
D916,590 S 4/2021 Albright
D917,281 S 4/2021 Will
D917,282 S 4/2021 Albright
D917,283 S 4/2021 Albright
D917,284 S 4/2021 Albright
10,968,010 B1 4/2021 Zabaleta et al.
11,130,606 B2 9/2021 Ross et al.
D959,981 S 8/2022 Stammen
D976,704 S 1/2023 Stammen
D977,971 S 2/2023 Stammen
D997,720 S 9/2023 Stammen
2001/0003292 A1 6/2001 Sun et al.
2001/0037668 A1 11/2001 Fields
2001/0040167 A1 11/2001 Flecheux et al.
2002/0008109 A1 1/2002 Hirota
2002/0030053 A1 3/2002 Copeland
2003/0051445 A1 3/2003 Martin et al.
2003/0116521 A1 6/2003 Chupak
2003/0213709 A1 11/2003 Gibler et al.
2003/0213803 A1 11/2003 Chasteen
2004/0089629 A1 5/2004 Villaescusa
2004/0159662 A1 8/2004 Johnson
2004/0256386 A1 12/2004 LaFortune
2005/0008458 A1 1/2005 Keech et al.
2005/0029264 A1 2/2005 Werth
2005/0039416 A1 2/2005 Hidding
2005/0067365 A1 3/2005 Hanafusa et al.
2005/0115969 A1 6/2005 Mizuma
2005/0127077 A1 6/2005 Chupak
2005/0150889 A1 7/2005 Perra
2006/0011633 A1 1/2006 Cook et al.
2006/0163253 A1* 7/2006 Steadman ..... B65D 17/506 220/269
2007/0017089 A1 1/2007 Hosoi
2007/0045318 A1 3/2007 Gibson et al.
2007/0062952 A1 3/2007 Kobayashi et al.
2007/0170184 A1 7/2007 Canedo
2007/0249424 A1 10/2007 Marshall et al.
2007/0266755 A1 11/2007 Cook et al.
2008/0011702 A1 1/2008 Walsh
2008/0047922 A1 2/2008 Olson et al.
2008/0053997 A1 3/2008 Perra
2008/0099480 A1 5/2008 Chang
2008/0110922 A1 5/2008 Sines
2008/0168818 A1 7/2008 Gillest et al.
2008/0237235 A1* 10/2008 Morabito ..... B65D 39/08 220/288
2009/0026201 A1 1/2009 Hall et al.
2009/0045158 A1 2/2009 Suriol
2009/0200306 A1 8/2009 Breunig
2009/0211329 A1 8/2009 Hanafusa et al.
2009/0236353 A1 9/2009 Martin et al.
2009/0261101 A1 10/2009 Forrest
2010/0051576 A1 3/2010 Tran et al.
2010/0059516 A1 3/2010 Parker
2010/0065528 A1 3/2010 Hanafusa et al.
2010/0126992 A1 5/2010 Phillips
2010/0133275 A1 6/2010 Phillips
2010/0264109 A1 10/2010 Pedraza et al.
2010/0294768 A1 11/2010 Ramsey et al.
2010/0320207 A1* 12/2010 Sjogren ..... B65D 51/007 220/270
2011/0036839 A1 2/2011 Gardner
2011/0036840 A1 2/2011 Zakai

(56) References Cited

U.S. PATENT DOCUMENTS

| | | | |
|---|---|---|---|
| 2011/0056945 | A1 | 3/2011 | Ramsey |
| 2011/0062106 | A1 | 3/2011 | Caspar |
| 2011/0100946 | A1 | 5/2011 | Perra |
| 2011/0114649 | A1 | 5/2011 | Adams et al. |
| 2011/0168709 | A1 | 7/2011 | Wells |
| 2011/0174639 | A1 | 7/2011 | Sibley |
| 2011/0226636 | A1 | 9/2011 | Petti |
| 2011/0232423 | A1 | 9/2011 | Raymond |
| 2011/0278255 | A1 | 11/2011 | Forrest et al. |
| 2012/0012586 | A1 | 1/2012 | Rinderer et al. |
| 2012/0031913 | A1 | 2/2012 | Moore et al. |
| 2012/0037631 | A1 | 2/2012 | Weist |
| 2012/0055925 | A1 | 3/2012 | Van Goolen |
| 2012/0061263 | A1 | 3/2012 | Sibley |
| 2012/0064468 | A1 | 3/2012 | Sibley |
| 2012/0138621 | A1 | 7/2012 | Bratsch |
| 2012/0199548 | A1 | 8/2012 | Kitto |
| 2012/0228294 | A1 | 9/2012 | Grissom |
| 2012/0273490 | A1 | 11/2012 | Jensen |
| 2013/0082055 | A1 | 4/2013 | Ramsey et al. |
| 2013/0199017 | A1 | 8/2013 | Kurosawa et al. |
| 2013/0200034 | A1 | 8/2013 | Kaanta |
| 2013/0240527 | A1 | 9/2013 | Philippe |
| 2014/0042164 | A1 | 2/2014 | Zabaleta |
| 2014/0238994 | A1 | 8/2014 | Christopoulos et al. |
| 2014/0262870 | A1 | 9/2014 | Sims et al. |
| 2014/0263150 | A1 | 9/2014 | Robinson et al. |
| 2014/0305942 | A1 | 10/2014 | Van Goolen |
| 2015/0013416 | A1 | 1/2015 | Hosoi |
| 2015/0108132 | A1 | 4/2015 | McGirr et al. |
| 2015/0136776 | A1 | 5/2015 | Chasteen et al. |
| 2015/0190003 | A1 | 7/2015 | Kelaher |
| 2015/0210438 | A1 | 7/2015 | Ledun et al. |
| 2015/0225107 | A1 | 8/2015 | Ross et al. |
| 2015/0321789 | A1 | 11/2015 | McGirr et al. |
| 2016/0016700 | A1 | 1/2016 | Stevens |
| 2016/0107796 | A1 | 4/2016 | Sibley |
| 2016/0166473 | A1 | 6/2016 | Young |
| 2016/0244213 | A1 | 8/2016 | Conley et al. |
| 2017/0129644 | A1 | 5/2017 | Jobges |
| 2017/0174398 | A1 | 6/2017 | Cox |
| 2017/0197241 | A1 | 7/2017 | Ellefson |
| 2017/0355495 | A1 | 12/2017 | Martin et al. |
| 2017/0355583 | A1 | 12/2017 | Kelly et al. |
| 2018/0002065 | A1 | 1/2018 | Thielen et al. |
| 2018/0044071 | A1 | 2/2018 | Conley et al. |
| 2018/0044155 | A1 | 2/2018 | Ross et al. |
| 2018/0134460 | A1 | 5/2018 | Ramsey |
| 2018/0148237 | A1 | 5/2018 | Sibley et al. |
| 2019/0061995 | A1 | 2/2019 | Albright |
| 2019/0112096 | A1 | 4/2019 | Gogola |
| 2019/0291914 | A1 | 9/2019 | Albright |
| 2019/0351473 | A1 | 11/2019 | Stammen |
| 2020/0031529 | A1 | 1/2020 | Van Goolen |
| 2023/0021579 | A1 | 1/2023 | Zabaleta |

FOREIGN PATENT DOCUMENTS

| | | | | |
|---|---|---|---|---|
| CA | 2929949 | A1 | 5/2015 | |
| CA | 2665477 | A1 | 10/2015 | |
| CN | 103781568 | B | 11/2015 | |
| CN | 110615174 | B | 5/2022 | |
| DE | 29914655 | U1 | 11/1999 | |
| DE | 102006051409 | A1 | 4/2008 | |
| EP | 0414249 | A2 | 2/1991 | |
| EP | 0740971 | A1 | 11/1996 | |
| EP | 0828663 | B1 | 12/1999 | |
| EP | 892742 | B1 * | 10/2000 | ..... B65D 17/401 |
| EP | 1154934 | B1 | 4/2004 | |
| EP | 1669299 | A1 | 6/2006 | |
| EP | 2269914 | A1 | 1/2011 | |
| EP | 2086700 | B1 | 11/2011 | |
| EP | 2212215 | B1 | 2/2012 | |
| EP | 2662295 | A1 | 11/2013 | |
| EP | 2662296 | A1 | 11/2013 | |
| EP | 2555988 | A1 | 6/2014 | |
| EP | 2253396 | B1 | 12/2014 | |
| EP | 2825334 | A1 | 1/2015 | |
| EP | 2692657 | B1 | 10/2016 | |
| GB | 2297076 | A | 7/1998 | |
| GB | 2552882 | A * | 2/2018 | ..... B65D 43/0225 |
| GB | 2537370 | B | 8/2019 | |
| HU | 229285 | B1 | 4/2004 | |
| JP | 2004210403 | A | 7/2004 | |
| JP | D1214756 | | 8/2004 | |
| JP | 2005096843 | A | 4/2005 | |
| JP | 3665002 | B2 | 6/2005 | |
| JP | 2005263230 | A | 9/2005 | |
| JP | 2005280768 | A | 10/2005 | |
| JP | 4173388 | B2 | 10/2008 | |
| JP | 2010036986 | A | 2/2010 | |
| JP | 5090290 | B2 | 12/2012 | |
| JP | 5151314 | B2 | 2/2013 | |
| JP | 5290569 | B2 | 9/2013 | |
| JP | 2013244996 | A | 12/2013 | |
| JP | D1579294 | | 6/2017 | |
| JP | D1579295 | | 6/2017 | |
| JP | D1594206 | | 1/2018 | |
| JP | D1594408 | | 1/2018 | |
| JP | D1678521 | | 2/2021 | |
| JP | D 1678522 | | 2/2021 | |
| KR | 301119524.0000 | | 7/2021 | |
| KR | 301125985.0000 | | 9/2021 | |
| KR | 301125987.0000 | | 9/2021 | |
| NL | 1029298 | C1 | 8/2005 | |
| NL | 1027703 | C1 | 6/2006 | |
| NL | 1028568 | C1 | 9/2006 | |
| NL | 2001544 | C2 | 10/2009 | |
| NL | 1043564 | B1 | 9/2021 | |
| NL | 1043660 | B1 | 10/2022 | |
| WO | WO1999032363 | A1 | 11/1998 | |
| WO | WO-0064771 | A1 * | 11/2000 | ..... B65D 1/26 |
| WO | WO2002083516 | A1 | 10/2002 | |
| WO | WO2004056667 | A1 | 7/2004 | |
| WO | WO2006009483 | A2 | 1/2006 | |
| WO | WO2007054568 | A1 | 5/2007 | |
| WO | WO2008/053014 | | 5/2008 | |
| WO | WO2009115377 | A1 | 9/2009 | |
| WO | WO2009151325 | A1 | 12/2009 | |
| WO | WO2010117009 | A1 | 10/2010 | |
| WO | WO2011025327 | A2 | 3/2011 | |
| WO | WO2011078057 | A1 | 6/2011 | |
| WO | WO2011124552 | A1 | 10/2011 | |
| WO | WO-2012046215 | A1 * | 4/2012 | ..... B65D 3/268 |
| WO | WO2012112051 | A2 | 8/2012 | |
| WO | WO2012133391 | A1 | 10/2012 | |
| WO | WO2012144490 | A1 | 10/2012 | |
| WO | WO2017123502 | A1 | 7/2017 | |
| WO | 2017151419 | A1 | 9/2017 | |
| WO | WO2018060889 | A1 | 4/2018 | |

OTHER PUBLICATIONS

Gold Candle Jars Timplate 307# Stretch Metal Can Lids, curiousexpeditions.org, 2 Pages. Found online Nov. 11, 2015 at http://papercanspackaging.sell.curiousexpeditions.org/iz6fge2dc-gold-candle-jars-tinplate-307-images.

PCT/US2022/044747 WIPO Search Report dated Jan. 12, 2023.

Canovation, posted Feb. 7, 2020 [retrieved Oct. 19, 2023]. Retrieved from intemet, https://www.packagingdigest.comltechnologies/innovation-adds-resealability-food-and-bevrage-cans (Year: 2020).

* cited by examiner

SEALING CAP HAVING TAMPER EVIDENCE RING FOR SEALING RESEALABLE CONTAINER AND METHOD OF USE

CROSS-REFERENCE TO RELATED APPLICATIONS

This Non-Provisional Patent Application is:

A. is a Divisional Application of co-pending United States Non-Provisional Utility Patent application Ser. No. 17/223,221, filed on 6 Apr. 2021 (currently pending),
   wherein U.S. application Ser. No. 17/223,221 is a Continuation of United States Non-Provisional Utility Patent application Ser. No. 16/035,583, filed on 13 Jul. 2018 (Issued as U.S. Pat. No. 10,968,010 on Apr. 6, 2021),
   wherein U.S. application Ser. No. 16/035,583 is a Continuation In Part claiming the benefit of United States Non-Provisional Utility Patent application Ser. No. 15/494,498, filed on 22 Apr. 2017 (Issued as U.S. patent Ser. No. 10/427,832 on Oct. 1, 2019),
   wherein U.S. application Ser. No. 15/494,498 is a Divisional Patent Application claiming the benefit of United States Non-Provisional Utility Patent application Ser. No. 15/056,216, filed on 29 Feb. 2016 (Issued as U.S. Pat. No. 9,637,269 on May 2, 2017),
   wherein U.S. application Ser. No. 15/056,216 is a Continuation In Part claiming the benefit of United States Non-Provisional Utility Patent application Ser. No. 14/665,102, filed on 23 Mar. 2015 (Issued as U.S. Pat. No. 9,272,819 on Mar. 1, 2016),
   wherein U.S. application Ser. No. 14/665,102 is a Divisional Patent Application claiming the benefit of United States Non-Provisional Utility Patent application Ser. No. 13/787,012, filed on 6 Mar. 2013 (Issued as U.S. Pat. No. 8,985,371 on 24 Mar. 2015),
   wherein U.S. application Ser. No. 13/787,012 is a Continuation-In-Part claiming the benefit of United States Non-Provisional Utility Patent application Ser. No. 13/572,404, filed on 10 Aug. 2012 (Issued as U.S. Pat. No. 8,844,761 on 30 Sep. 2014);

B. wherein U.S. application Ser. No. 14/665,102 is a Continuation In Part claiming the benefit of United States Non-Provisional Design Patent Application Ser. No. 29/491,268, filed on 19 May 2014 (Issued as U.S. Pat. D752,978 on 30 Sep. 2014),
   wherein U.S. application Ser. No. 29/491,268 is a Divisional Patent Application claiming the benefit of United States Non-Provisional Utility Patent application Ser. No. 13/787,012, filed on 6 Mar. 2013 (Issued as U.S. Pat. No. 8,985,371 on 24 Mar. 2015),
   wherein U.S. application Ser. No. 13/787,012 is a Continuation-In-Part claiming the benefit of United States Non-Provisional Utility Patent application Ser. No. 13/572,404, filed on 10 Aug. 2012 (Issued as U.S. Pat. No. 8,844,761 on 30 Sep. 2014);

C. wherein U.S. application Ser. No. 15/494,498 is a Continuation In Part claiming the benefit of United States Non-Provisional Design Patent Application Ser. No. 29/560,269, filed on 5 Apr. 2016 (Pending),
   wherein U.S. application Ser. No. 29/560,269 is a Continuation In Part claiming the benefit of United States Non-Provisional Design Patent Application Ser. No. 29/491,268, filed on 19 May 2014, (Issued as US Design Patent D752,978 on Apr. 5, 2016),
   wherein U.S. application Ser. No. 29/491,268 is a Divisional Patent Application claiming the benefit of United States Non-Provisional Utility Patent application Ser. No. 13/787,012, filed on 6 Mar. 2013 (issued as U.S. Pat. No. 8,985,371 on 24 Mar. 2015),
   wherein U.S. application Ser. No. 13/787,012 is a Continuation-In-Part claiming the benefit of United States Non-Provisional Utility Patent application Ser. No. 13/572,404, filed on 10 Aug. 2012 (Issued as U.S. Pat. No. 8,844,761 on 30 Sep. 2014);

D. wherein U.S. application Ser. No. 15/494,498 is a Continuation In Part claiming the benefit of United States Non-Provisional Design Patent Application Ser. No. 29/560,269, filed on 5 Apr. 2016 (Issued as U.S. Pat. D795,693 on Aug. 9, 2017),
   wherein U.S. application Ser. No. 29/560,269 is a Continuation In Part claiming the benefit of United States Non-Provisional Utility Patent application Ser. No. 15/056,216, filed on 29 Feb. 2016 (Issued as U.S. Pat. No. 9,637,269 on May 2, 2017),
   wherein U.S. application Ser. No. 15/056,216 is a Continuation In Part claiming the benefit of United States Non-Provisional Utility Patent application Ser. No. 14/665,102, filed on 23 Mar. 2015 (Issued as U.S. Pat. No. 9,272,819 on Mar. 1, 2016),
   wherein U.S. application Ser. No. 14/665,102 is a Divisional Patent Application claiming the benefit of United States Non-Provisional Utility Patent application Ser. No. 13/787,012, filed on 6 Mar. 2013 (Issued as U.S. Pat. No. 8,985,371 on 24 Mar. 2015),
   wherein U.S. application Ser. No. 13/787,012 is a Continuation-In-Part claiming the benefit of United States Non-Provisional Utility Patent application Ser. No. 13/572,404, filed on 10 Aug. 2012 (Issued as U.S. Pat. No. 8,844,761 on 30 Sep. 2014); and E. is a Continuation In Part claiming the benefit of United States Non-Provisional Design Patent Application Ser. No. 29/777,334, filed on 5 Apr. 2021 (Pending),
   wherein U.S. application Ser. No. 29/777,334 is a Continuation In Part claiming the benefit of United States Non-Provisional Design Patent Application Ser. No. 29/777,331, filed on 5 Apr. 2021 (Pending),
   wherein U.S. application Ser. No. 29/777,331 is a Continuation In Part claiming the benefit of United States Non-Provisional Design Patent Application Ser. No. 29/777,270, filed on 5 Apr. 2021 (Pending),
   wherein U.S. application Ser. No. 29/777,270 is a Continuation In Part claiming the benefit of United States Non-Provisional Utility Patent application Ser. No. 16/035,583, filed on 13 Jul. 2018 (scheduled to Issue as U.S. Pat. No. 10,968,010 on Apr. 6, 2021);

all of which are incorporated by reference herein.

TECHNICAL FIELD

The present invention relates to a resealable lid and cap combination for a container, including the structure, method of manufacturing, and method of use thereof. In general, the resealable lid is assembled to a container such as an aluminum beverage can. The cap is assembled to the lid and rotated by the consumer to open and reseal the can. The rotational movement of the cap is converted into linear motion by one or more cam mechanisms to effect an opening action, fracturing a score line and bending a tear panel inward into the can. Once the can is opened, the cap can be removed for consumption of content stored therein and replaced to reseal the opened lid.

BACKGROUND OF THE PRESENT INVENTION

The beverage and can industries have long sought to create a can that is both economical to produce and convenient for use by consumers. In the past, beverage cans were provided with a "pull tab" which the consumer would grab by a ring, and pull until the tab was removed from the can. This created a problem in that the tab became disposable waste for which the consumer was responsible to ensure proper disposal. Often the consumer failed to properly dispose of the tab, thereby creating not only litter, but also a safety issue, in that the tabs could be swallowed by small children. Moreover, the edges of the pull tab were sharp enough that they could, if mishandled, cut the fingers or hands of the consumer or anyone else who handled a loose pull tab. As a result of these problems, the industry moved in the direction of a tab that stayed on the can after opening, thereby preventing both litter and any sharp edges from coming into contact with consumers.

The present state of the art is to have a "stay on" tab that is attached to the can lid by a rivet formed in the can lid next to the opening. The opening is formed by a score line, or frangible "kiss cut" which breaks when the tab is pulled up by the consumer. The score line, when broken, produces a hinged flap that stays connected to the can lid, but inside the can.

Beverage cans with stay on tabs suffer from at least the following deficiencies. First, they are not resealable, so that once the consumer opens the beverage, the contents are subject to loss of carbonation, and the influx of foreign material due to the contents being open to the surrounding environment. Secondly, in order to form the rivet which is used to secure the stay on tab to the beverage lid, the lid needs to be made of a different material, typically an aluminum alloy that is stronger than the aluminum alloy used to make the sides and bottom of the can. Further, the tab itself is typically made of a different alloy than the sides and lid, reflecting the need for a still stronger, typically heavier material As a result, recycling of the aluminum beverage can is problematic because the different materials need to be separated. The use of three different materials also tends to add weight, and expense, to the finished container.

A need exists for improved beverage containers that are resealable, cost effective to produce, and "green" in terms of avoiding waste and facilitating the recycling of aluminum cans. Concurrently, a need exists for improved methods for manufacturing beverage containers that result in faster production time, lower production costs, and improved products.

BRIEF DESCRIPTION OF THE PRESENT INVENTION

A container has a sidewall and integrally formed bottom. The container is preferably a beverage container, but could be adapted to any suitable container. A top lid includes a socket integrally formed therein; the socket including a substantially cylindrical sidewall and a bottom wall. A score line formed in the bottom wall defines a tear panel which forms an opening into the can when the score line is fractured and the tear panel is bent inward or removed. A cap is fitted in the socket and has a sidewall which is formed with cam surfaces. The cam surfaces, formed as grooves or slots, cooperate with bosses or detents formed in the cylindrical sidewall of the socket. The design of the cam surfaces and associated bosses translate the rotational motion of the cap into linear motion, wherein the linear motion fractures the score line and opens the tear panel. As the cap moves downwardly, a protrusion formed on the lower surface of the cap impinges on the periphery of the score line, fracturing the score line and subsequently pushes the tear panel into the can.

Once opened, the cap can be re-fitted into the socket, so that the cam surfaces engage the detents, and rotated to achieve a sealing position, whereby the contents of the can are protected from the ambient atmosphere. This will result in the prevention of spillage, the loss of carbonation, and the prevention of foreign objects from entering the can. The user can opt to discard the cap and/or container once the entire contents of the can are consumed.

Preferably, the container is a beverage container, commonly referred to as a "can," but the same principals described above could be used for other types of beverage containers, including bottles made of various materials, including plastic, paper, metal (such as aluminum), cartons, cups, glasses, etc. In one particularly preferred embodiment, the container can be an aluminum can manufactured of an Aluminum alloy material, and lid would be manufactured of the same Aluminum alloy material as the container. The cap is preferably made of plastic material of sufficient hardness that the cam surfaces do not deform during opening and closing operations.

The cap may be included with the container or offered as a separate implement, being sold separately from the beverage container, and re-useable after washing. Also, caps with different features may be provided, such as a cap that has a child's sip cup top, so that the beverage can be converted into a child's sip cup. Other implements can be envisioned, including a cap that has a baby bottle "nipple" formation to convert the beverage can into a baby bottle. In such an embodiment, the contents of the container could be infant formula. Each implement would be adapted to be removably attached to the resealable container lid.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

DETAILED DESCRIPTION OF THE PRESENT INVENTION

Figure 1:
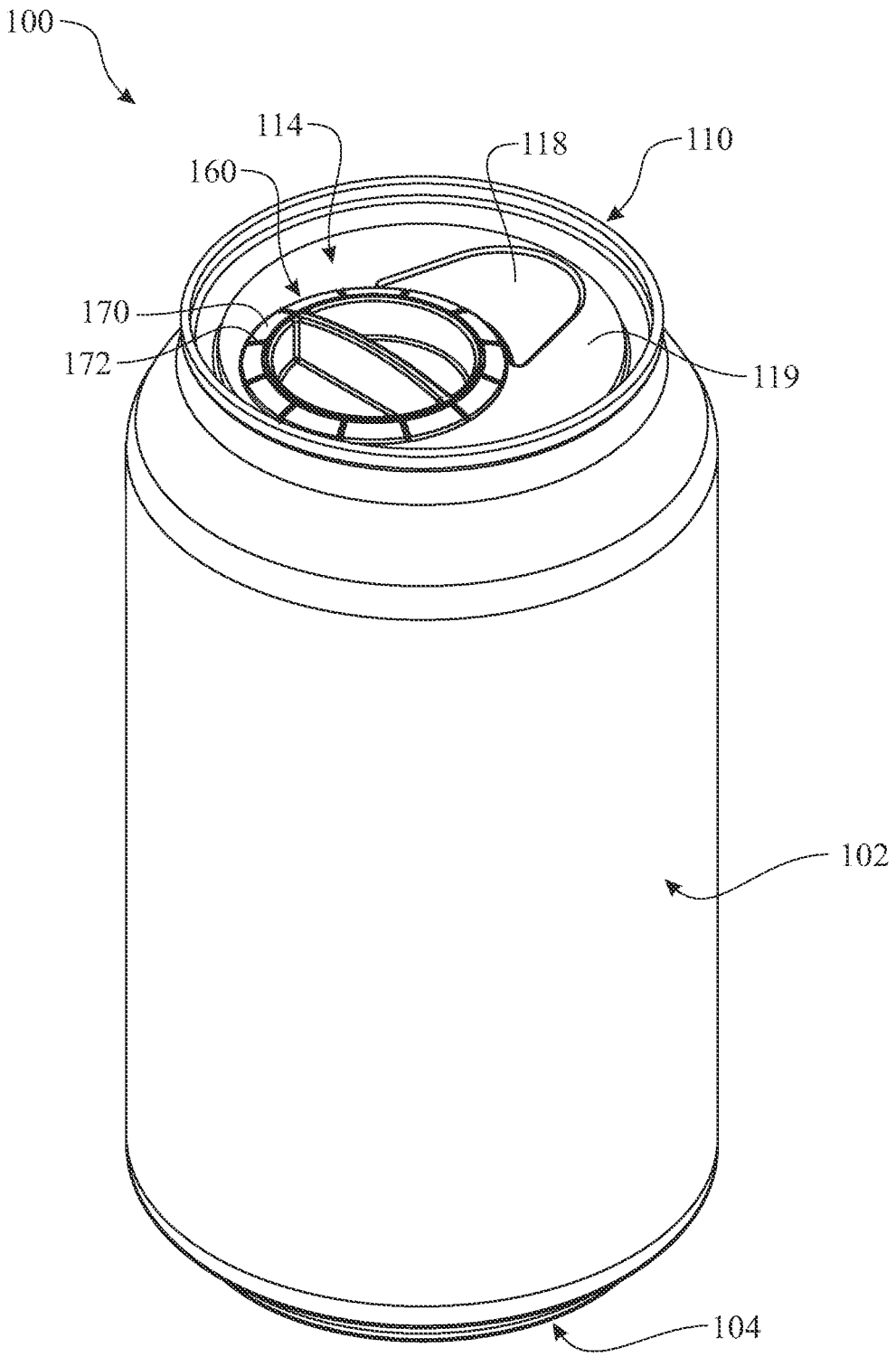
FIG. 1 presents a side isometric view introducing an exemplary container in accordance with the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

A container 100, exemplified as a beverage container in FIGS. 1 through 12, includes a container cylindrical sidewall 202, a container closed container closed bottom wall 204, integrally formed with the container cylindrical sidewall 102 and a resealable container lid 110 connected to the container cylindrical sidewall 102 at the end opposite the container closed container closed bottom wall 204. In the illustrated embodiment, the container 100 is a beverage container commonly referred to as a can, wherein the container closed container closed bottom wall 204 and the container cylindrical sidewall 102 are formed from a single piece of aluminum material, using otherwise known processes. The aluminum material is a lightweight aluminum alloy commonly used in the beverage can industry. The resealable container lid 110 is preferably made of the same lightweight aluminum alloy material, and is joined at the upper end of the sidewall through likewise known processes. The resealable container lid 110 includes a cap receiving socket 130 which extends downwardly into the container 100 from a resealable container lid upper surface 114. The cap receiving socket 130 is formed near a peripheral edge or lip of the resealable container lid 110 as is customary in the art, to allow drinking from the container 100. A resealable container cap 160 fits into the cap receiving socket 130 and engages same in a manner described in more detail below. The container cylindrical sidewall 202 of the container 100 is preferably tapered at both the upper and lower ends to provide greater structural integrity, particularly for use with pressurized contents, such as when used for carbonated beverages.

The resealable container lid 110 has an outer perimeter that is connected to the upper open end of the container cylindrical sidewall 102 of the beverage container, using known processes, to form an enclosure which contains a beverage. Beverages contained therein are not limited, but include carbonated or non-carbonated beverages, and could also include foodstuffs, and non-edible products. The cap receiving socket 130 is integrally formed in the resealable container lid upper surface 114 of the resealable container lid 110 and includes a cap receiving socket cylindrical sidewall 132, which extends downwardly into the container 100, and a cap receiving socket bottom wall 134. A cap receiving socket bottom panel circular score line 136 is formed in the cap receiving socket bottom wall 134 in order to create a cap receiving socket bottom panel tear panel 138 (see FIGS. 13B, 13C and 13D) which is pushed into the can when the can is opened. In the opened position, the cap receiving socket bottom panel tear panel 138 remains connected to the cap receiving socket bottom wall 134 due to the fact that the cap receiving socket bottom panel circular score line 136 does not make a complete circle or loop; a tear panel hinge 139 is created where the cap receiving socket bottom wall 134 is not scored (see FIG. 5).

Figure 9:
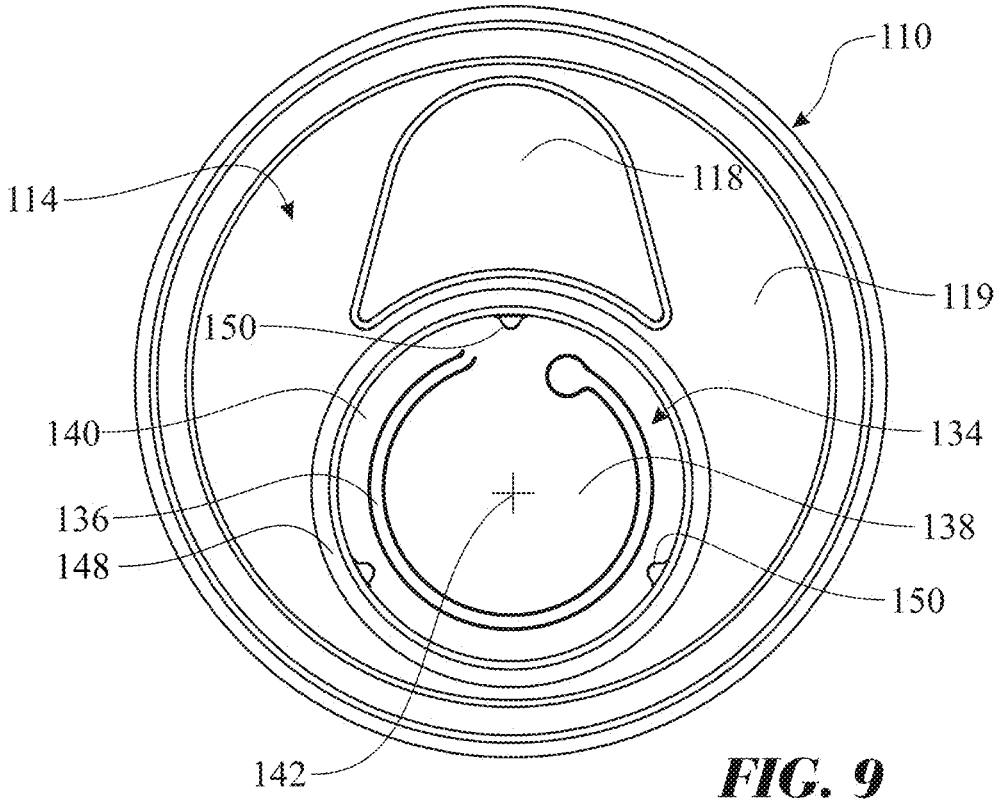
FIG. 9 presents a top view of the exemplary container originally introduced in FIG. 1FIG., wherein the illustration excludes the cap to introduce projections inside the socket for engaging with cam surfaces of the cap.

As seen in figures, the resealable container cap 160 is sized to fit substantially within the cap receiving socket 130, and includes a flat annular cap bottom sealing surface 167 which is disposed between the cam shaped cap bottom surface 166 and the cap's resealable container cap cylindrical sidewall 162. In FIG. 9, the cap receiving socket bottom wall 134 of the cap receiving socket 130 may include a cap receiving socket bottom panel flat annular surface 140 which is disposed between the cap receiving socket cylindrical sidewall 132 and the cap receiving socket bottom panel circular score line 136. When assembled and in the "resealed" position shown in FIG. 13D, the flat annular cap bottom sealing surface 167 of the resealable container cap 160 comes into contact with the cap receiving socket bottom panel flat annular surface 140 of the bottom of the cap receiving socket 130 to effectively reseal the container 100.

The resealable container lid 110 has a shallow, resealable container lid upper surface reinforcement formation 118 which serves two purposes. First, the resealable container lid upper surface reinforcement formation 118 acts as a stiffening structure to provide greater strength to the resealable container lid 110. This is particularly advantageous if the resealable container lid 110 is to be made of the same aluminum alloy as the container cylindrical sidewall 102 and container closed container closed bottom wall 204 of the container 100. Secondarily, the resealable container lid upper surface reinforcement formation 118 adds a familiar look to consumers who are accustomed to the prior art beverage containers employing a pull tab that is operated first in an opening direction, and then secondly, in a seated direction, where the hinged pull tab is positioned after opening.

Figure 2:
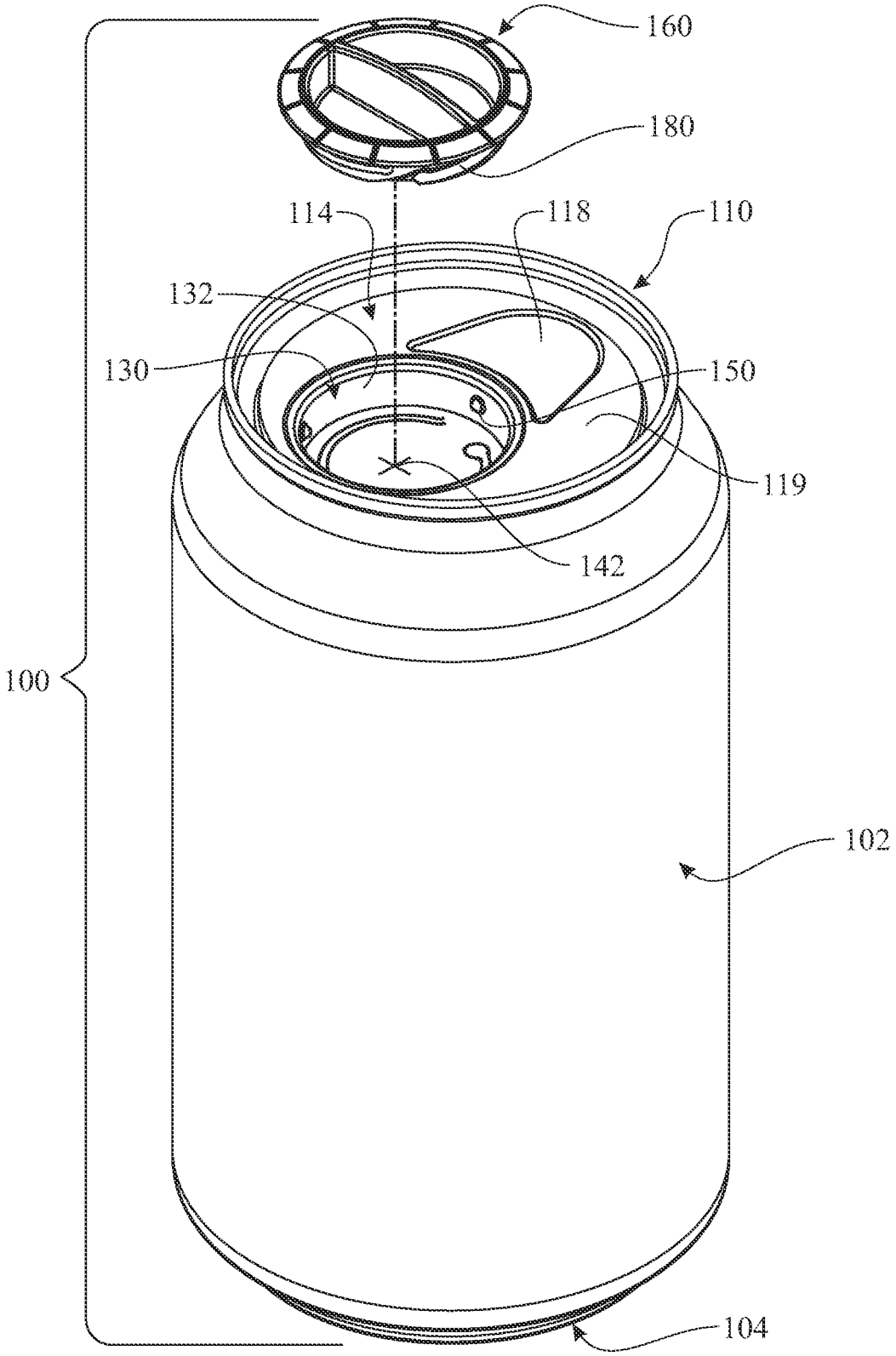
FIG. 2 presents a side isometric exploded assembly view of the container introduced in FIG. 1, wherein the illustration reveals features of a cap and a socket of the exemplary container.
Figure 3:
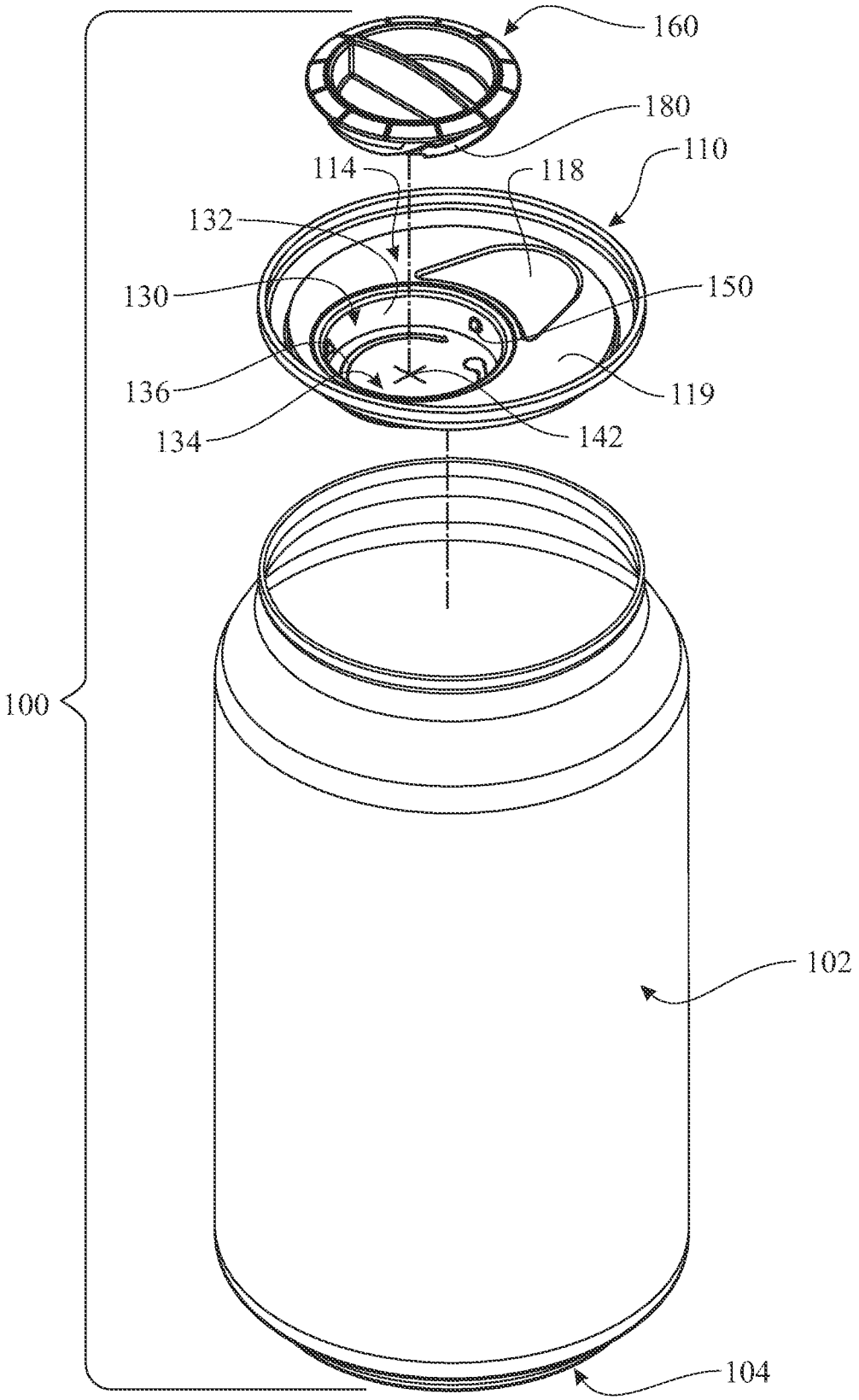
FIG. 3 presents a side isometric exploded assembly view of the container introduced in FIG. 1, wherein the illustration additionally separates the lid and the exemplary container body.
Figure 4:
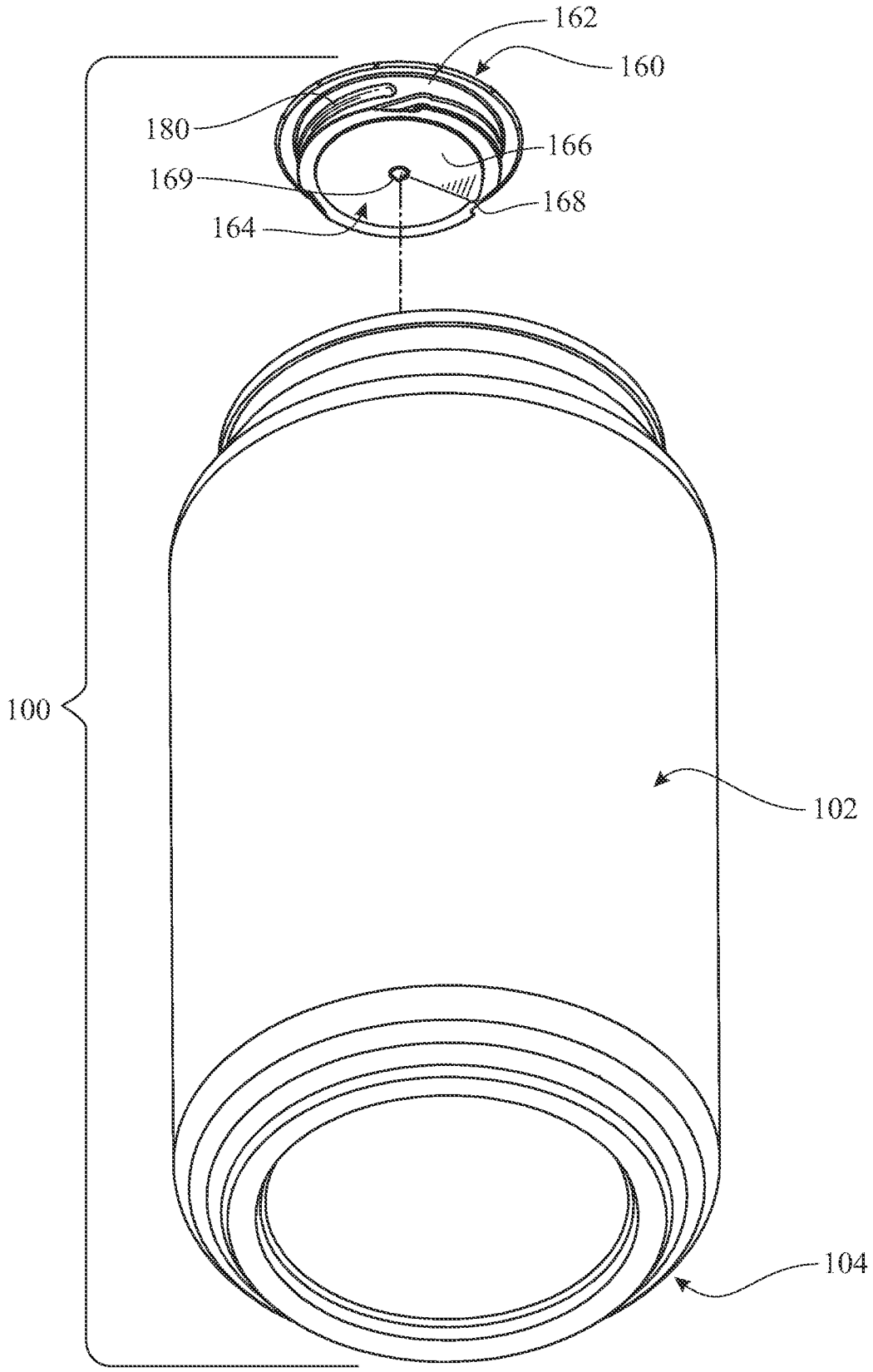
FIG. 4 presents a bottom isometric exploded assembly view of the container as shown in FIG. 2.
Figure 5:
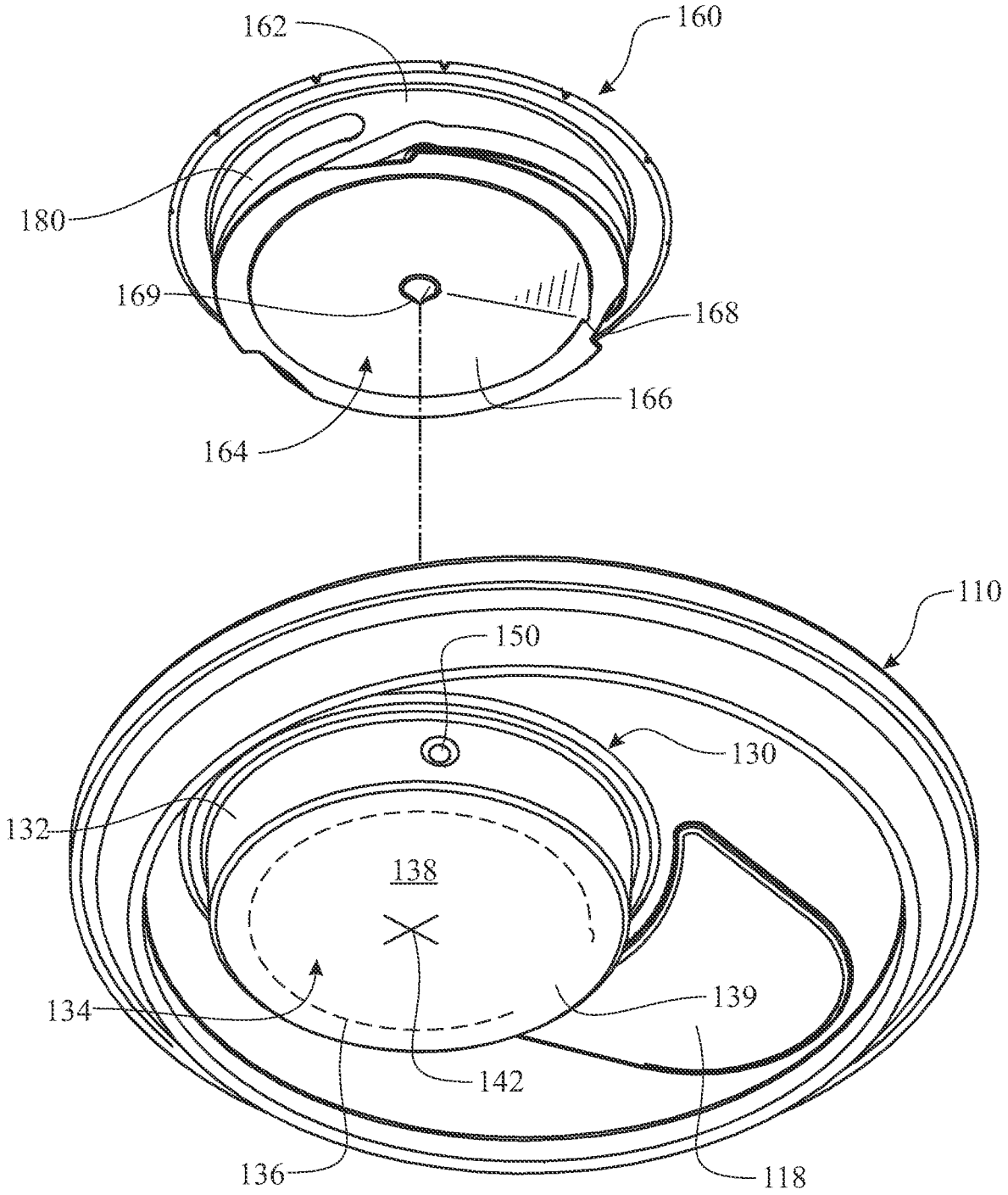
FIG. 5 presents an enlarged, bottom isometric exploded assembly view of the lid and the cap of the exemplary container introduced in FIG. 1.

As shown in FIGS. 2, 3 and 5, the cap receiving socket cylindrical sidewall 132 of the cap receiving socket 130 has a plurality of equally spaced socket sidewall cam engaging projections 150, disposed substantially on the same plane and being integrally formed in the sidewall 22. FIG. 5 shows one protrusion as an indentation or recess, since FIG. 5 shows the outer cylindrical sidewall 132 of the resealable container lid 110, whereas the other figures show the inner cap receiving socket cylindrical sidewall 132 of the resealable container lid 110. The socket sidewall cam engaging projections 150 cooperate with the resealable container cap 160 in a manner described below in order to open and reseal the container 100.

Figure 6:
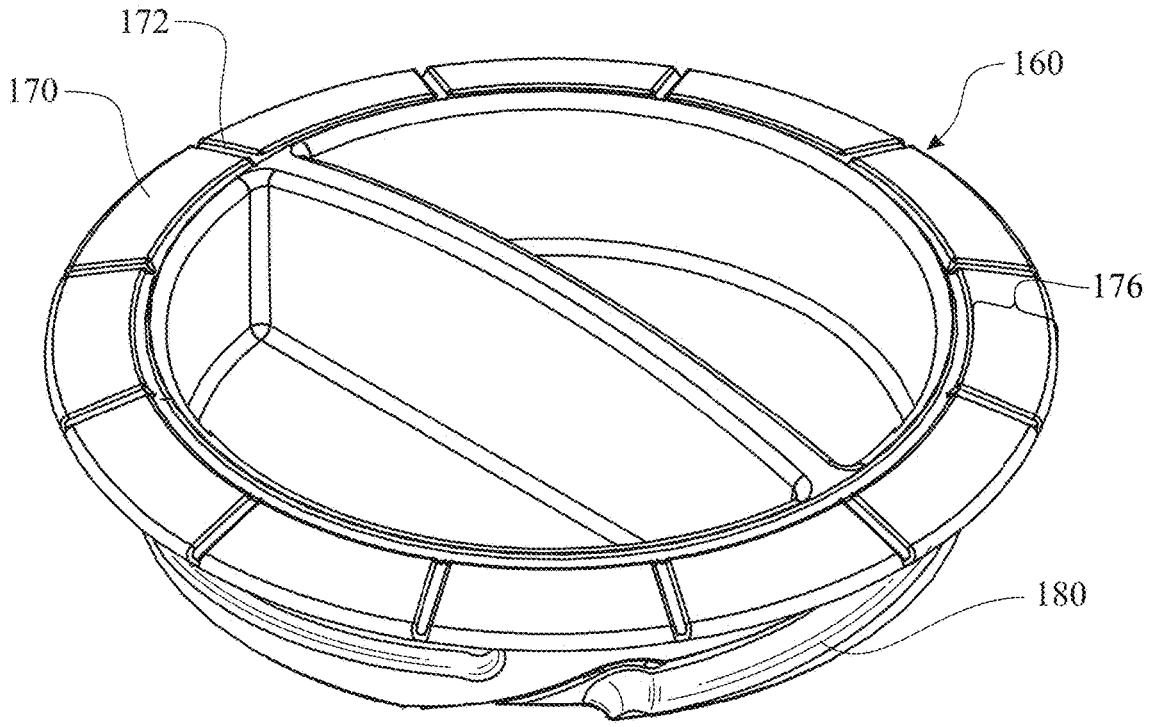
FIG. 6 presents an enlarged, top and side isometric view of the cap originally introduced in FIG. 1.
Figure 7:
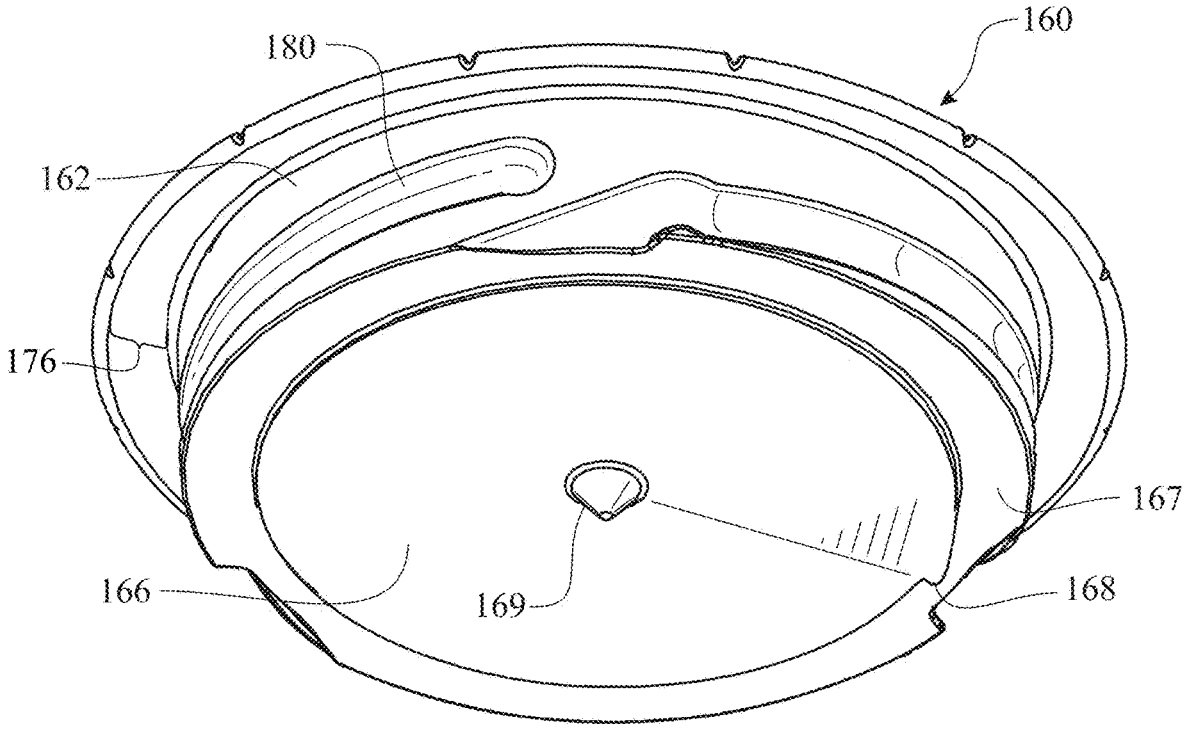
FIG. 7 presents an enlarged, bottom and side isometric view of the cap originally introduced in FIG. 1.

Referring to FIGS. 5-7, the resealable container cap 160 has a radially extending cap skirt 170 which acts as a tamper proof indicator. As seen in FIG. 1, prior to opening the container 100, the radially extending cap skirt 170 seats flush with the resealable container lid planar upper surface outer segment 119 of the resealable container lid 110. The skirt is integrally formed with the resealable container cap 160, which is preferably made of plastic material. The radially extending cap skirt 170 includes a series of radially extending cap skirt frangible score lines 172, extending radially outwardly, which are operable to break during the opening operation of the can. The breaking of the score lines 172 is effected by the skirt 170 being driven downwardly as the resealable container cap 160 is twisted or rotated and thereby advances downwardly into the cap receiving socket 130. Opening of the beverage container will thus be evident by the broken score lines 172 of the radially extending cap skirt 170, and preferably, by the sections of the radially extending cap skirt 170 that are formed by the broken score lines 172 extending at an angle upwardly, thus extending radially outwardly and radially upwardly.

The resealable container cap 160 is preferably made of a molded plastic material, is sized to fit substantially within the cap receiving socket 130, and includes a cam shaped cap bottom surface 166 formed at the lower or inner end of a resealable container cap cylindrical sidewall 162. The cam shaped cap bottom surface 166 may include an integrally formed sharp or pointed offset projecting incisor 168 disposed offset to the center axis of the resealable container cap 160 and extending downwardly into the cap receiving socket 130 when the resealable container cap 160 is assembled in the cap receiving socket 130. When assembled, the offset projecting incisor 168 is disposed immediately above the cap receiving socket bottom panel circular score line 136, so that when the resealable container cap 160 moves downwardly during opening of the container 100 offset projecting incisor 168 punctures the can at the beginning of the cap receiving socket bottom panel circular score line 136, next to the tear panel hinge 139, then progressively propagates the rupture along the cap receiving socket bottom panel circular score line 136 to its terminus on the opposite end of the tear panel hinge 139.

The cam shaped cap bottom surface 166 may also include a centered projecting incisor 169 disposed on the center axis of the resealable container cap 160 and extending downwardly into the cap receiving socket 130 when the resealable container cap 160 is assembled in the cap receiving socket 130. When assembled, the projection is disposed immediate above an Cap receiving socket bottom panel centered "X" shaped score line 142, so that when the resealable container cap 160 moves downwardly during opening of the container, the projection punctures the can at the Cap receiving socket bottom panel centered "X" shaped score line 142, thereby relieving internal pressure and assisting in the rupturing of the cap receiving socket bottom panel circular score line 136 by the offset projecting incisor 168.

The opening operation of the container 100 is made possible by forming a cam structure between the cap receiving socket 130 and the resealable container cap 160. In particular, cam groove surfaces 180 are formed in the resealable container cap cylindrical sidewall 162 of the resealable container cap 160. The socket sidewall cam engaging projections 150 are fitted into and engage the cam groove surfaces 180 such that when the resealable container cap 160 is hand-twisted by the consumer, rotational motion of the resealable container cap 160 is converted into linear motion of the resealable container cap 160 thus driving the cap in a downward direction relative to the cap receiving socket 130. As the resealable container cap 160 moves downwardly, the cap receiving socket bottom panel circular score line 136 is ruptured by the offset projecting incisor 168, then progressively propagates the rupture along the cap receiving socket bottom panel circular score line 136 to its terminus. In an alternate embodiment, an optional Cap receiving socket bottom panel centered "X" shaped score line 142 may be ruptured by the centered projecting incisor 169 immediately before the cap receiving socket bottom panel circular score line 136 is ruptured by the offset projecting incisor 168, to thereby relieve internal pressure and assist in the rupture of the cap receiving socket bottom panel circular score line 136 by the offset projecting incisor 168.

Figure 8:
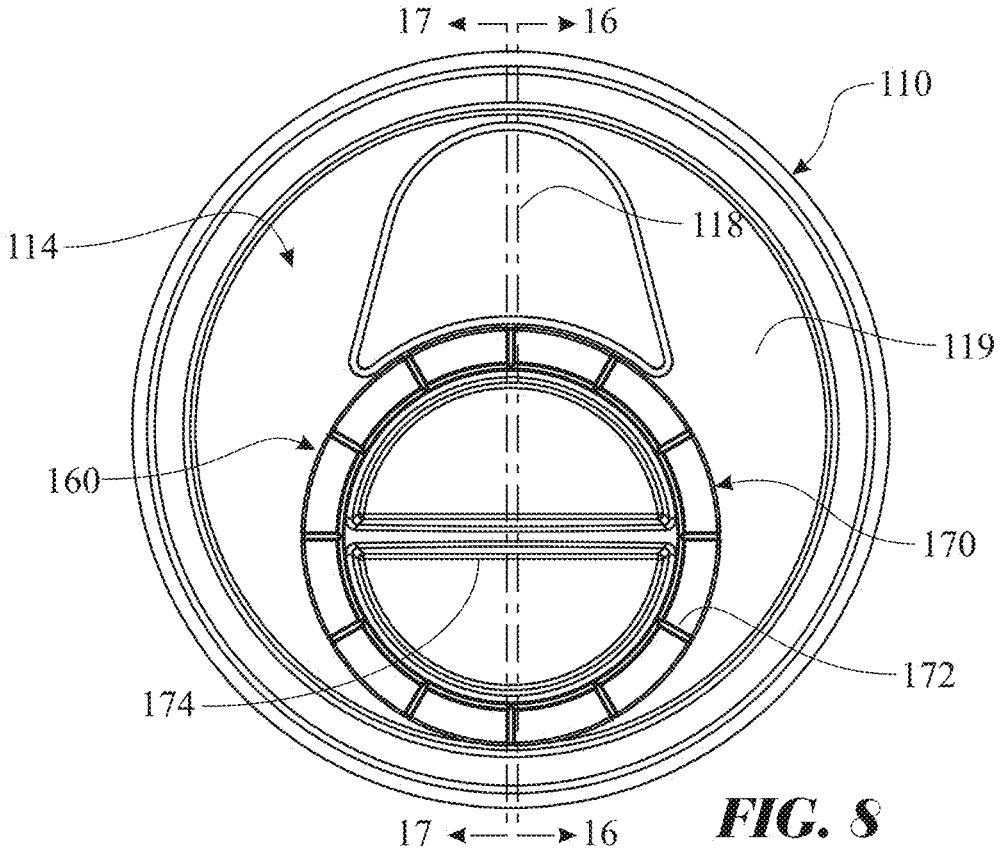
FIG. 8 presents a top view of the exemplary container originally introduced in FIG. 1, wherein the illustration includes the cap shown in an un-opened position.

As shown in FIG. 8, the resealable container cap 160 includes a resealable container cap grip element 174 for the consumer to grab when ready to open the beverage container, and also, as described below, for resealing the beverage container after opening. Depending on the contour of the cam surfaces and their direction of orientation, the cap can be rotated in one direction, preferably clockwise for opening, and then in the opposite direction, counterclockwise, to remove the cap during consumption of beverage, and then again back to the can-opening direction for resealing the beverage container if the contents are not entirely consumed. Symmetry of disposition of the three socket sidewall cam engaging projections 150 is shown in FIG. 9, wherein the three socket sidewall cam engaging projections 150 are located at approximately equal angular intervals of 120 degrees. Each projection engages a corresponding cam groove surface 180, more specifically, a first cam groove surface 181, a second cam groove surface 182, and a third cam groove surface 183. As shown in the illustrated embodiment, the resealable container cap cylindrical sidewall 162 of the resealable container cap 160 would be contoured, as by forming grooves, to form three cam groove surfaces 181, 182, 183. The cam surfaces or features 181, 182, 183 are shaped and sloped in a manner designed to cause the resealable container cap 160 to advance into an opening position without more than a quarter to half a turn, and as measured in radians, this would be no more than 1 to 2 radians. The number of projections and cam elements can be varied, although three provides a balance between cost and effectiveness.

Figure 10:
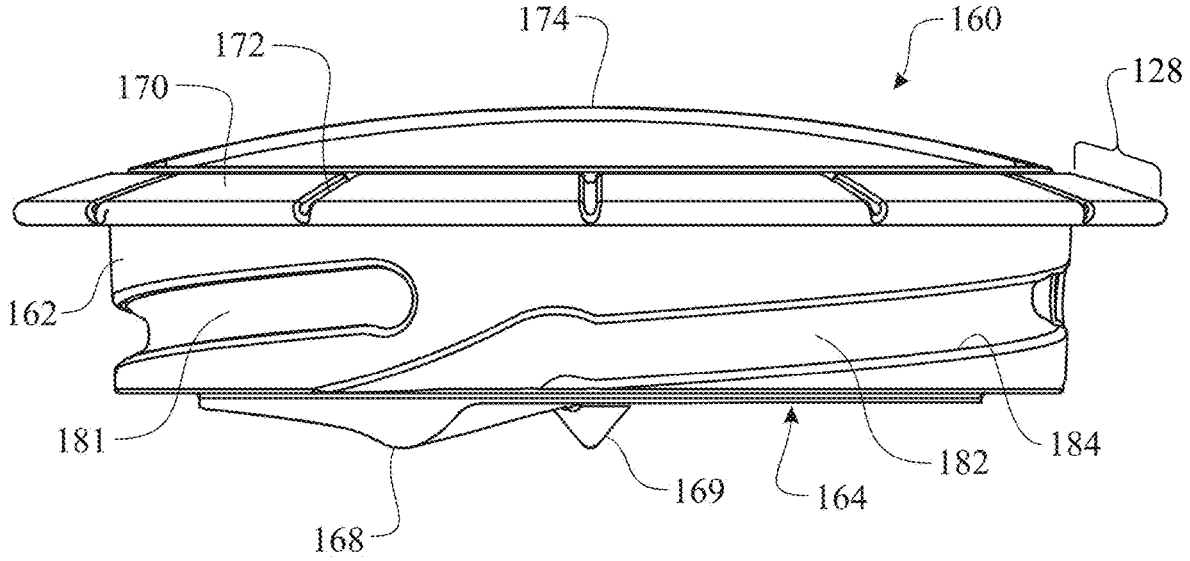
FIG. 10 presents an enlarged side elevation view of the cap, wherein the illustrations present details of the cam groove surfaces formed on a cylindrical sidewall of the cap.
Figure 11:
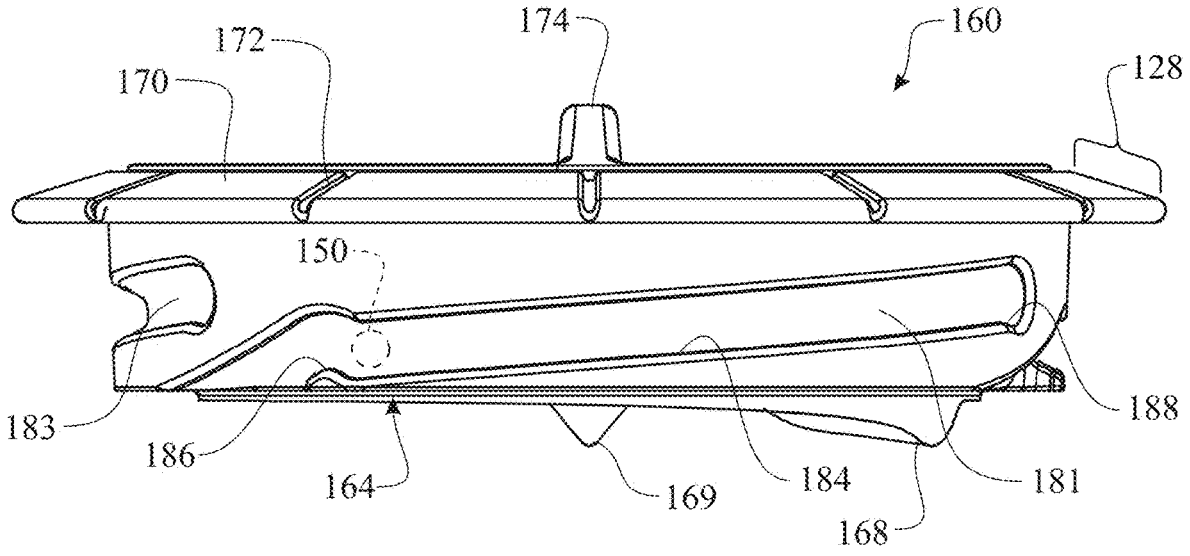
FIG. 11 presents an enlarged side elevation view of the cap, wherein the illustration presents the cap rotated ninety degrees (90°) from the illustration presented in FIG. 10.
Figure 12:
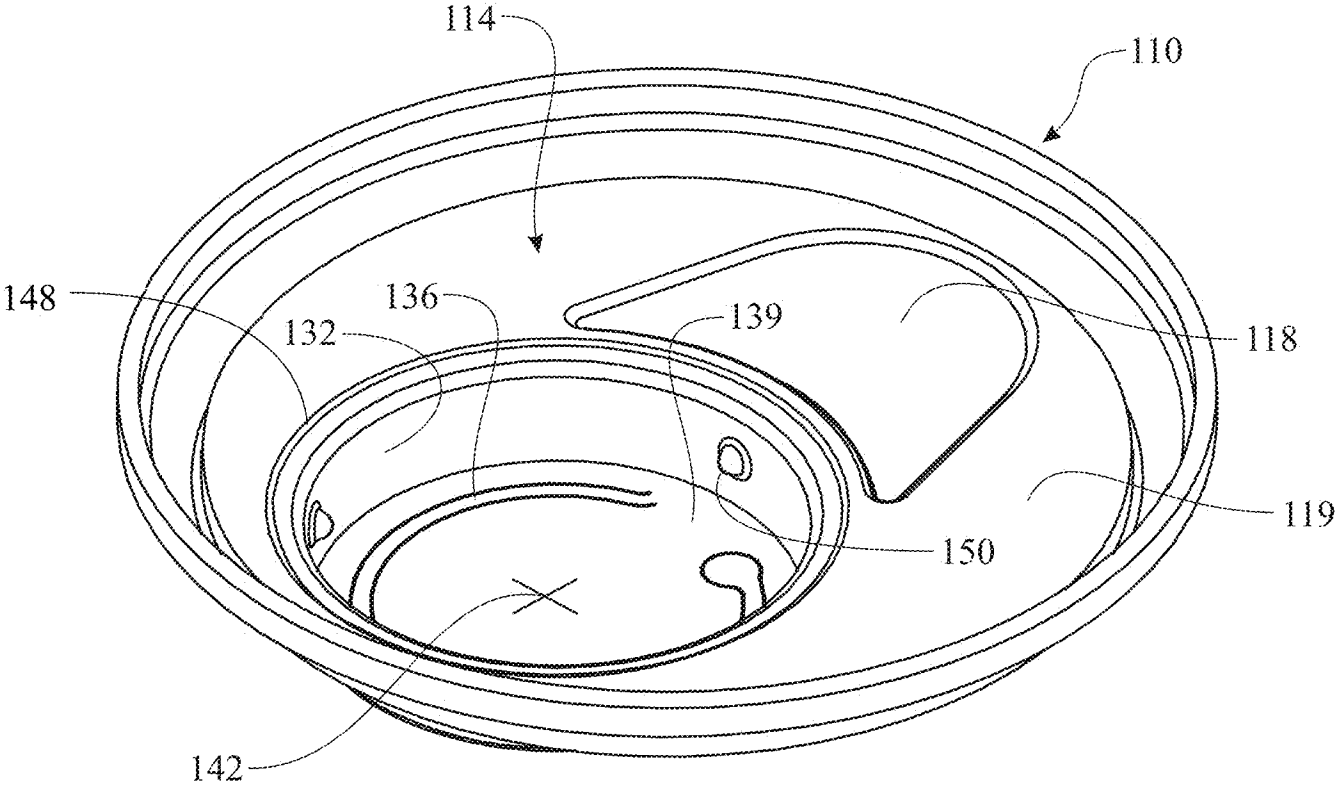
FIG. 12 presents a top isometric view of the resealable container lid, wherein the illustration excludes the cap to expose features of the socket.

The cap resealable container cap cylindrical sidewall 162 includes three equally spaced cam groove surfaces 181, 182 and 183, as best shown in FIGS. 10 and 11. The cam groove surfaces 181 and 182 and the resealable container cap grip element 174 extending across the page are best illustrated in FIG. 10. The resealable container cap bottom surface 164 of the resealable container cap 160 includes the centered projecting incisor 169, acting as a piercing element, which punctures the cap receiving socket bottom panel centered "X" shaped score line 142, and it further includes a further offset projecting incisor 168 which also acts as a piercing element. The projection 168 is designed and shaped to impinge on the cap receiving socket bottom wall 134 of the cap receiving socket 130 inside and juxtaposed the cap receiving socket bottom panel circular score line 136. As the resealable container cap 160 is rotated, from the unopened position shown in FIG. 10, the cam structure turns the rotational movement to translational movement, thus moving the cap inwardly. As the resealable container cap 160 moves inwardly, the offset projecting incisor 168 rotates until, preferably, it reaches the position shown in FIG. 11, wherein a portion of the cap receiving socket bottom wall 134 breaks away and is pushed inwardly to form the cap receiving socket bottom panel tear panel 138 that remains hinged to the cap receiving socket bottom wall 134 by virtue of the cap receiving socket bottom panel circular score line 136 not extending to a complete loop. The offset projecting incisor 168 starts at the beginning of the cap receiving socket bottom panel circular score line 136 and only travels ninety degrees (90°). Thus, offset projecting incisor 168 will only have traveled a portion of the length. What pushes the cap receiving socket bottom panel tear panel 138 out of the way is the body of the cam shaped cap bottom surface 166 going past the plane of the cap receiving socket 130 cap receiving socket bottom wall 134. Notice that the cam shaped cap bottom surface 166 protrudes out from the flat annular cap bottom sealing surface 167.

Figure 13A:
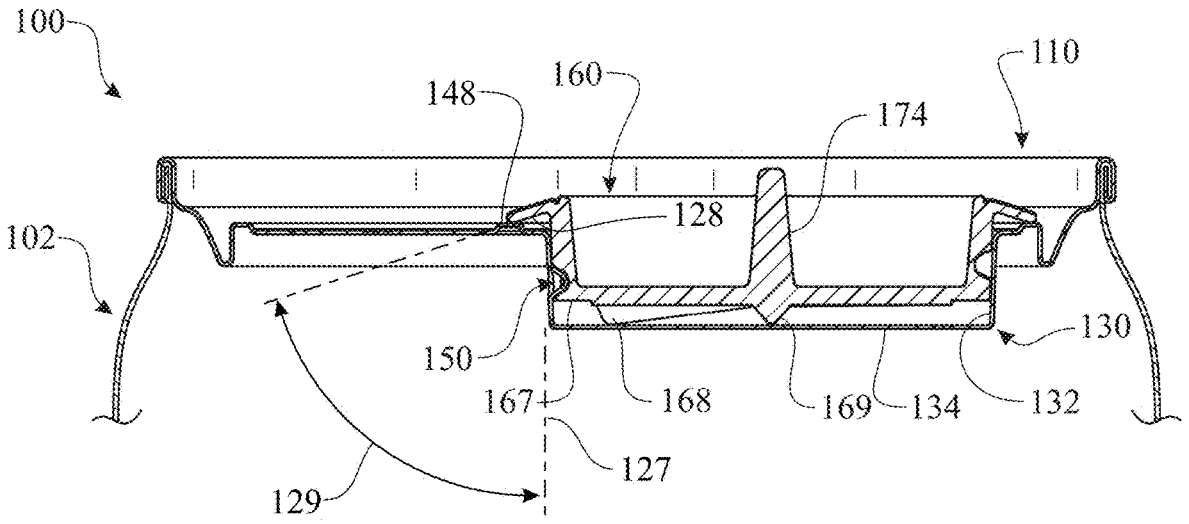
FIG. 13A presents a cross sectional elevation view of the cap in a sealed condition, following bottling, and prior to fracturing a score line to open the container.

Cross sectional views of the cap moving between opening and resealing positions are shown in FIGS. 13A through 13D. In FIG. 13A, the resealable container cap 160 is shown in cross section prior to opening the beverage container. Thus, the cap receiving socket bottom wall 134 of the cap receiving socket 130, the cap receiving socket cylindrical sidewall 132 of the cap receiving socket 130, and the resealable container lid upper surface 114 form the resealable container lid 110. The resealable container cap 160 is shown in the storage position, i.e., pre-opening of the can, in FIG. 13A, wherein the cap receiving socket bottom wall 134 is not punctured and the contents of the container 100 are air tight for potentially long term storage. The resealable container cap grip element 174 is shown in a first, unopened position. In this position the flat annular cap bottom sealing surface 167 of the resealable container cap 160 is spaced above the socket cap receiving socket bottom wall 134, but the offset projecting incisor 168 is close to or in slight contact with the cap receiving socket bottom panel circular score line 136. Similarly, if a second centered projecting incisor 169 is employed at the center of the lower end of the resealable container cap 160, it is also disposed in close proximity to the score line 44 if not slightly touching.

Figure 13B:
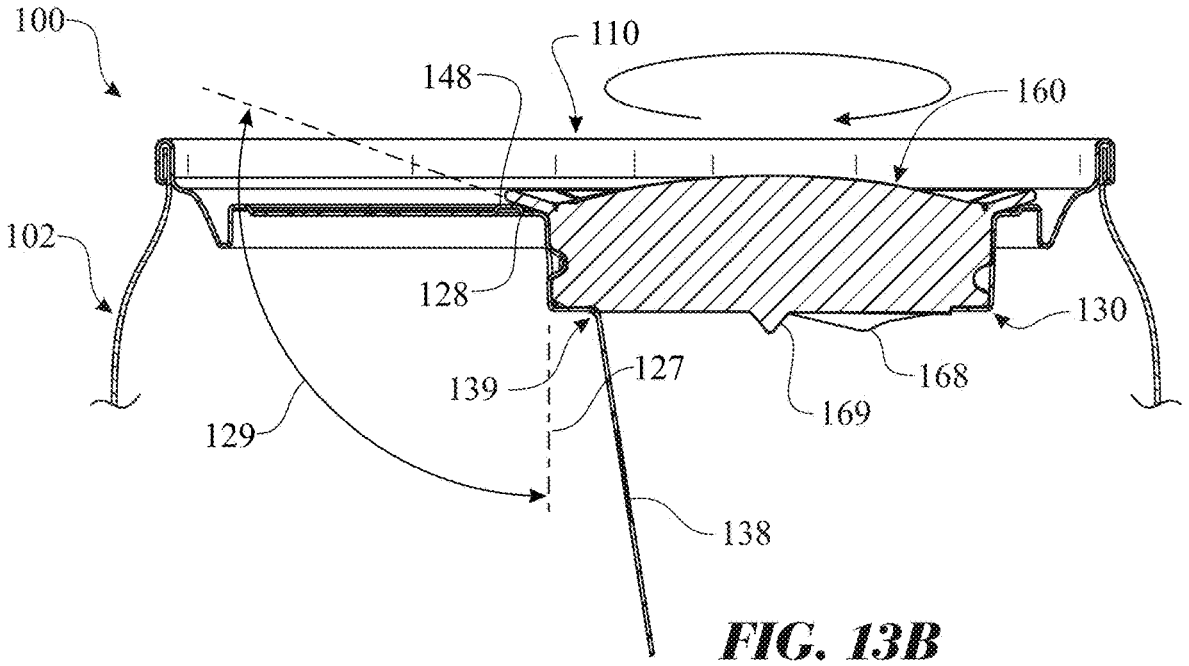
FIG. 13B presents a cross sectional elevation view of the cap, wherein the illustration demonstrates a first step in use, wherein the cap is rotated to open the container.

The resealable container cap 160 is rotated clockwise approximately ninety degrees (90°), as shown in FIG. 13B. Engagement between the cam groove surfaces 180 and the socket sidewall cam engaging projections 150 translates the resealable container cap 160 downwardly by a distance sufficient to cause the offset projecting incisor 168 to rupture the cap receiving socket bottom panel circular score line 136 as the projection moves along the inner side of the score line. The rupture creates a cap receiving socket bottom panel tear panel 138 which is pushed by the offset projecting incisor 168 into the interior of the container 100 by rotating downwardly about a tear panel hinge 139, wherein the tear panel hinge 139 is formed spanning between opposite ends of the cap receiving socket bottom panel circular score line 136. The opposite ends of the score line 136 are positioned to locate and define a pivot axis of the tear panel hinge 139 for the cap receiving socket bottom panel tear panel 138.

Figure 13C:
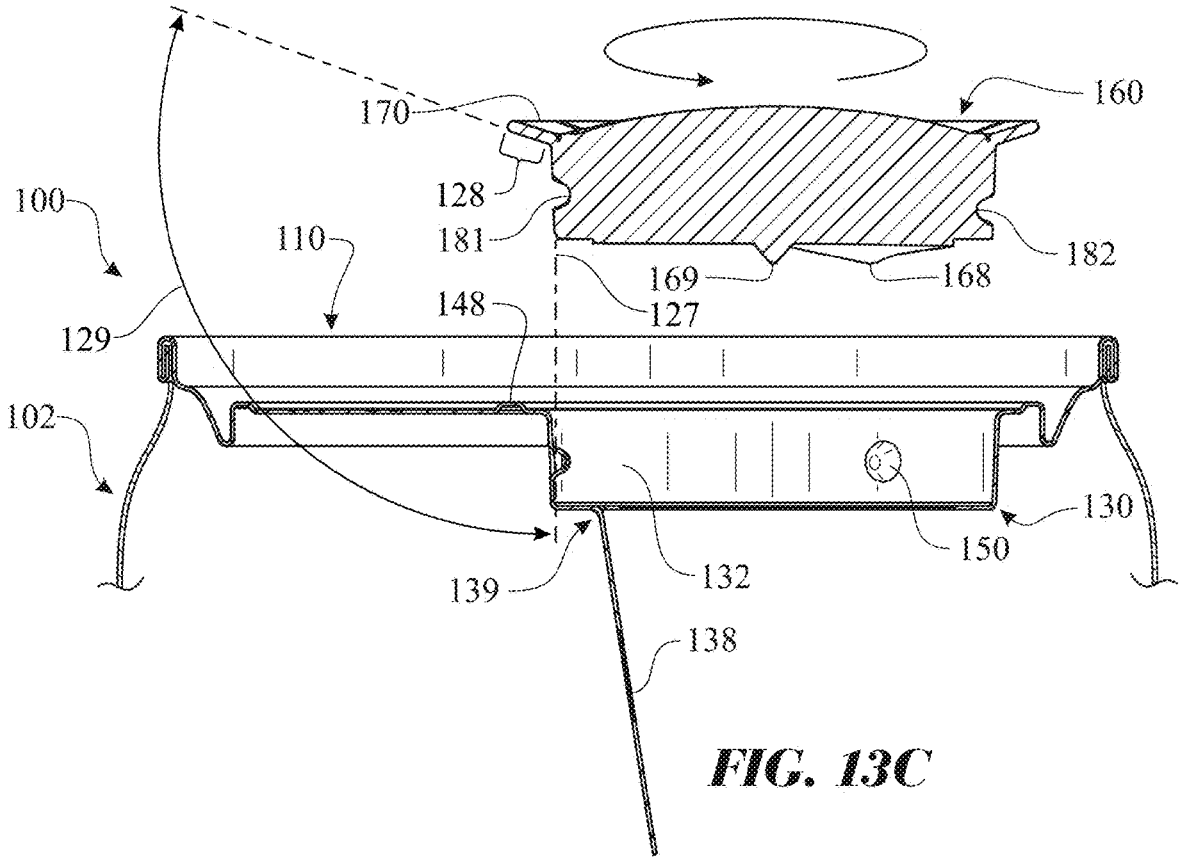
FIG. 13C presents a cross sectional elevation view of the cap, wherein the illustration demonstrates a second step in use, wherein the cap is removed from the lid of the container enabling dispensing and consumption of contents stored within the container.

After the cap receiving socket bottom panel tear panel 138 is formed, and the resealable container cap 160 is disposed at its innermost position relative to the socket, the consumer would then rotate the resealable container cap 160 counterclockwise, preferably by turning the resealable container cap grip element 174. The resealable container cap 160 is shown in FIG. 13C being separated from the container 100, and can be pocketed by the consumer, or placed in a location for easy access in case the consumer chooses not to consume the entire contents of the container 100. As evidence that the beverage container has been opened, the radially extending cap skirt 170 may be angled upwardly as a result of the frangible score lines being broken, so that individual sections of the skirt are now biased in an upward direction.

A circumferential tamper evidence actuating formation 148 is formed circumscribing the opening of the resealable container 100. The exemplary circumferential tamper evidence actuating formation 148 is formed on the resealable container lid upper surface 114 of the resealable container 100. The exemplary circumferential tamper evidence actuating formation 148 defines a radially oriented plane. The circumferential tamper evidence actuating formation 148 circumscribes the opening of the resealable container 100. The radially extending cap skirt 170 includes at least one, and preferably, a series of actuating members 128, wherein the actuating member 128 extend in a non-axial orientation, wherein an axial direction is identified by an axial or vertical direction reference 127 or having an acute angular relation 129 to the axial or vertical direction, wherein the angular relation is referenced by an acute angle 129 off the axial or vertical direction 127, wherein the acute angle and the obtuse angle are respective to the direction of axial motion during activation of the tamper evidence feature. The actuating member 128 is of a shape and size to engage with the circumferential tamper evidence actuating formation 148. Engagement between the cam groove surface 180 and the socket sidewall cam engaging projections 150 translates a rotational motion into an axial motion. The resulting axial motion of the resealable container cap 160 causes the actuating member 128 to engage with the circumferential tamper evidence actuating formation 148. During the resulting axial motion of the resealable container cap 160 respective to the resealable container 100, the non-axial orientation (angle off axial direction 127) of the actuating member 128 against a contacting surface of the circumferential tamper evidence actuating formation 148 causes the radially extending cap skirt 170 to deform, as illustrated in FIGS. 13A through 13C. The deformation can be at least one of a change in shape and a fracture. The deformation of the radially extending cap skirt 170 is sufficient to be clearly identified by the user, as best represented in the illustration presented in FIG. 13D, wherein the deformation is referenced against the resealable container lid upper surface 114 of the resealable container 100.

Also, when rotating counterclockwise, the cam groove surfaces 180 and the socket sidewall cam engaging projections 150 will eventually separate, allowing the resealable container cap 160 to be free of the container 100.

Figure 13D:
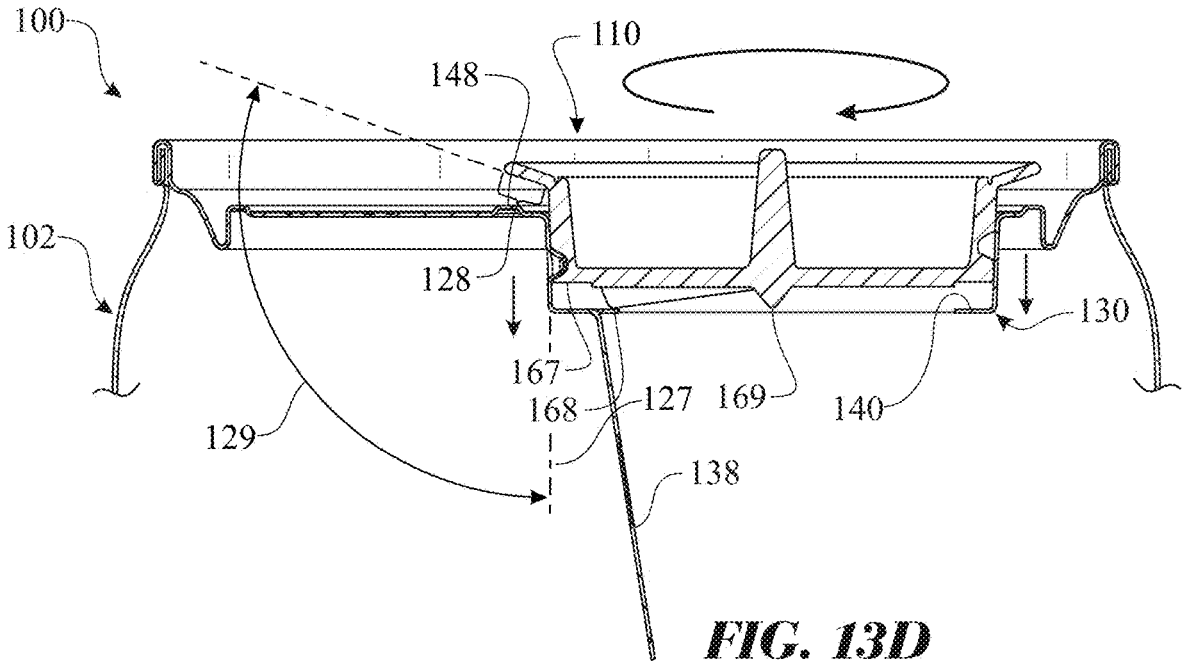
FIG. 13D presents a cross sectional elevation view of the cap, wherein the illustration demonstrates a third step in use, wherein the cap is replaced upon the lid of the container sealing any remaining contents within the container.

In the event that the consumer wishes to reseal the container 100, and as shown in FIG. 13D, the resealable container cap 160 is brought into contact with the cap receiving socket 130 by the consumer, by bringing the cam groove surfaces 180 into engagement with the socket sidewall cam engaging projections 150. Once this occurs, clockwise rotation will cause the resealable container cap 160 to translate downwardly until a sealing, seating arrangement is made between the cap receiving socket bottom panel flat annular surface 140 of the socket cap receiving socket bottom wall 134 and the flat annular cap bottom sealing surface 167 of the resealable container cap 160, thereby keeping the contents of the container 100 fresh and safe from foreign contaminants. The seal will retain carbonation when the contents are carbonated.

The resealable container cap 160 can be removed again and again to gain access to the contents of the beverage container until all contents are consumed. There is no limit to the type of beverages or other contents that can be housed in the container 100, but most commonly "canned" beverages include sodas, beer, juices, etc. It is also within the scope of the present invention that the contents of the containers could be foodstuff, and non-consumable liquids, gels, powders, and the like.

The cam means disclosed herein can be used for caps that provide other functionality for the container 100. For example, a variation of the resealable container cap 160 would be one that could include a passageway extending through the resealable container cap 160 with drinking implements formed at the upper, outer end, such as a child's sip cup, which would allow a child to drink from the container 100 without spilling. Alternatively, the resealable container cap 160 could be formed with an infant nipple for feeding formula, juice, water or other beverages suitable for infants. When using drinking implements such as sip cup and baby bottle nipples, a resealable container cap 160 would nonetheless have to be employed for opening the container, and then a second "cap" could be used for consuming the contents. In any event, the opening caps and drinking implements could be sold separately from the container 100, as long as the container 100 included the socket sidewall cam engaging projections 150 formed in the cap receiving socket cylindrical sidewall 132 of the cap receiving socket 130.

Although a wide range of plastic materials could be used to form the resealable container cap 160, other materials could be used, including ceramics and metals. However, for harder materials such as these, it may be necessary to position a gasket between the opposing annular surfaces 140, 167 of the socket 130 and the cap 160, respectively to ensure the best possible seal.

While the embodiments described herein place the socket 130 and cap 160 in the top of the container 100, it is possible to have the same opening and resealing structures in the container closed bottom wall 104 of the container 100. Also, while a cylindrical container 100 has been described herein, other shapes of containers, e.g., oval, rectangular, hexagonal, octagonal, and the like, could also be used.

The preferred shape of the frangible cap receiving socket bottom panel circular score line 136 in the bottom of the cap receiving socket 130 is circular, with a closed end and an open end. The inside score (shallower line) terminates in a curve arcing towards the socket's cylindrical sidewall to prevent loss of tear panel into the container. The outside score line (deeper line) terminates in circular form spaced from the inside score line. There is a hinged portion of the tear panel that keeps the panel in contact with the lid once ruptured, as described above.

The offset projecting incisor 168, described as a piercing element, is intended to be a single point of contact that moves deeper, and radially along the inside of the cap receiving socket bottom panel circular score line 136 while the resealable container cap 160 is rotated. The offset projecting incisor 168 may also include additional areas to further drive the cap receiving socket bottom panel tear panel 138 deeper into the container. A single point will apply more force to breaking the cap receiving socket bottom panel circular score line 136 defining the cap receiving socket bottom panel tear panel 138 but additional areas acting in a secondary fashion could help in the opening process.

The socket sidewall cam engaging projections 150 used in the cap receiving socket 130 allow the use of a very shallow socket 130 (as compared to threaded designs) and still provide positive opening, closing and sealing of the resealable container cap 160. The design of the socket sidewall cam engaging projections 150 also provides for positive stops for open, closed and removable cap positions. As seen in FIGS. 10 and 11, each cam groove surface 181, 182, 183 includes a sloped cam groove surface segment 184, a cam groove surface lower detent 186 and an cam groove surface upper detent 188. Once assembled, the three socket sidewall cam engaging projections 150 are respectively positioned so that the detents prevent the resealable container cap 160 from becoming disconnected from the cap receiving socket 130, during transport or storage, and from backing off a sealing position, when the resealable container cap 160 is positioned in a resealing position. This can be illustrated with reference to FIG. 11, where the socket sidewall cam engaging projection 150 is shown as a broken line circle. When the resealable container cap 160 is in the unopened position, each socket sidewall cam engaging projection 150 (shown as a broken line circle) will be positioned next to the cam groove surface lower detent 186. The cam groove surface lower detent 186 prevents the resealable container cap 160 from turning to a position where the socket sidewall cam engaging projection 150 is disengaged from the third cam groove surface 183, as for example, if vibration or the like caused the projection to pass out of the sloped cam groove surface segment 184. Similarly, when the resealable container cap 160 is intentionally rotated clockwise, to either open or reseal the beverage container, the projection passes over the cam groove surface upper detent 188 to become locked by interference fit between the cam groove surface upper detent 188 and the socket sidewall cam engaging projection 150. The cam groove surface upper detent 188 thus prevents the resealable container cap 160 from inadvertently backing out from the sealing position. Thus, the resealable container cap 160 is held in two positions by the detents 186, 188. The first position can be referred to as a transport securement position and the second position can be referred to as a closed position. The distance between the two detents, measured along the rotational axis of the resealable container cap 160 is equal to the distance between the resealing surface on the resealable container cap 160 and the associated surface of the cap receiving socket bottom wall 134. The transport securement detent, or cam groove surface lower detent 186 restricts the rotary movement of the resealable container cap 160 due to the interference between the stabilizing radially extending cap skirt 170 and the flat upper rim of the resealable container cap 160, as well as the interference between the piercing element or offset projecting incisor 168 and the socket cap receiving socket bottom panel tear panel 138.

When turning the resealable container cap 160 in the opening direction, e.g., clockwise, the socket sidewall cam engaging projections 150 on the socket's cylindrical sidewall follow the sloped cam groove surface segments 184 of the cam groove surfaces 180, which form gradual ramps, converting the rotary motion of the resealable container cap 160 to a linear or translational movement, which drives the resealable container cap 160 into the interior of the container 100. This engages the offset projecting incisor 168 against the cap receiving socket bottom panel tear panel 138 and provides the force necessary to rupture the cap receiving socket bottom panel circular score line 136. Further turning of the resealable container cap 160 in the opening direction progressively pushes the cap receiving socket bottom panel tear panel 138 out of the way and into the interior of the container 100, until the socket sidewall cam engaging projections 150 reach the closed position of the cam groove surface upper detents 188. A slightly higher point on the sloped cam groove surface segment 184 of the cam groove surfaces 180 just before the closed position provides the resistance necessary to keep the resealable container cap 160 from backing out.

When turning the resealable container cap 160 opposite the opening direction, the socket sidewall cam engaging projections 150 follow the same route to their starting positions but after opening, the socket sidewall cam engaging projections 150 can pass over the transport securement or cam groove surface lower detents 186 because the stabilizing radially extending cap skirt 170 and the cap receiving socket bottom panel tear panel 138 are now not providing any interference between the transport securement or cam groove surface lower detents 186 and the void between the cam groove surfaces 180, allowing the resealable container cap 160 to be freed from the container.

In the embodiments described and illustrated herein, the exemplary cam groove surfaces 180 are shown as grooves having a sloped segment that terminates at opposite lower and upper ends in a lower and an upper detent 186, 188 (respectively), whereby the entire cam groove surfaces or elements 181, 182, 183 were formed in the resealable container cap cylindrical sidewall 162 of the resealable container cap 160. It is equally possible to form the cam groove surfaces or elements 181, 182, 183 as projections or bosses from the surface, integrally formed therewith, or as separate parts connected to the resealable container cap 160. Further, while the socket sidewall cam engaging projections 150, acting as cam followers, project from the cap receiving socket cylindrical sidewall 132 of the cap receiving socket 130, the cap receiving socket 130 could have been formed with cam surfaces 181, 182, 183 and the cam followers or cam engaging projections 150 could have been formed on the resealable container cap 160. The exact size and shapes of the cam surfaces 181, 182, 183 can be selected to correspond to the particular needs of the container 100. The overall goal is to select a structure that results in an operable torque which can be applied by consumers without exerting excessive effort.

Figure 14:
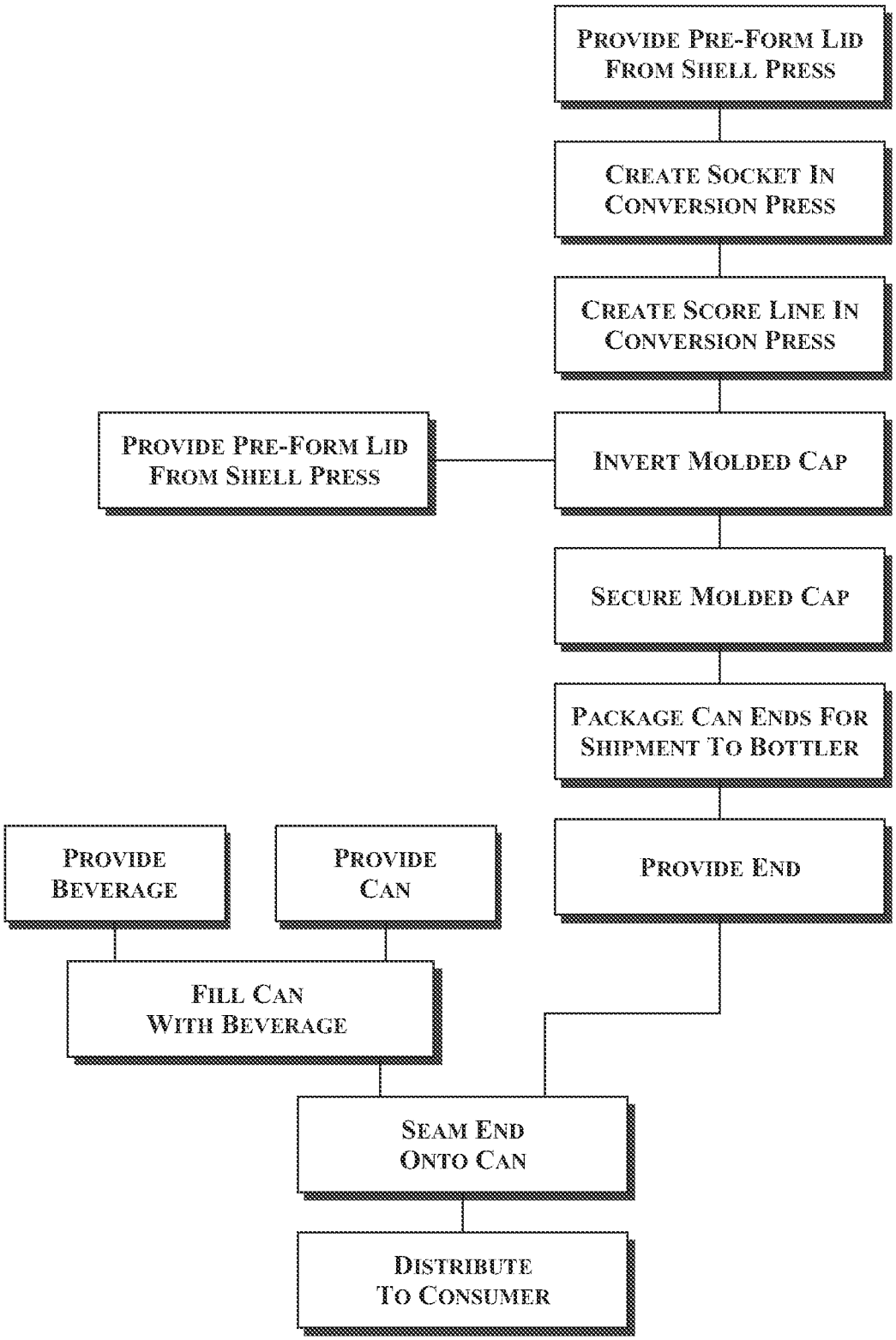
FIG. 14 presents an exemplary flow chart defining steps of manufacturing the resealable lid and the associated container according to one embodiment of the present invention.

The structures described above can be made using unique manufacturing processes, which combine some of the known processing steps with new, modified or avoided steps. In one particularly preferred method of making containers 100, as illustrated in the flow chart of FIG. 14, preformed resealable container lids 110 are provided from a shell press. Next, cap receiving sockets 130 are formed in the resealable container lids 110 using a conversion press. Next, a score line is formed in the bottom of the cap receiving socket 130 in the conversion press, either at the same time, or sequentially after the cap receiving socket 130 is formed. Resealable container cap 160 are formed by injection molding, or other suitable means, and the resealable container caps 160 are supplied to the assembly line, where they are inserted into the sockets. The resealable container caps 160 are then secured to the sockets by press forming the projections by spacing three dies around the socket, all centered on a common plane. The dies are pressed inwardly against the cylindrical sidewall of the cap receiving socket 130, and the resealable container cap 160 acts as a mandrel against the inner pressing force of the dies, thus forming the socket sidewall cam engaging projections 150 to project into the grooves of the cam groove surfaces 180. The resealable container lids 110 or ends are then packaged and sent to bottlers, who can then use conventional processing steps to secure the lid to any of a variety of cans or other beverage containers.

The process described above achieves several cost and environmental advantages over the prior manufacturing techniques. First of all, the lid does not have to be processed to form a rivet, which has conventionally been used to secure a pull tab to a can lid. There is no need for a rivet because there is no need for the pull tab. The rivet required the lid to be made of stronger, thicker material, usually consisting of a different alloy of aluminum as opposed to the material that made up the sidewall and bottom. Moreover, the conventional process would have required the formation of a pull tab, likely to be made of third, different aluminum alloy. Use of three different aluminum materials presented a problem for recycling, whereas in the present invention, a single material can be used to form the can body and the can lid.

Figure 15:
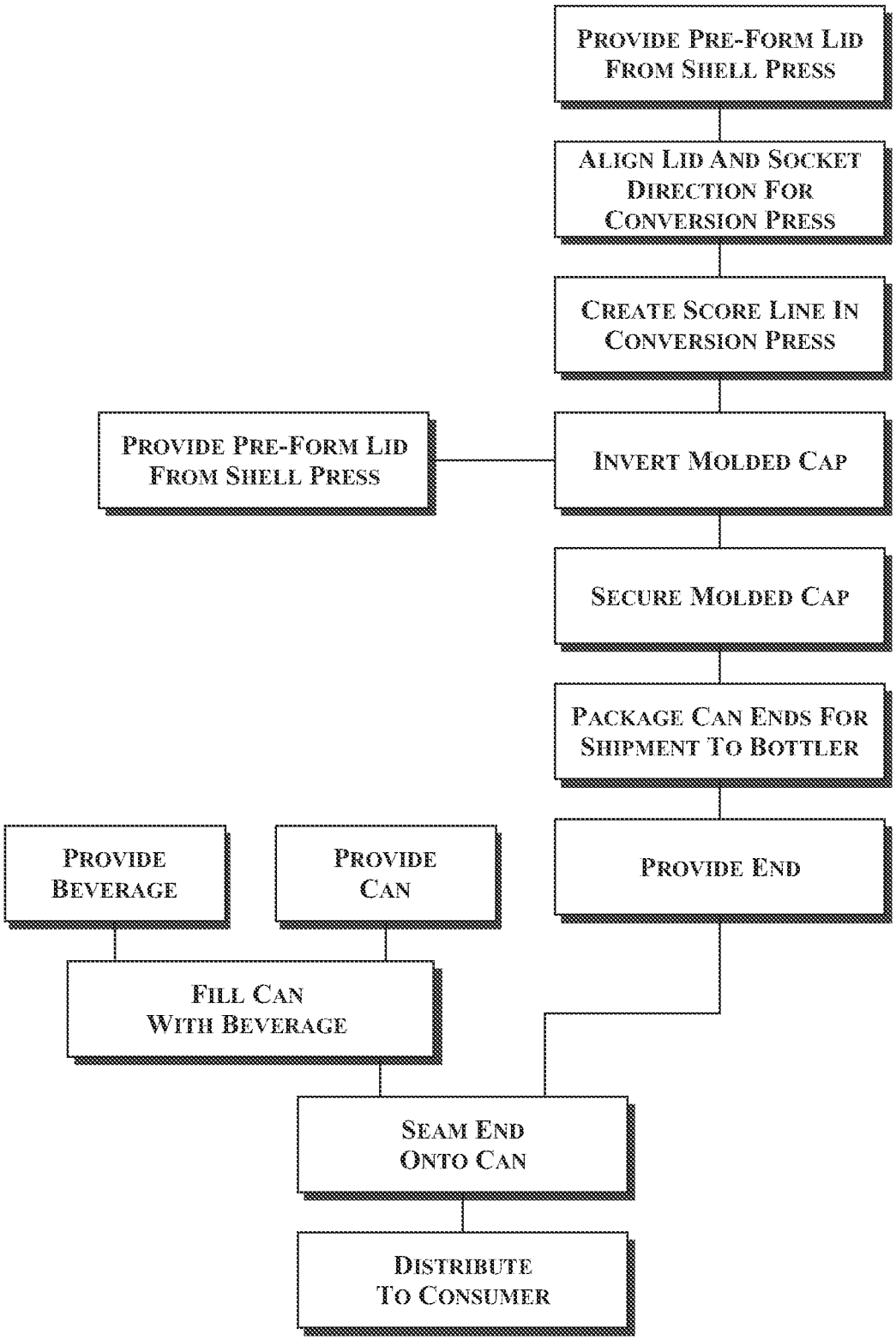
FIG. 15 presents an exemplary flow chart defining steps of manufacturing the resealable lid and the associated container according to a variant thereof.
Figure 16:
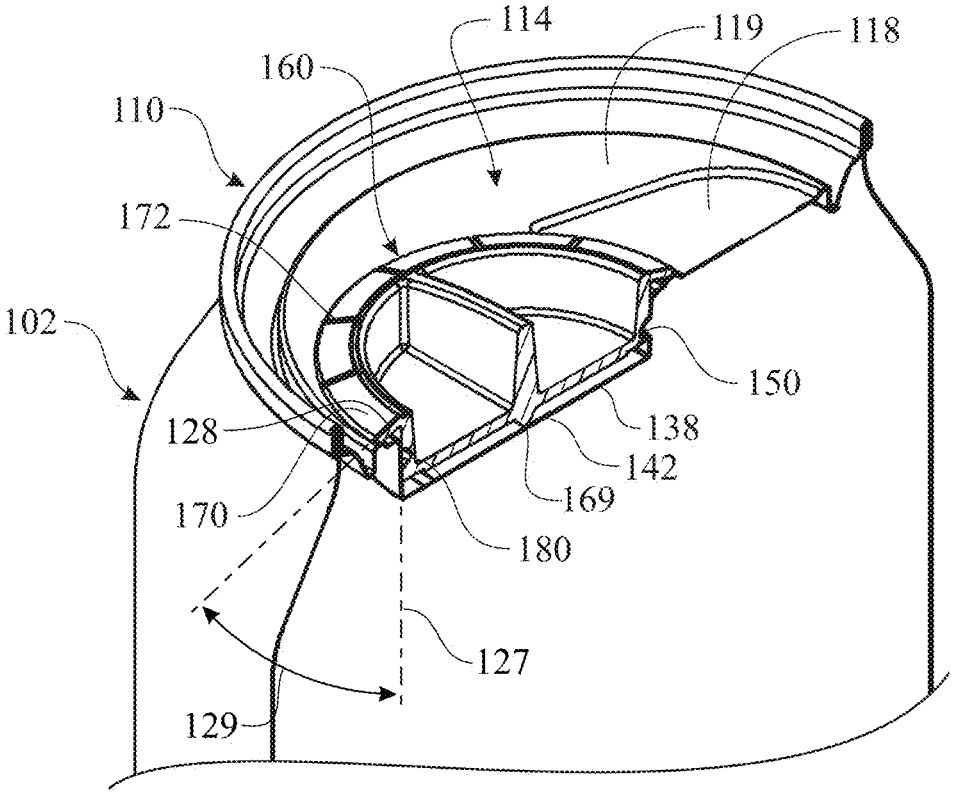
FIG. 16 presents a sectioned isometric view of the container, the section being taken along section line 16-16 of FIG. 8, wherein the illustration presents the container in an assembled, sealed configuration.
Figure 17:
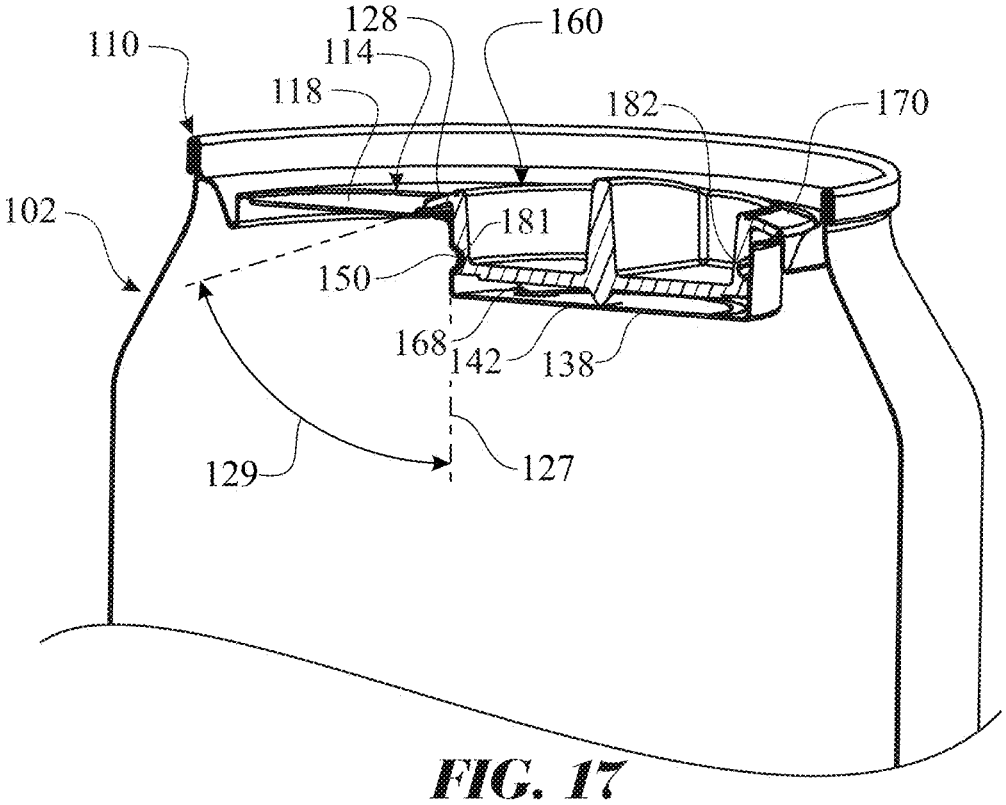
FIG. 17 presents a isometric view of the container FIG. 16, the section being taken along section line 17-17 of FIG. 8.
Figure 18:
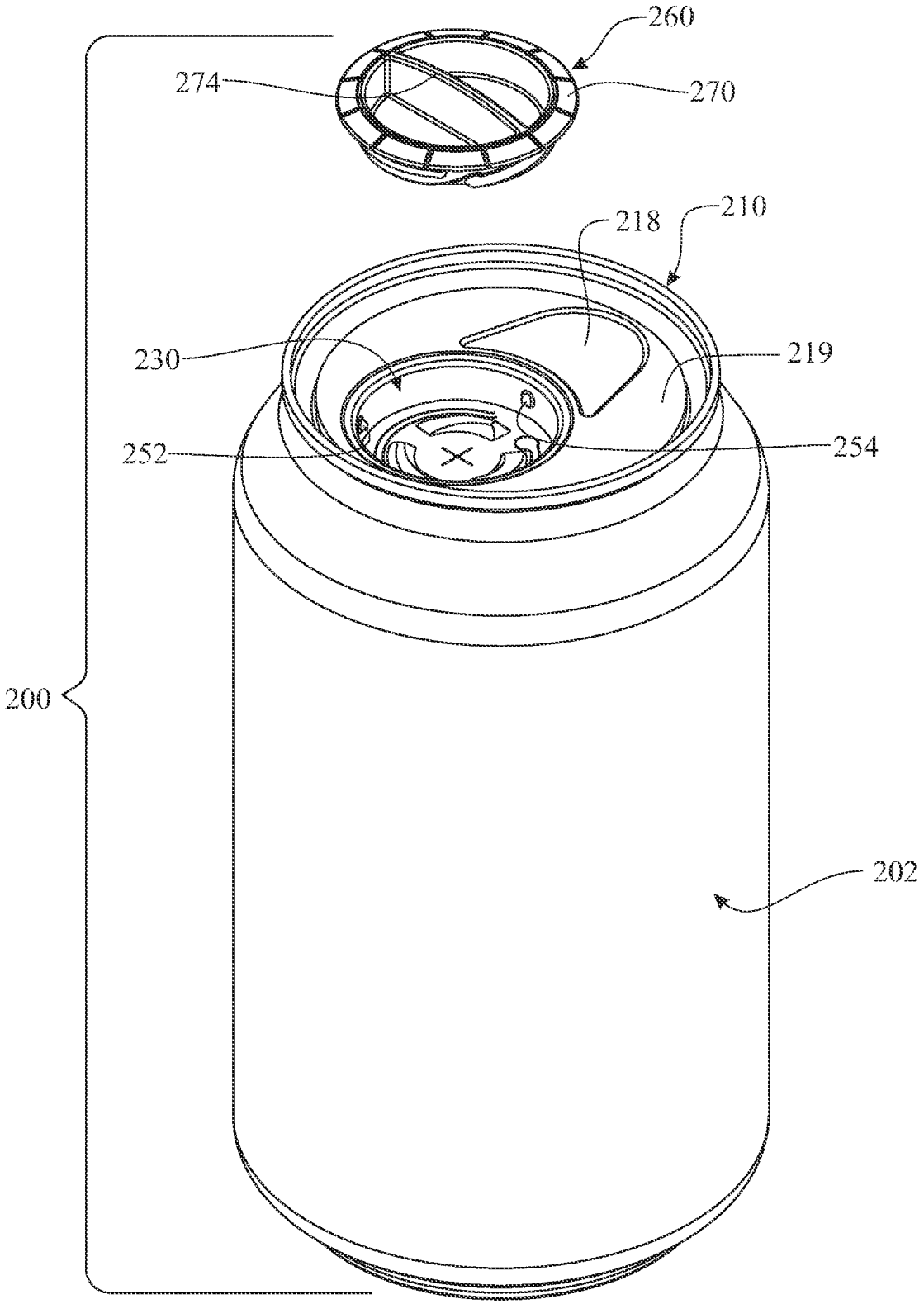
FIG. 18 presents a side isometric view of a second exemplary container introducing a variant of the present invention.
Figure 19:
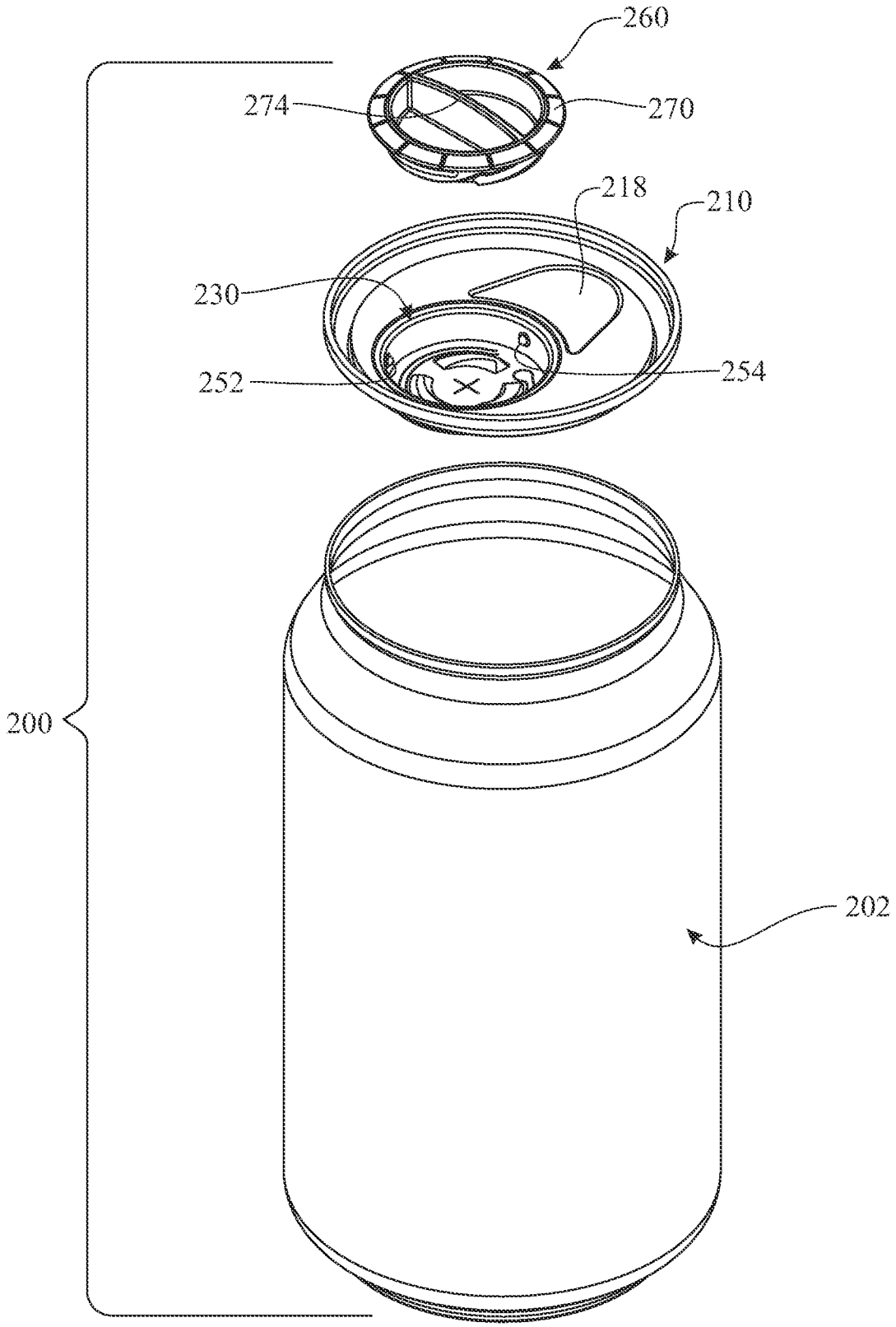
FIG. 19, presents a top and side isometric exploded assembly view of the container originally introduced in FIG. 18, wherein the illustration introduces the components of the container.
Figure 20:
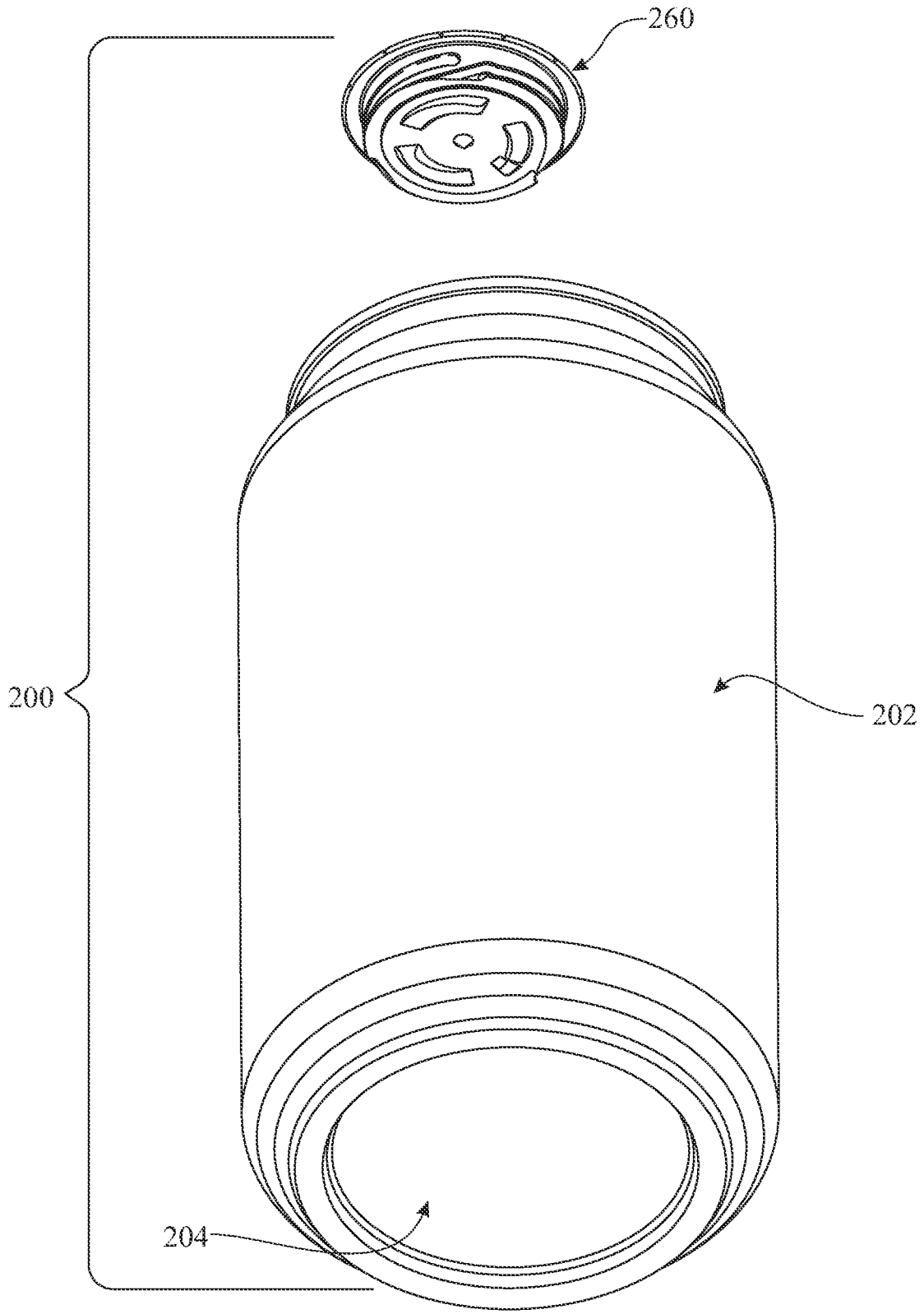
FIG. 20 presents a bottom and side isometric partially exploded assembly view of the container originally introduced in FIG. 18, wherein the cap is separated from the lid of the container to introduce features thereof.
Figure 21:
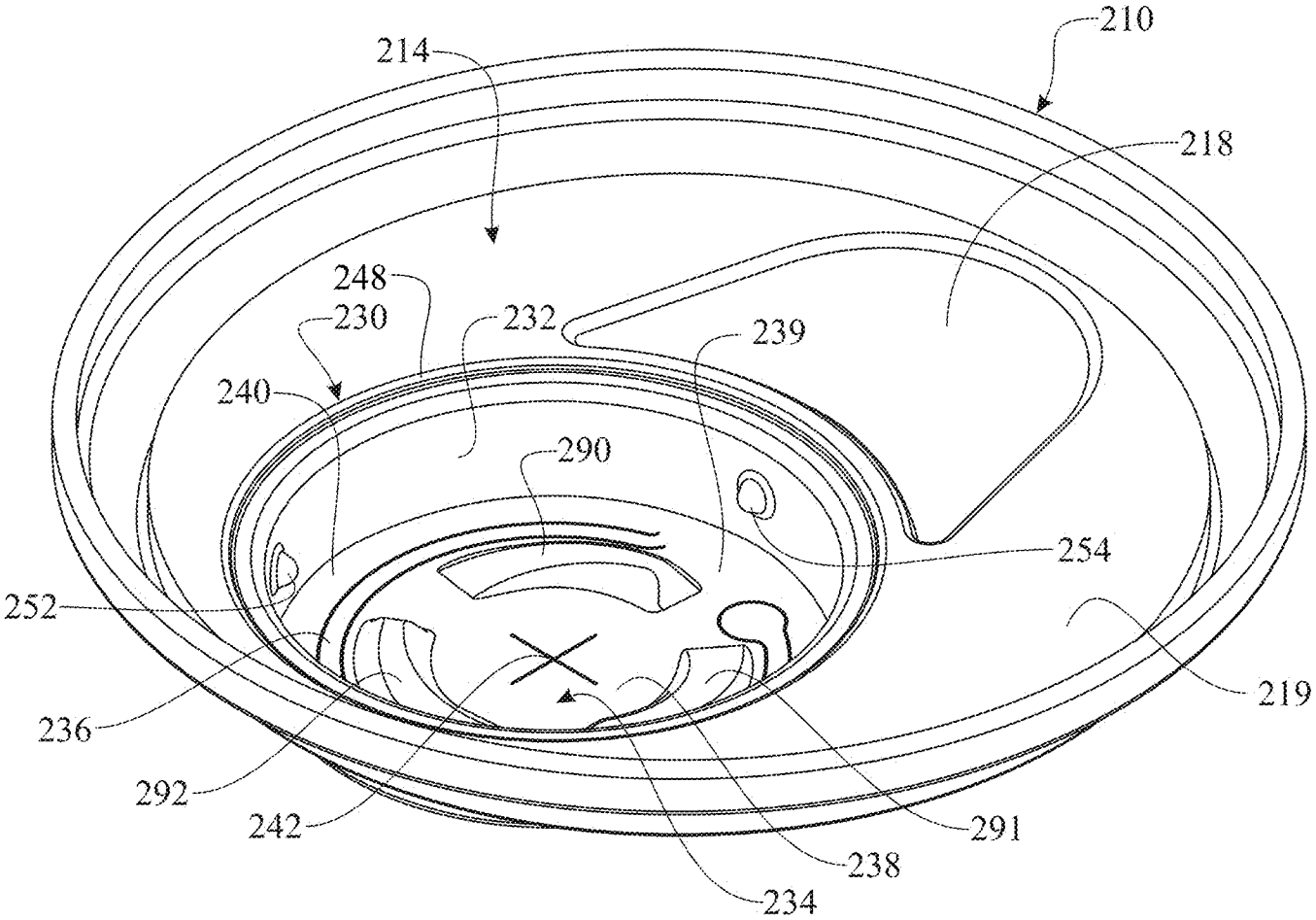
FIG. 21 presents an enlarged, isometric top view of the lid, of the container originally introduced in FIG. 18, wherein the lid is illustrated exclusive of the cap to introduced details thereof.
Figure 22:
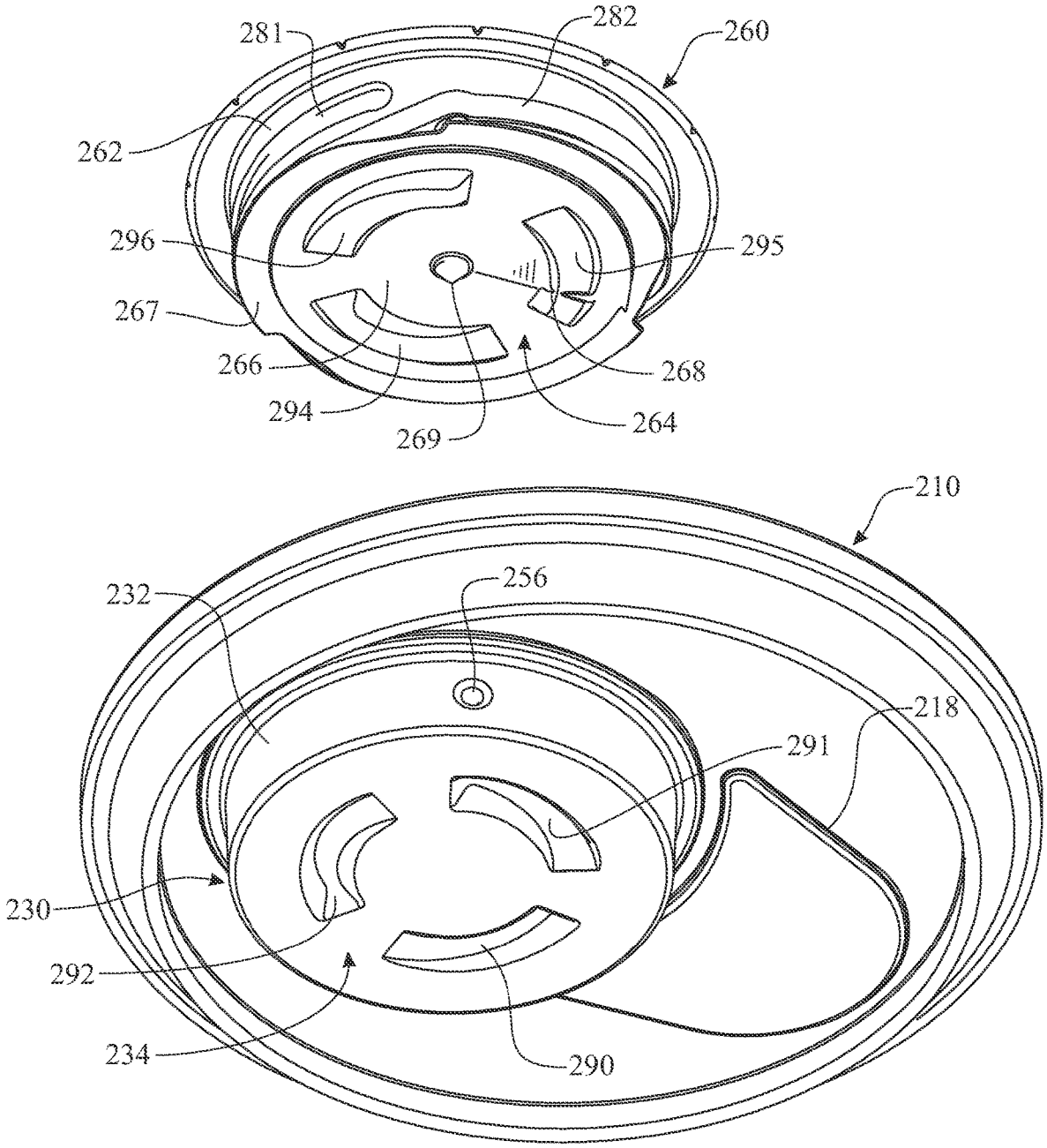
FIG. 22 presents a bottom isometric exploded assembly view of the lid and the cap of the container originally introduced in FIG. 18.
Figure 23:
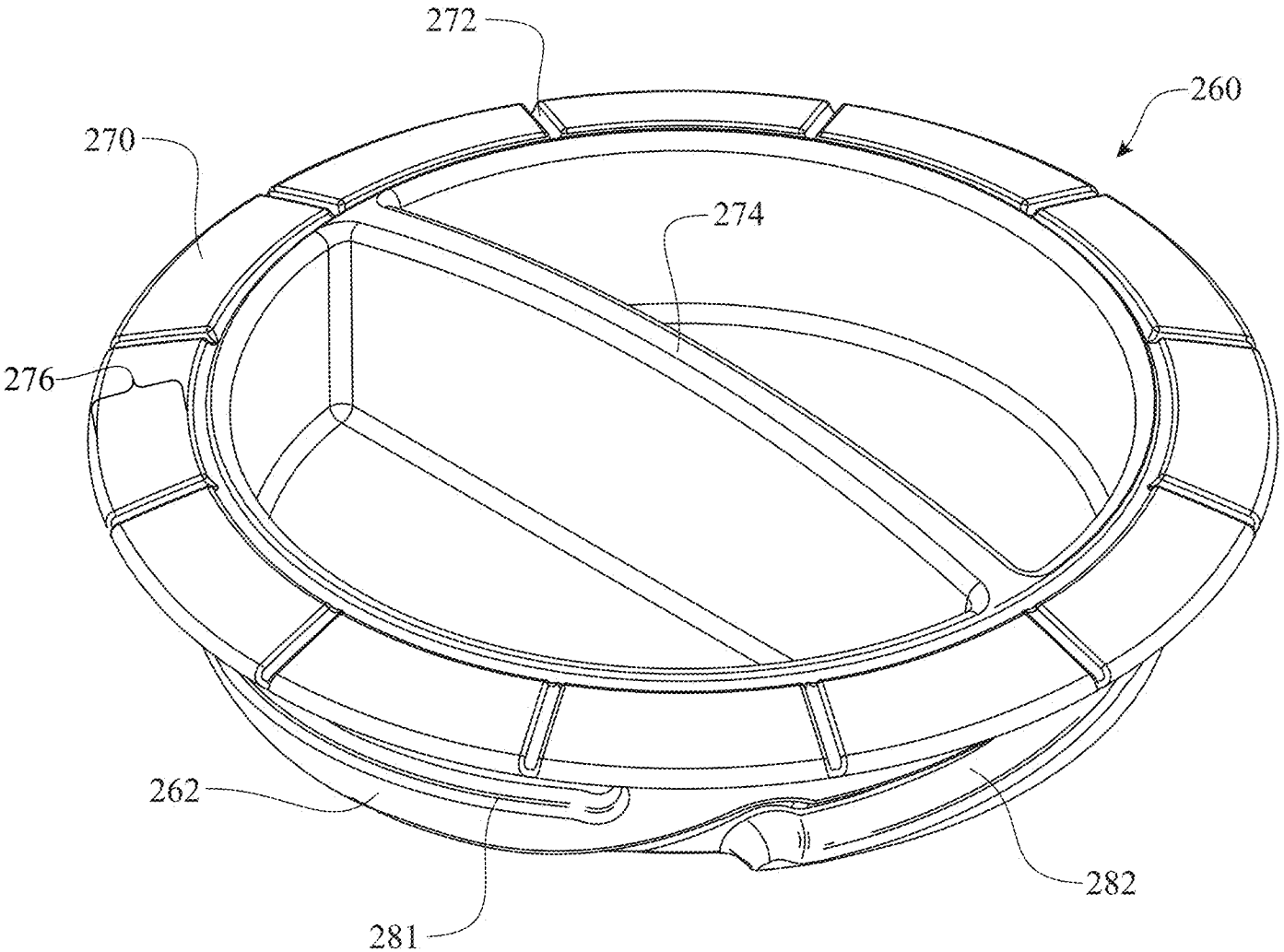
FIG. 23 presents an enlarged top isometric view of the cap of the container originally introduced in FIG. 18.
Figure 24:
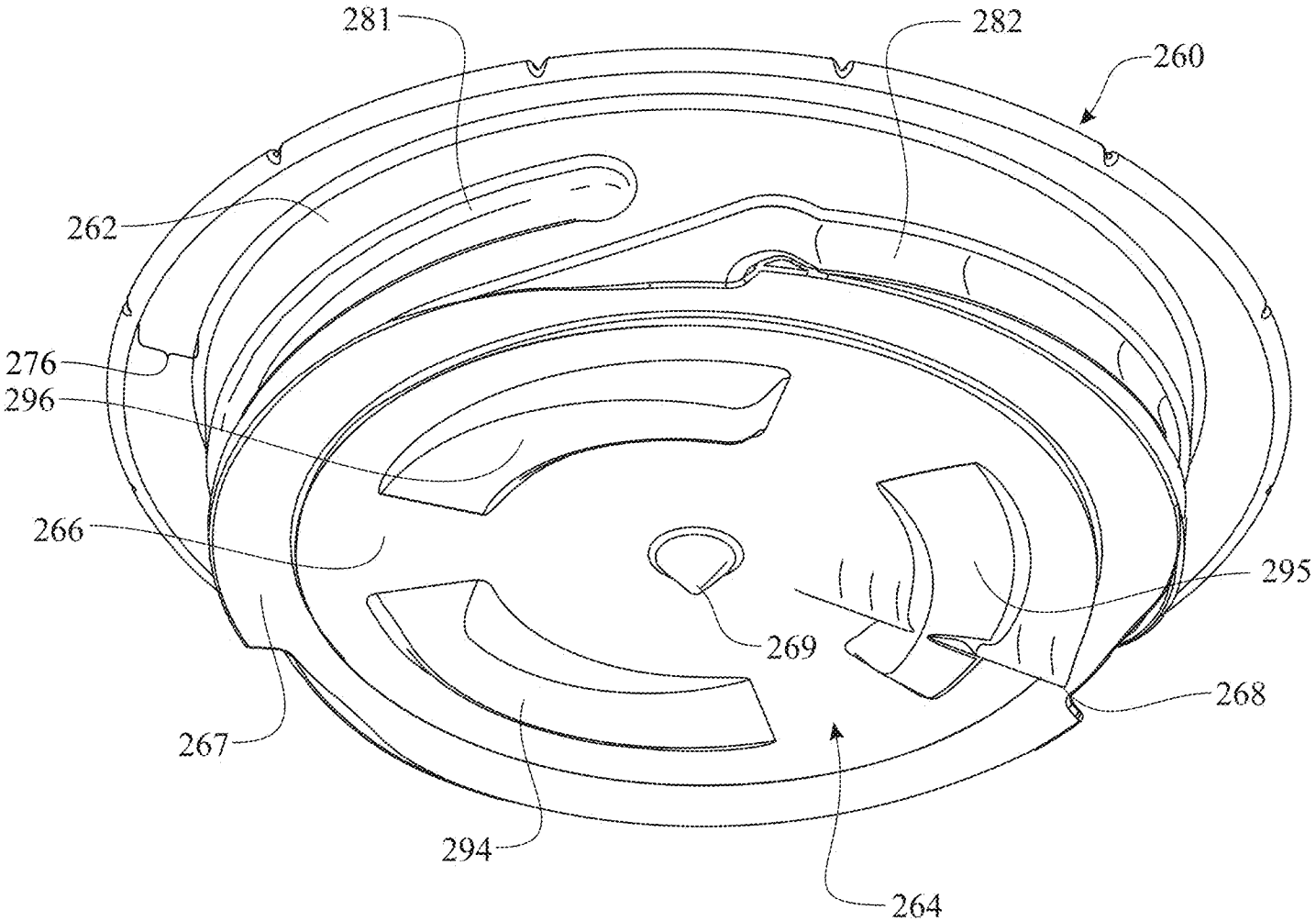
FIG. 24 presents an enlarged bottom isometric view of the cap shown in FIG. 23.

Referring to FIG. 15, a further variation of manufacturing process is disclosed. In the first step a pre-formed resealable container lid 110 is provided from a shell press with a cap receiving socket 130 already formed. In the next step, the resealable container lid 110 and cap receiving socket 130 are aligned directionally for a conversion press. Next a cap receiving socket bottom panel circular score line 136 is created in the conversion press, at the bottom of the cap receiving socket 130. Molded resealable container caps 160 are provided to the assembly line, and inserted into the molded resealable container cap 160. The molded resealable container caps 160 are secured to the cap receiving socket 130 by forming the socket sidewall cam engaging projections 150 in a manner described above, in which the resealable container cap 160 functions as a mandrel during formation of the projections. Next, the resealable container lids 110 with secured resealable container caps 160 are packaged and shipped to bottlers or others for conventional filling, sealing, and shipment to customers. As in the previously described manufacturing process, there is no need to form a rivet in the resealable container lid 110, and no need to attach a pull tab to the rivet. Avoiding these steps saves money and makes the resulting product easier to recycle.

An alternative embodiment of a container 200 is shown in FIGS. 18 through 35, and includes a body having a container cylindrical sidewall 202 and opposite axial ends. The container 100 and container 200 include a number of similar features. Like features of the container 100 and the container 200 are numbered the same except preceded by the numeral '2'. The container 200, like that of the previous embodiment (container 100), is illustrated in the size and shape of a common aluminum can used today for a wide variety of beverages, including soft drinks, juice drinks, beer, and the like. The body itself differs from the prior art in the features at the top end or lid of the container 100 where the features of the present invention allow for opening and resealing the container 200.

A container closed bottom wall 204 (seen in FIG. 20) is integrally formed at one of the axial ends with the container sidewall 202 in the known fashion of making aluminum cans. However, the body (202, 204) can be made of other materials and have other shapes, depending on either style, functionality or a combination of both. A resealable container lid 210 is attached to the open axial end of the body, at the open end defined by the container cylindrical sidewall 202, after filling the body (202, 204) with a beverage in the ordinary, and known, way of attaching resealable container lids or tops 110 to the containers 200. After assembly, the resealable container lid 210, container closed bottom wall 204 and container cylindrical sidewall 202 define a closed, interior space.

A cap receiving socket 230 is formed in the resealable container lid 210 and includes a cylindrical sidewall 110 and a cap receiving socket bottom wall 234. The cap receiving socket 230 is located eccentrically so that it nears a peripheral edge of the resealable container lid 210 to facilitate drinking and pouring after opening. The cap receiving socket 230 further includes a cap receiving socket bottom panel circular score line 236 slightly inset from the peripheral edge of the cap receiving socket bottom wall 234 and forming a cap receiving socket bottom panel substantially closed loop tear panel 238. An cap receiving socket bottom panel centered score line 242 is provided at the center of the bottom wall cap receiving socket bottom wall 234 and preferably includes two intersecting score lines that form an "X" with the intersection of the two lines being at the center of the cap receiving socket bottom wall 234. The cap receiving socket bottom wall 234 further includes socket bottom panel ramps 290, 291, 292 which are equi-distantly spaced around the periphery of the cap receiving socket bottom wall 234 inside the cap receiving socket bottom panel circular score line 236. A different number of ramps could be used, but three is preferable. The socket bottom panel ramps 290, 291, 292 are integrally formed in the cap receiving socket bottom wall 234.

The cap receiving socket 230 further includes equi-distantly spaced socket sidewall cam engaging projections 252, 254, 256 formed in the sidewall 110. From an interior view, such as that shown in FIGS. 22 and 34, the projections such as projections 124 and 128 are shown as indentations, since the projections are formed from the sidewall material. The resealable container lid 210 also includes a resealable container lid upper surface reinforcement formation 218, as in the previous embodiment, which may include instructional text to inform the consumer how to use the opening and resealing features of the container 200.

Figure 31:
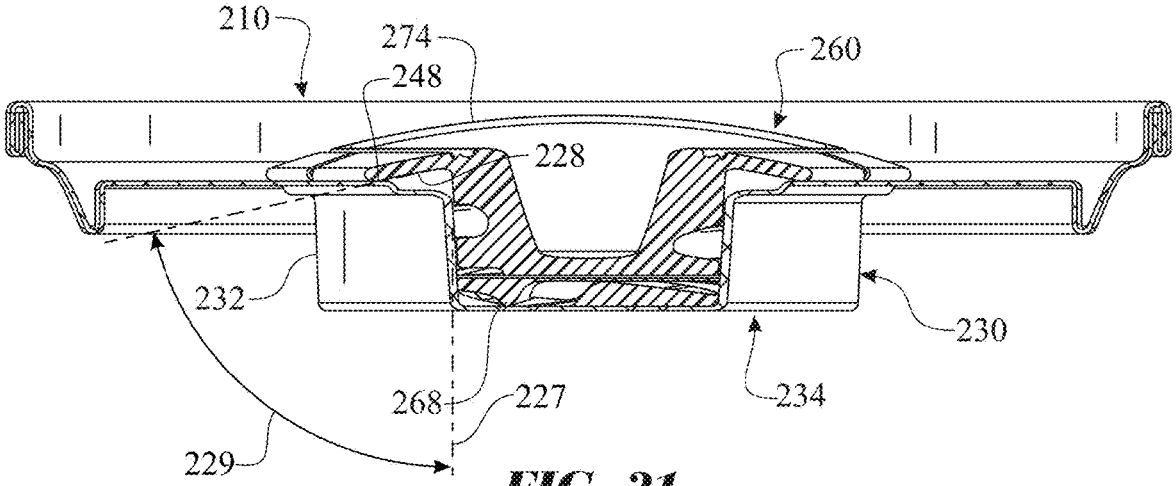
FIG. 31 presents a sectioned elevation view of the lid and cap subassembly of the container originally introduced in FIG. 18, wherein the section is taken along section line 31-31 of FIG. 25.
Figure 32:
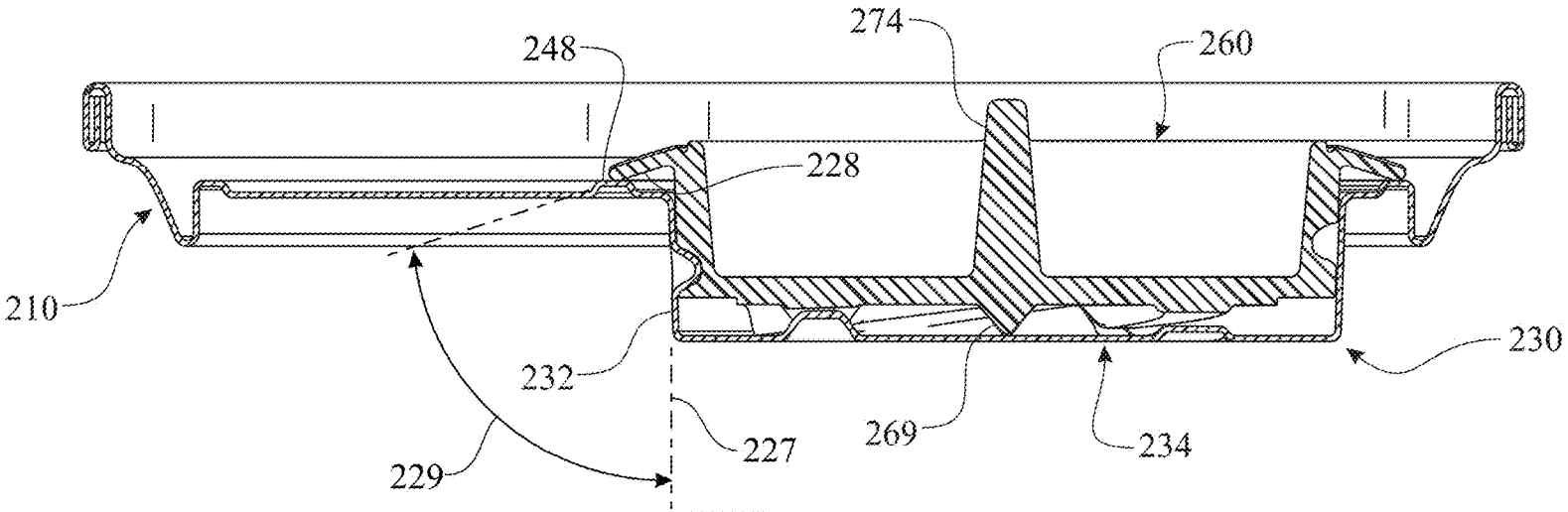
FIG. 32 presents a sectioned elevation view of the lid and cap subassembly of the container originally introduced in FIG. 18, wherein the section is taken along section line 30-30 of FIG. 25.
Figure 33:
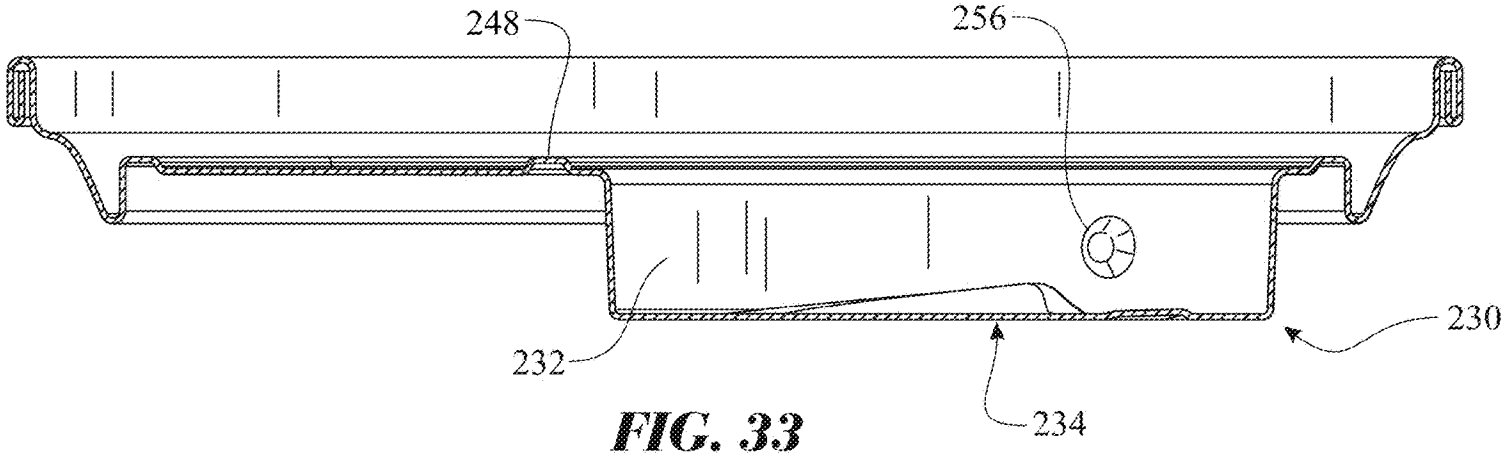
FIG. 33 presents a sectioned elevation view similar to FIG. 30, wherein the cap is excluded from illustration, exposing features of the socket within the lid of the container originally introduced in FIG. 18.
Figure 34:
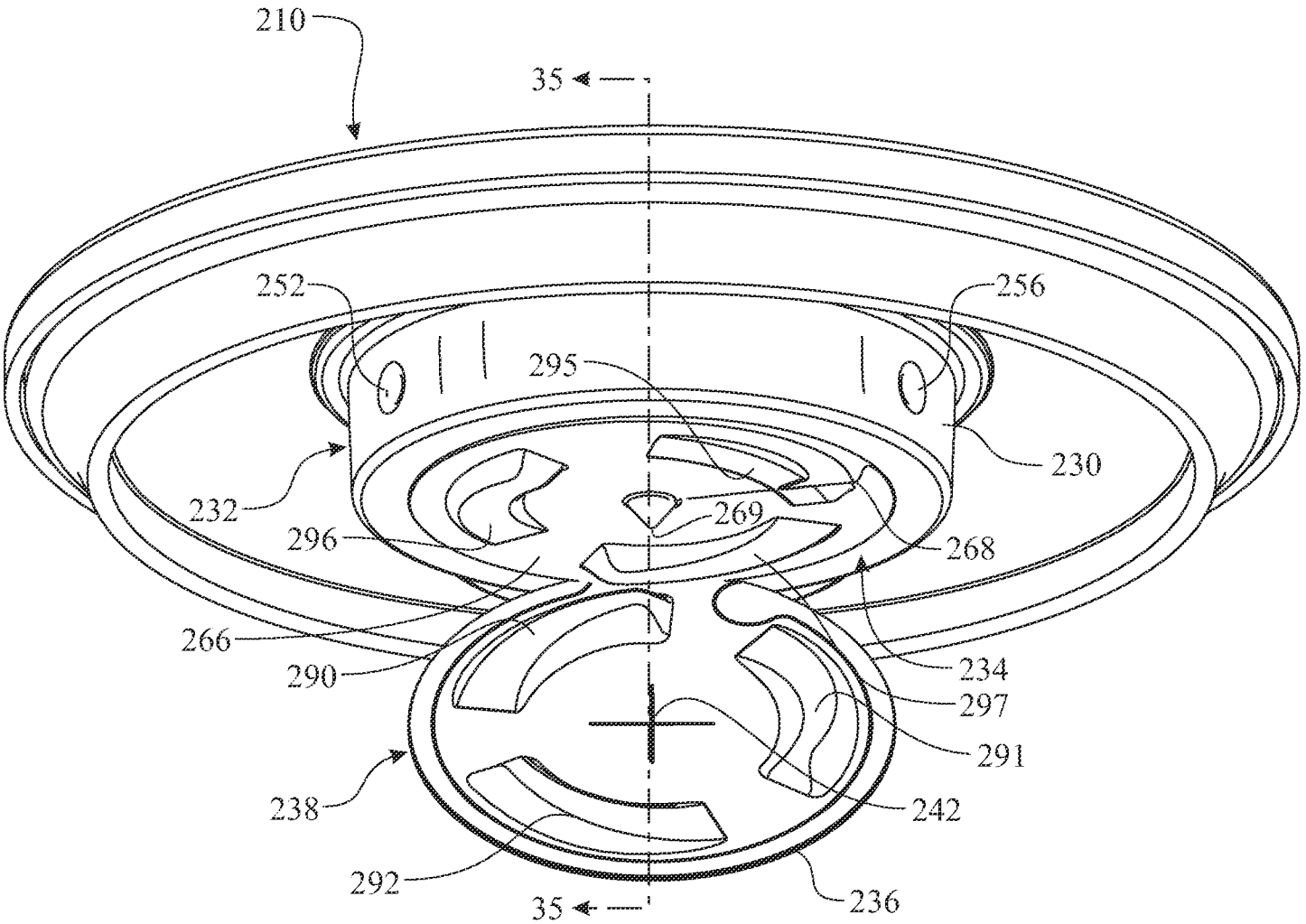
FIG. 34 presents a bottom isometric view of the lid and cap subassembly of the container originally introduced in FIG. 18, wherein the tear panel is shown after the cap has been rotated to impart linear motion fracturing the score line and bending the tear panel into the container
Figure 35:
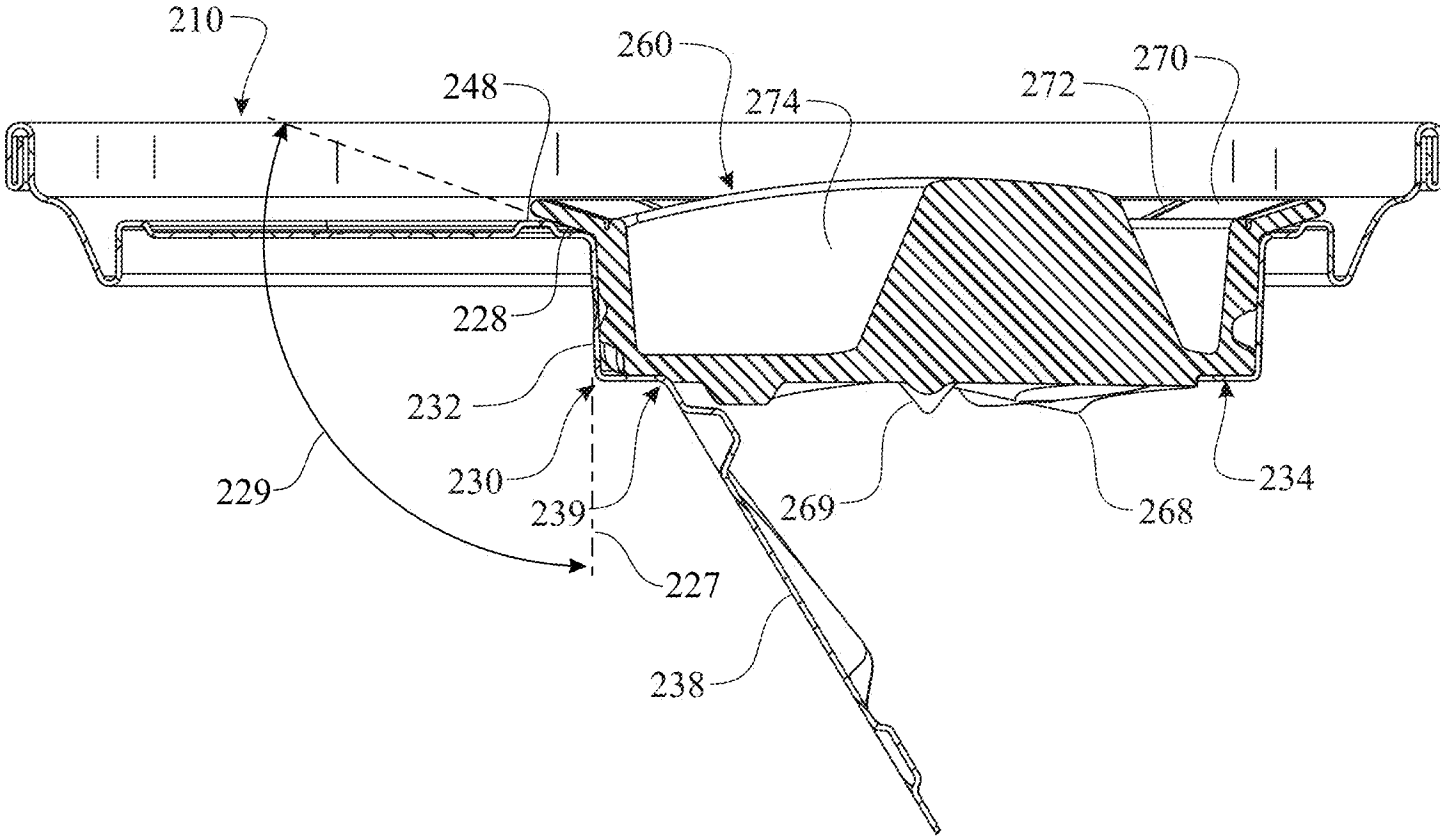
FIG. 35 presents a sectioned elevation view of the lid and cap subassembly in an opened and resealed configuration, wherein the section is taken along section line 35-35 of FIG.

A resealable container cap 260 fits into the cap receiving socket 230 and includes a resealable container cap cylindrical sidewall 262 and a bottom wall 136. A series of cam groove surfaces 281, 282, 283 are provided in the resealable container cap cylindrical sidewall 262 of the resealable container cap 260 at equi-distantly spaced locations and are designed to receive the cam engaging projections 252, 254, 256, respectively, of the cap receiving socket 230, when the resealable container cap 260 is assembled within the cap receiving socket 230. In this regard, the embodiment of container 200 is similar to that of the embodiment of container 100. When assembled and before opening the container, the resealable container cap 260 seats in the cap receiving socket 230 as shown in FIGS. 30 through 32.

The resealable container cap 260 further includes a resealable container cap handle or grip element 274 at the upper end of the resealable container cap 260 so that the consumer can turn the cap in either clockwise or counterclockwise directions. As in the previous embodiments, the upper perimeter of the resealable container cap 260 is provided with a radially extending cap skirt 270 which provides a tamper resistant feature, whereby the skirt would extend upwardly if the cap had been turned to cause the resealable container cap 260 to descend further into the cap receiving socket 230. The radially extending cap skirt 270, and all other features of the resealable container cap 260 are integrally formed in a one-piece construction preferably of a plastic material. Within the scope of the invention, other materials could be used including ceramic and metallic materials.

A sharp centered incising projection 269 is formed in the center of the bottom surface of the resealable container cap 260, so that when the resealable container cap 260 is fitted in the cap receiving socket 230, prior to opening the beverage can 100, the point of the sharp centered incising projection 269 is positioned next to or juxtaposed at the center of the bottom surface of the cap receiving socket 230, at the point of intersection between the two lines that form the cap receiving socket bottom panel centered score line 242. The sharp centered incising projection 269 punctures the cap receiving socket bottom wall 234 of the cap receiving socket 230 as the resealable container cap 260 moves linearly downwardly and further into the cap receiving socket 230 during opening operation of the beverage can 200.

Figure 30:
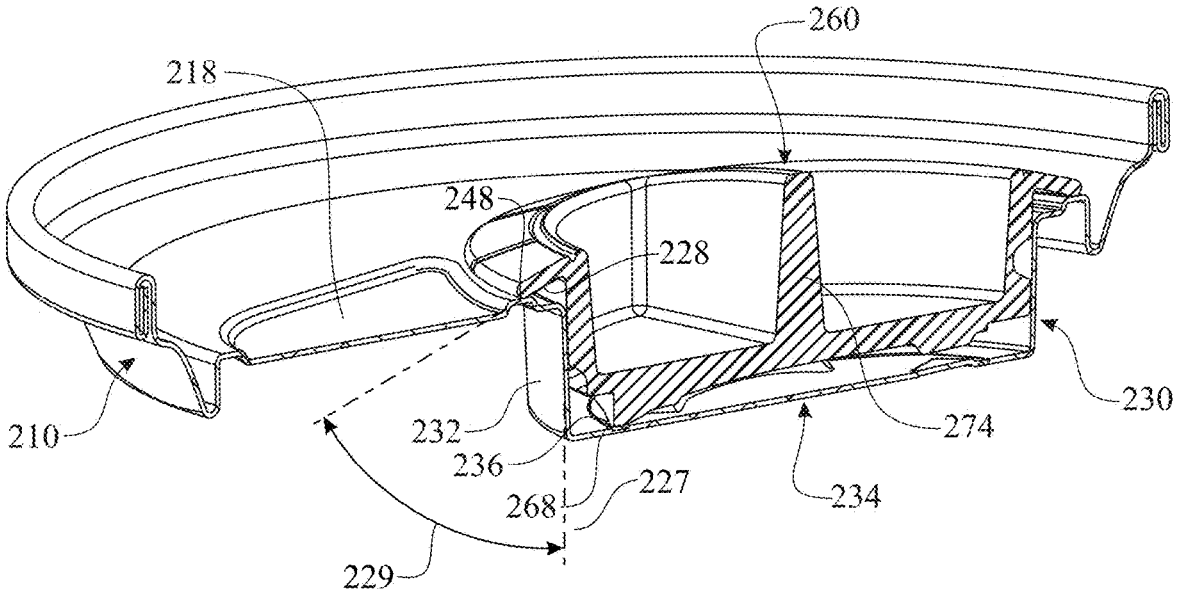
FIG. 30 presents an isometric, sectioned view of the lid and cap subassembly of the container originally introduced in FIG. 18, wherein the section is taken along section line 30-30 of FIG. 25.

An offset projecting incisor 268 is formed along an outer region of the bottom surface of the resealable container cap 260, so that when the resealable container cap 260 is fitted in the cap receiving socket 230, prior to opening the beverage can 100, the point of the sharp offset projecting incisor 268 is positioned in alignment with the cap receiving socket bottom panel circular score line 236 formed in the bottom surface of the cap receiving socket 230, as best shown in FIG. 30. The sharp offset projecting incisor 268 fractures the cap receiving socket bottom panel circular score line 236 formed in the cap receiving socket bottom wall 234 of the cap receiving socket 230 as the resealable container cap 260 moves linearly downwardly and further into the cap receiving socket 230 during opening operation of the beverage can 100.

Figure 25:
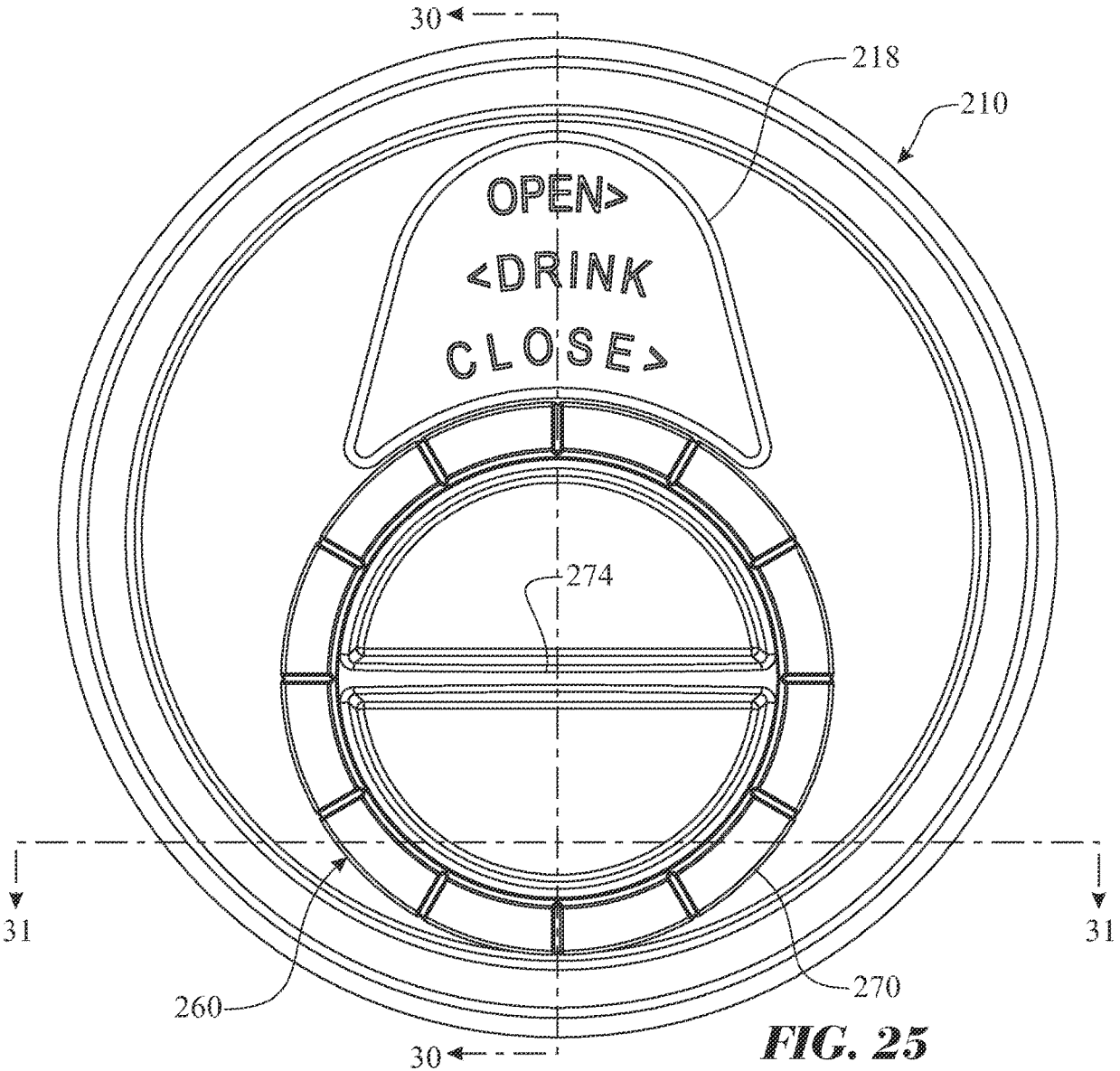
FIG. 25 presents a top plan view of the lid and the cap of the container originally introduced in FIG. 18, wherein the lid and cap are shown assembled to one another.
Figure 26:
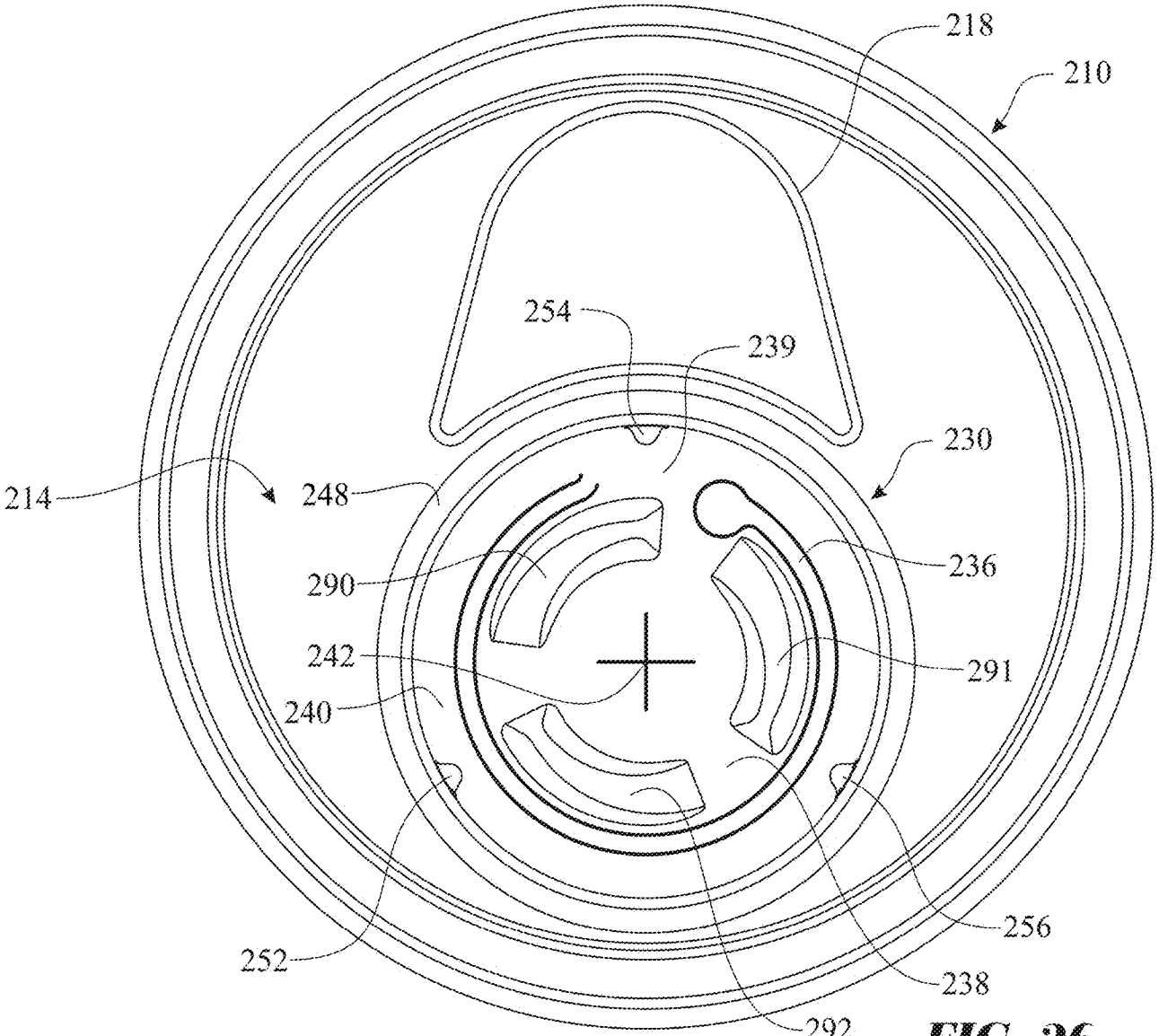
FIG. 26 presents a top plan view of the lid of FIG. 25, wherein the illustration excludes the cap to expose details of the socket.
Figure 27:
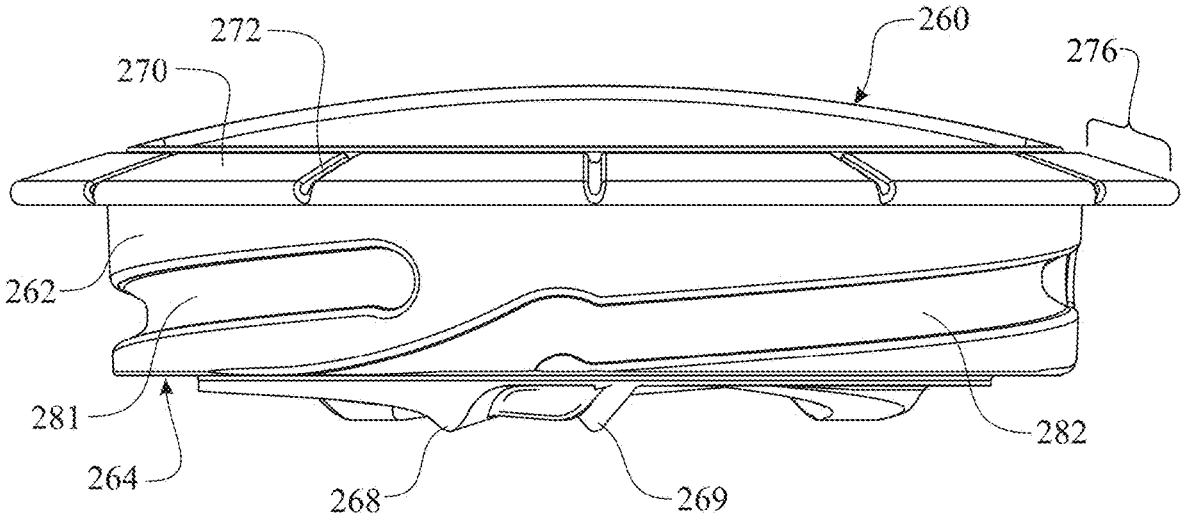
FIG. 27 presents a side elevation view of the cap of the container originally introduced in FIG. 18.
Figure 28:
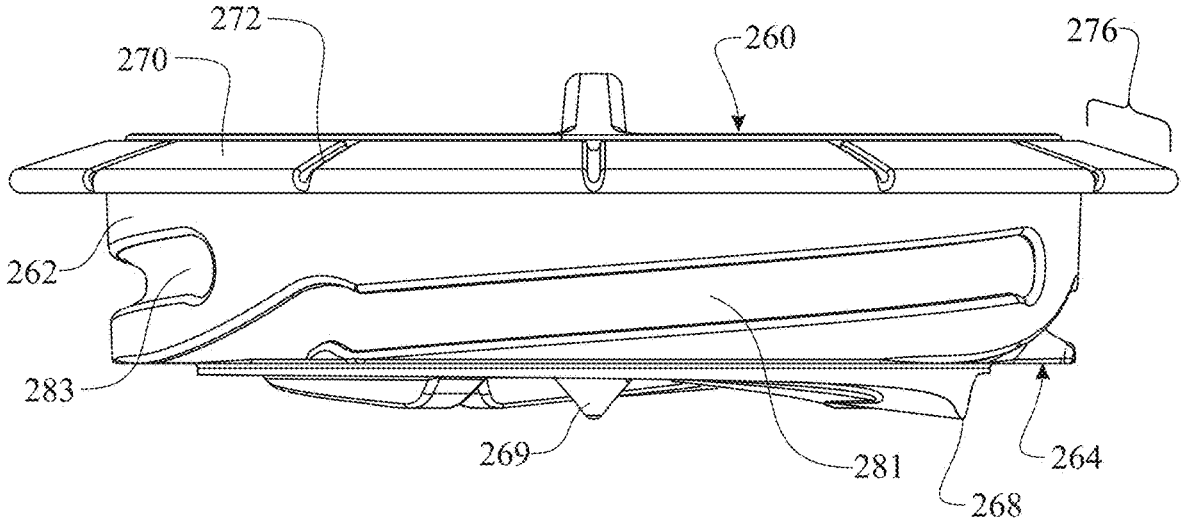
FIG. 28 presents a side elevation view of the cap of FIG. 27, wherein the cap is rotated ninety degrees (90°) from the view illustrated in FIG. 27.
Figure 29:
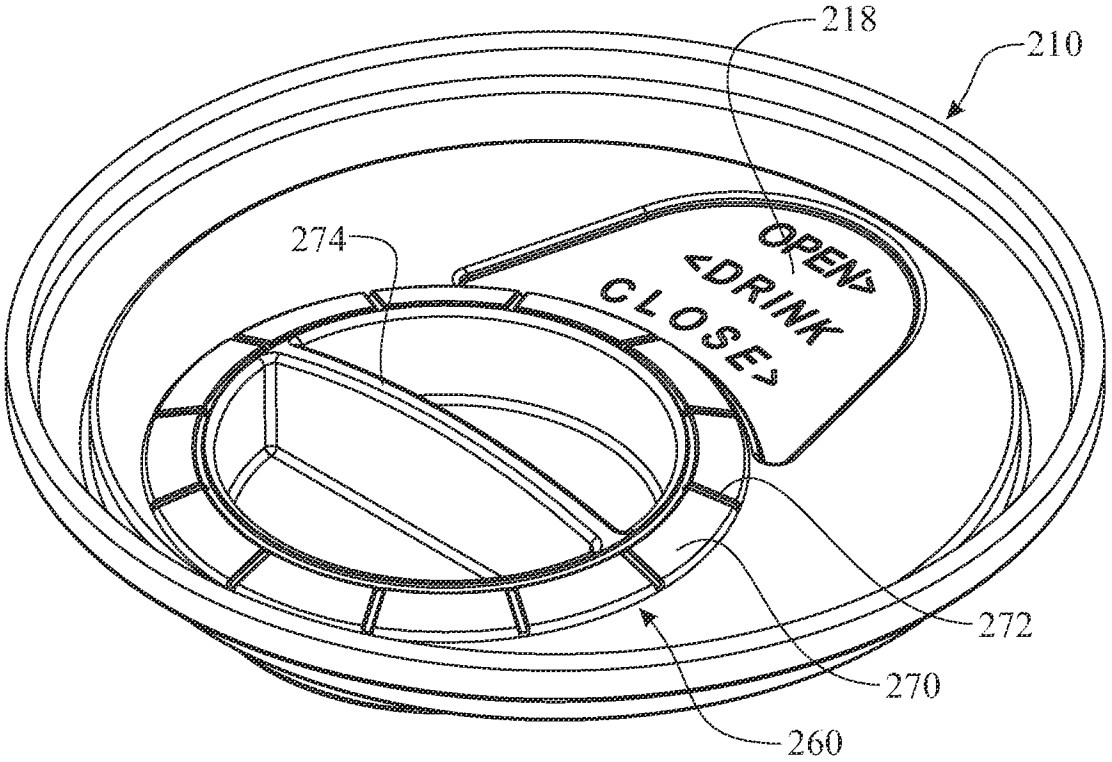
FIG. 29 presents a top isometric view of the cap and the lid of the container originally introduced in FIG. 18, wherein the cap and the lid are shown as a subassembly.

To understand how the embodiment of container 200 operates, reference is made to FIG. 25, which is a top view of the beverage container prior to opening. Optionally, the resealable container lid upper surface reinforcement formation 218 is embossed, printed or otherwise marked with instructions for how to use the resealable container cap 260. First, the consumer is instructed to open the beverage container by turning, or rotating, the resealable container cap 260 in the clockwise direction. The degree of slope on the ramps and the degree of slope on the spiral grooves is selected to ensure that the container 200 can be opened with the same or similar amount of force used to open a conventional beverage container, such as a soda can. This can be accomplished with a turning motion of the cap that is in the range of 45 to ninety degrees (45-90°), preferably.

After the resealable container cap 260 is rotated or turned to the full extent allowed, the resealable container cap 260 pushes the cap receiving socket bottom panel loop tear panel 238 into the can, but the tear panel 238 stays connected to the resealable container lid 210 through a portion of the lid between the ends of the cap receiving socket bottom panel circular score line 236. In order to then drink the contents of the container 200, the consumer turns, twists or rotates the resealable container cap 260 in the opposite direction until returning past the starting point from where the opening rotation started, placing the cam engaging projections 252, 254, 256 in the opened area of the cam groove surfaces 281, 282, 283.

At that point, the resealable container cap 260 is pulled upwardly by the consumer to become separated from the container 200, and the consumer is then free to drink from the opening formed in the resealable container lid 210 as a result of the cap receiving socket bottom panel substantially closed loop tear panel 238 being pushed into the container 100. When the consumer is finished drinking, and if the container 200 is not empty, the consumer can reseal or close the beverage container by pushing the resealable container cap 260 back into the cap receiving socket 230 and then turning, twisting or rotating the resealable container cap 260 in the same direction as the opening direction, until the resealable container cap 260 is fully seated in the cap receiving socket 230, thus sealing the opening in the container 200. In the resealed state, the contents of the container 200 can be kept fresh, carbonated (in the case of carbonated drinks), and spill-proof (when the beverage container 200 is mobile, such as if kept in a back pack, stroller, automobile drink holder, and the like).

As in the other embodiments described herein, the invention includes an assembled container 200, with or without contents, with a unique resealing mechanism. The invention also includes a container subassembly comprising a resealable container lid 210 and a resealable container cap 260, capable of further assembly with a container body 202, 204, such as beverage containers commonly in use as aluminum cans for distribution of a wide variety of beverages. The invention further includes a resealable container cap 260 capable of use with a resealable container lid 210, or with a container 200 that includes a resealable container lid 210, such that the beverage containers could be purchased without resealable container caps 260, and could separately purchase resealable container caps 260 that are then used with the containers 200 that are formed with the aforementioned cap receiving socket 230. This way, resealable container caps 260 could be re-used, repeatedly. Purchase of resealable container caps 260 separately from the containers 200 would have a "green" effect, in that the resealable container caps 260 could be washed and re-used over and over, thereby reducing waste.

Figure 36:
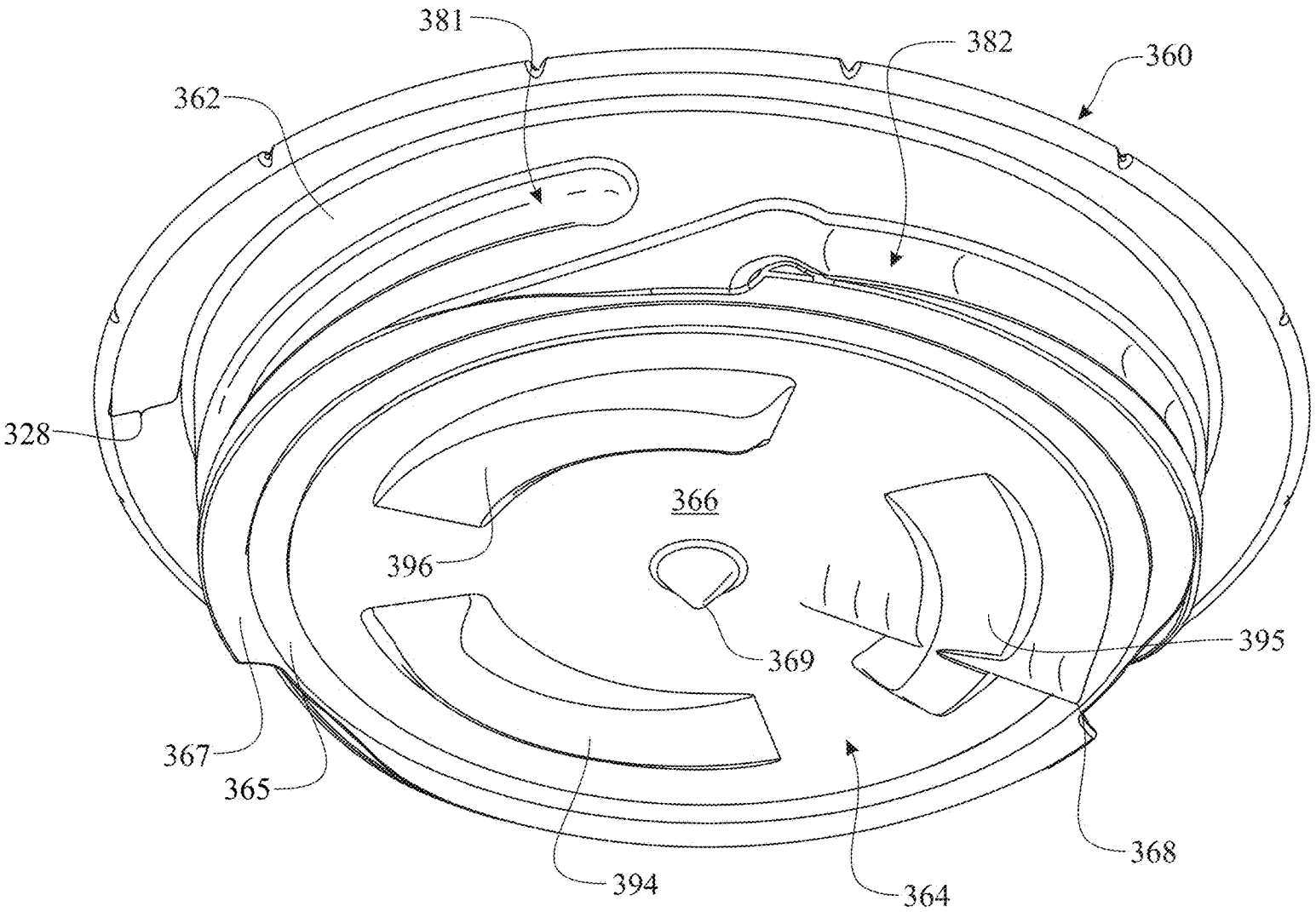
FIG. 36 presents a bottom isometric view of an enhanced cap, wherein the enhanced cap is similar in all aspects to the previously illustrated caps, while introducing a soft plastic sealing ring to further enhance the sealing capabilities of the cap.
Figure 37:
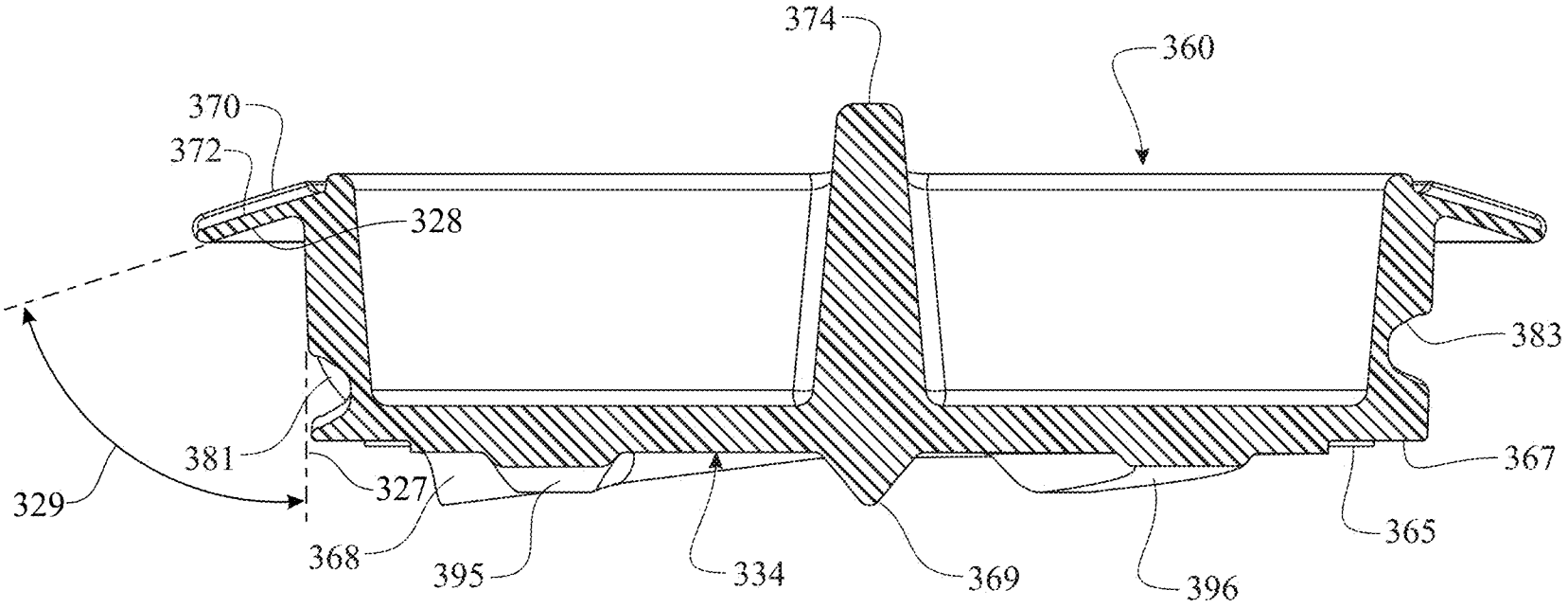
FIG. 37 presents a cross sectioned elevation view of the cap originally introduced in FIG. 36.

Another feature of the invention is to provide a resealable container cap 360, as illustrated in FIGS. 36 and 37. The resealable container cap 260 and resealable container cap 360 include a number of similar features. Like features of the resealable container cap 260 and the resealable container cap 360 are numbered the same except preceded by the numeral '3'. The resealable container cap 360 includes the features presented above, including the cap bottom surface ramps 394, 395, and 396, and cam groove surfaces 381, 382, and 383. As with the other embodiments, the resealable container cap 360 has a cap receiving socket bottom wall 334 from which the ramps project. A cap sealing ring 365 is provided on the surface of the cap receiving socket bottom wall 334 near the periphery thereof. The cap sealing ring 365 is made of an elastomeric material that is different from the material that constitutes the resealable container cap 360, which is preferably made of a hard plastic material. The material which forms the cap sealing ring 365 can be injected through ports into a mold and formed on the resealable container cap 360 at the same time that the resealable container cap 360 is being injection molded. Alternatively, the cap sealing ring 365 can be a separate pre-formed item that can be adhesively bonded in place after the resealable container cap 360 is removed from its mold.

A central sharp projection 241 is formed in the center of the bottom surface of the resealable container cap 360, wherein the central sharp projection 241 is similar to the sharp centered incising projection 269 described above in design, location and function.

An offset projecting incisor 368 is formed along an outer region of the bottom surface of the resealable container cap 360, wherein the offset projecting incisor 368 is similar to the offset projecting incisor 268 described above in design, location, and function.

Any of a variety of thermoplastic elastomers (TPEs) can be used to make the cap sealing ring 365, and selection of the precise one is a matter of design choice, as the requirements are simply that the material be easy to mold, easily adherent to the material that makes up the cap, and to some degree deformable under pressure (in use). Other materials could be used if a sealing ring is pre-made and adhesively bonded to the end face or bottom wall of the cap. However, molding the ring in place is preferred. As for TPEs, they are sometimes referred to as thermoplastic rubbers, and are in a class of copolymers or a mixture of polymers which consist of both thermoplastic and elastomeric properties. They are particularly suitable for injection molding, which is the preferred way to form the cap sealing ring 365 on the face of the resealable container cap 360.

Figure 38:
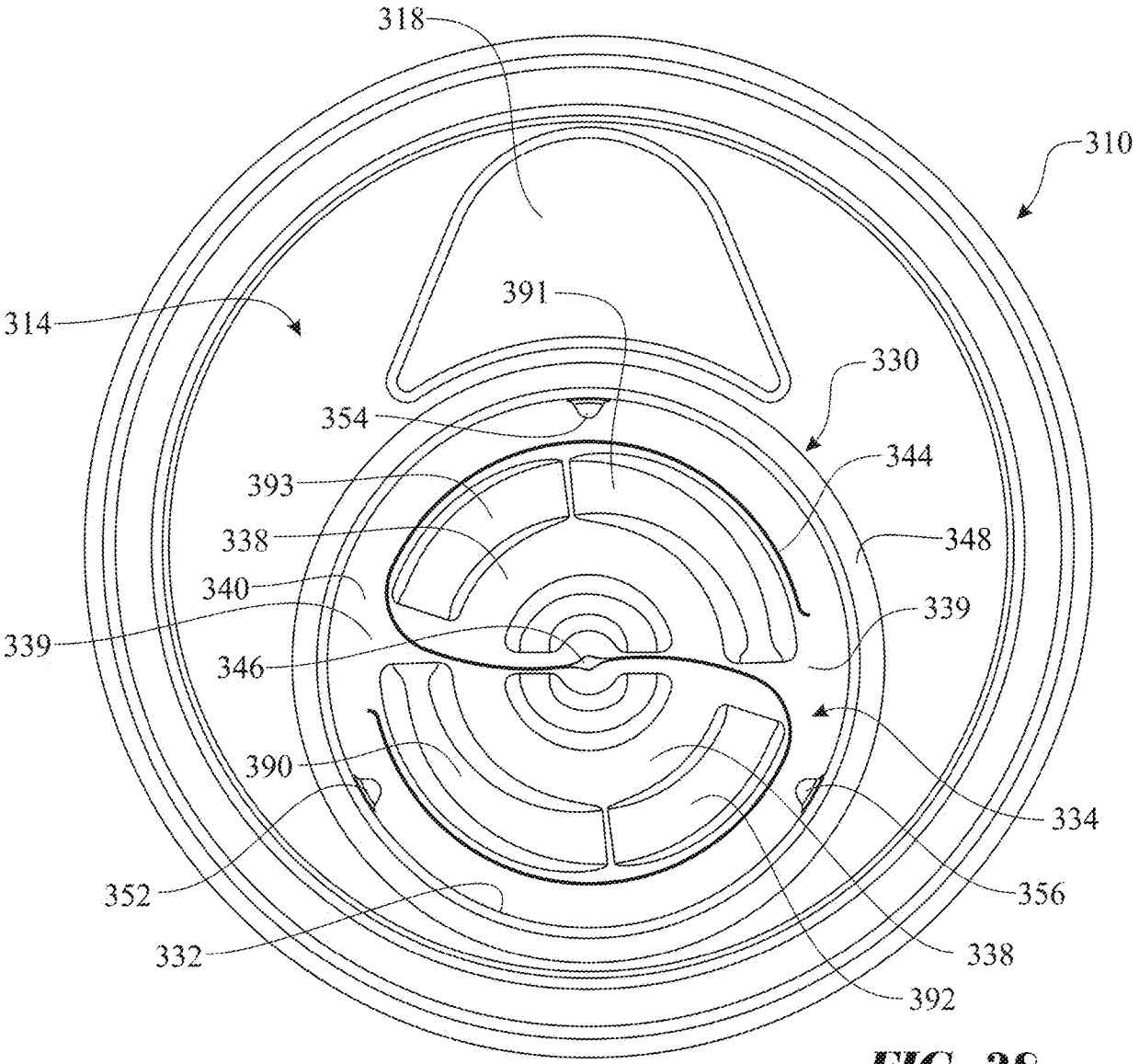
FIG. 38 presents a top plan view of another exemplary container lid, wherein the container lid is similar in all aspects to the previously illustrated lids, while introducing an alternative score line, wherein the alternative score line defines two tear panels for use during the opening process.

It is noted that in FIG. 38, there are two ramps 390, 391 illustrated as opposed to three, which are found in the other embodiments. Essentially any number of ramps can be employed, but two or three are more preferred for reasons that two or three can generate an opening force without requiring too much torque, and they are easier to manufacture than a number greater than three. As seen in FIG. 38, a cap used in the embodiment of FIG. 38 has two ramps on the lower end face that are shaped and positioned compatibly with the socket bottom panel ramps 390 and 391 shown in FIG. 38.

The resealable container cap 360 operates in the same way as the caps of previous embodiments, in that the consumer turns the cap in one direction to open the container, then turns the resealable container cap 360 in the opposite direction to remove the resealable container cap 360, and then the resealable container cap 360 is re-inserted into the cap receiving socket 230 and turned in the first, container-opening direction until the resealable container cap 360 is fully seated in the cap receiving socket 230. The resealable container cap 260 is shown in this fully seated position in FIG. 35, for resealing the container 200, in which the bottom surface 264 of the resealable container cap 260 presses against the cap receiving socket bottom wall 234 of the cap receiving socket 230 to form a sealing engagement between the cap receiving socket 230 and the cap. With the embodiment of resealable container cap 360 that includes the sealing ring 367, in this position, the cap sealing ring 365 is pressed against the cap receiving socket bottom wall 234 of the cap receiving socket 230 to enhance the sealing relationship between the cap receiving socket 230 and the resealable container cap 360. Contact between a hard surface, i.e., the metal material that makes up the cap receiving socket 230, and a relatively softer material, i.e., the elastomeric material that makes up the cap sealing ring 365, will ensure a better seal for the contents of the container 200. This is particularly useful when it comes to carbonated beverages, such as sodas, beers, and the like.

Figure 39:
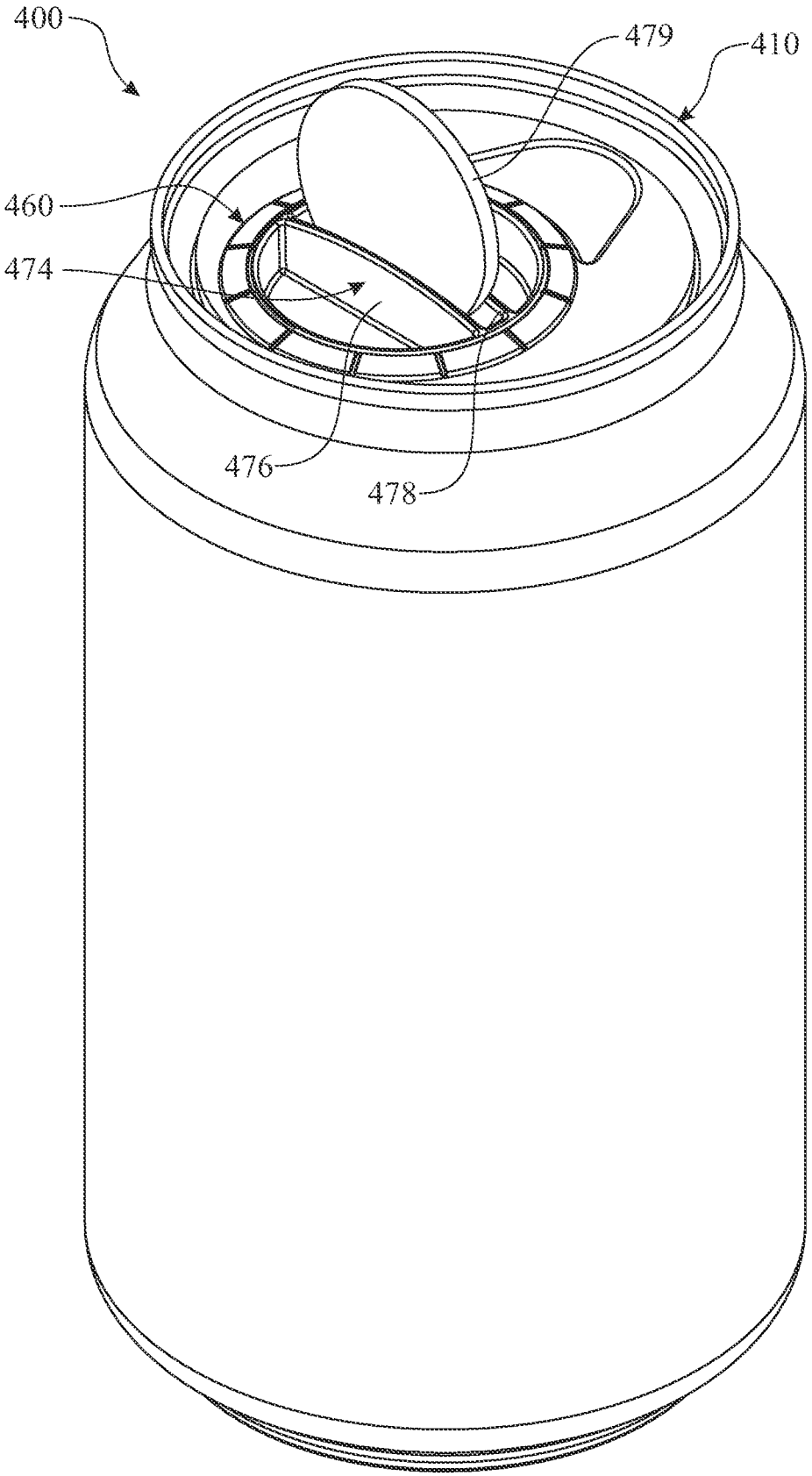
FIG. 39 presents a top and side isometric view of another exemplary container, wherein the cap introduces a grip capable of using an implement, such as a coin and the like, enabling the consumer to impart a greater opening force thereto.
Figure 40:
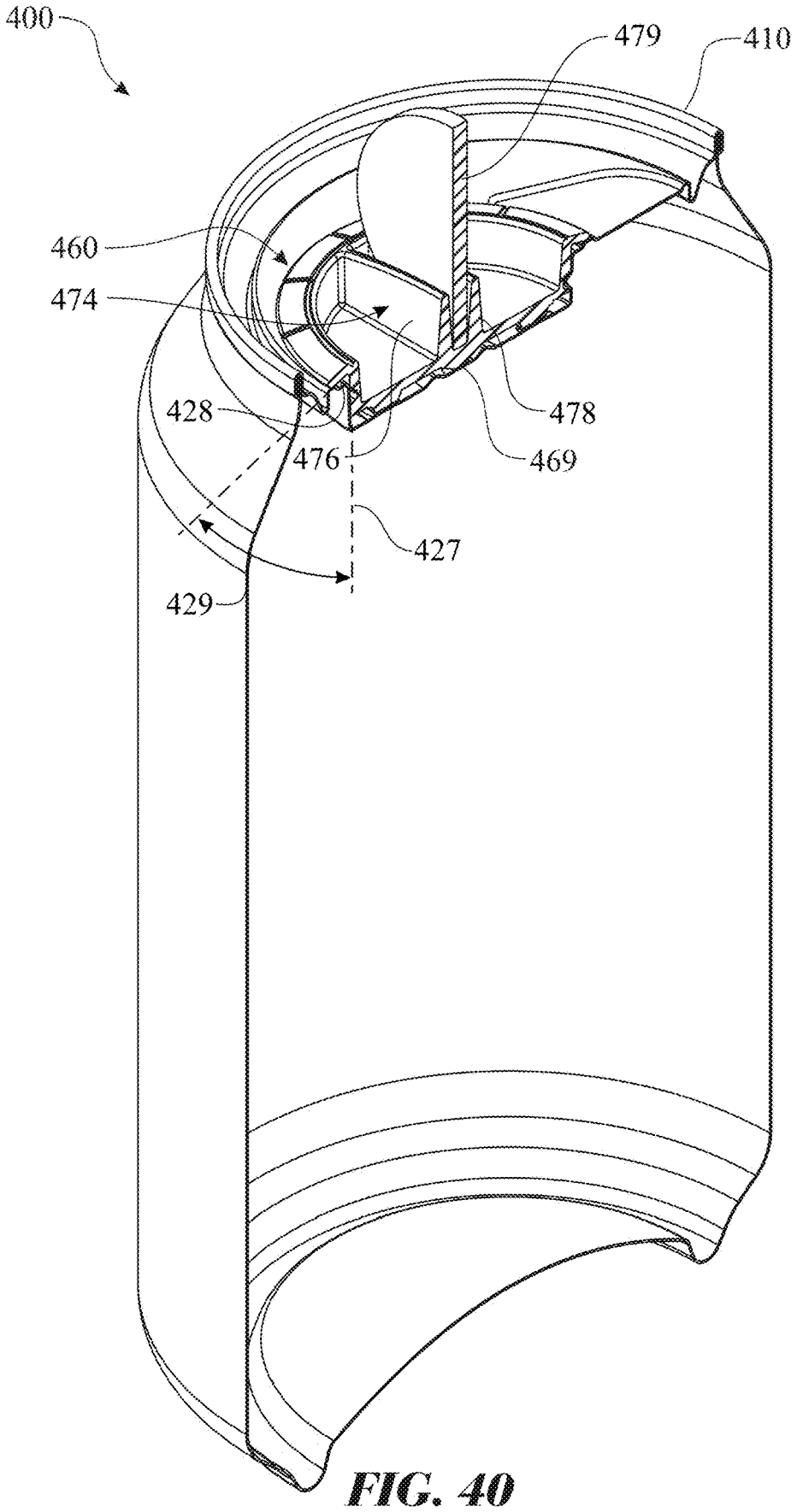
FIG. 40 presents a sectioned top and side isometric view, wherein the illustration demonstrates the use of a coin or other implement in conjunction with a grip to impart a greater opening force by the consumer.

In the previously described embodiments, the cap is provided with a resealable container cap handle or grip element 174, as seen in FIGS. 10, 11 and 13*a*, for example. An alternative embodiment of a resealable container cap grip element 374 is shown in FIGS. 39 and 40, in which the resealable container cap grip element 480 includes two parallel resealable container cap grip element first cross member 482 and 484, spaced apart by an amount sufficient to fit a force enhancing, or grip enhancing implement 486, such as a coin or other object made of a material that is rigid and strong enough to transfer torque from the consumer's hand to the resealable container cap 460. It is understood that the larger the diameter of the coin or other object, the greater the force that can be transmitted to the resealable container cap 460. The container 300 can be sold as an assembly which includes the resealable container cap 460 and the implement (coin) 486 (assuming it is not a coin), a subassembly including the resealable container lid 410, resealable container cap 460 and grip enhancing implement 486 (without the container body and sealed contents), or the resealable container cap 460 can be sold by itself. For ease of storage and transportation, and as a cost saving, it is preferable not to sell or package a grip enhancing implement 486 with the container 400 or resealable container cap 460, and/or lid/cap assembly.

Figure 41:
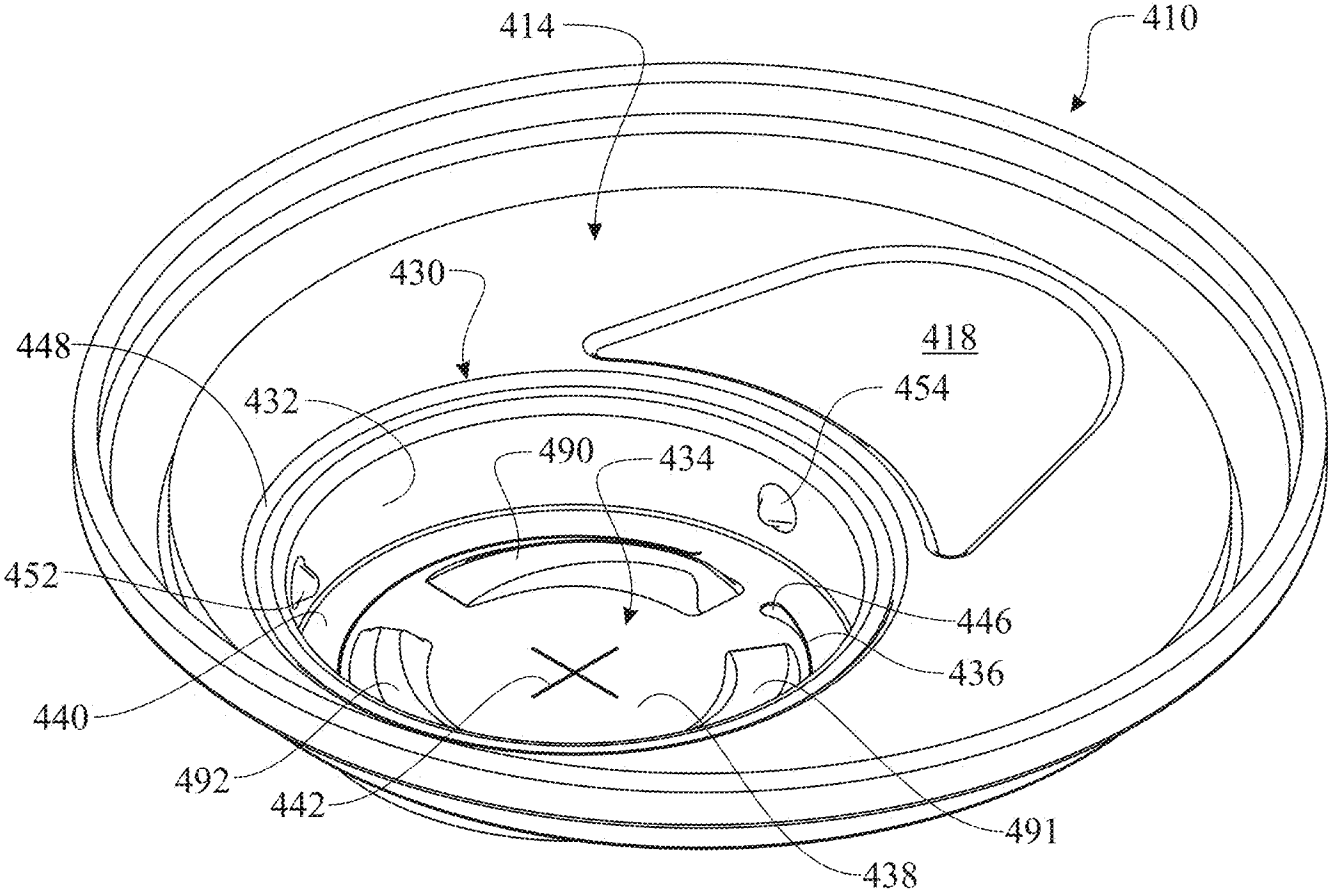
FIG. 41 presents a top isometric view of another enhanced container lid, wherein the enhancement introduces an accelerant for initiating a fracture of the score line.

Referring now to FIG. 41, another aspect of the invention includes making the score line which defines the tear panel or panels in a way that enhances the opening or fracturing ability of the score line. As seen in FIG. 41, a resealable container lid 410 includes a cap receiving socket bottom wall 434 which includes a cap receiving socket bottom wall 434. The cap receiving socket bottom wall 434 includes three socket bottom panel ramps 490, 491 and 492, and a cap receiving socket bottom panel tear panel 438 defined by a cap receiving socket bottom panel circular score line 436. The cap receiving socket bottom panel circular score line 436, as in one of the previous embodiments, is in the form of a loop, not quite fully disposed, so that a hinge is defined between the opposite ends of the cap receiving socket bottom panel circular score line 436. The cap receiving socket bottom panel circular score line 436 is made during the formation steps that create the resealable container lid 410, which in the case of beverage cans, is made of 0.008 inch thick material. The score line 436 is typically 0.004 inch deep, so that the thickness of the lid 410 under the score line 436 is typically about 0.004 inch thick for aluminum beverage cans. The thinning of the material occurs during pressing of the lid 410, and in essence, the material which comprises the lid 410 is deformed and flows to create a thinned area beneath the score line 436.

Using the same principals of material flow or deformation during the pressing steps, a score line thinned fracture initiation region 437 is formed at one end of the cap receiving socket bottom panel circular score line 436 where one of the ramps 394, 395, 396 in conjunction with ramps 490, 491, 492 will impinge upon the score line 436. At the beginning of the opening process, the ramps 394, 395, 396 in conjunction with ramps 490, 491, 492 push on the flared, score line thinned fracture initiation region 437, which has been thinned essentially to the thickness of the sidewall 102, 202 of the container 100, 200, in the case of an aluminum can. In other words, the entire area of the puncture area is thinned relative to the surrounding surface of the lid 410 to make it easier to puncture or break the score line 436. Once the score line 436 is broken at the puncture area 437, the break will propagate more readily and predictably around the score line 436 to ease the opening of the container 100, 200. Although the score line thinned fracture initiation region 437 is thinner, and thus potentially more vulnerable to accidental opening, it is no thinner than the sidewall of the beverage container and thus capable of withstanding internal pressures. It is also shielded from accidental external rupture by means of the cap 460 when seated in the socket 430.

Each embodiment described herein has referred to a tear panel, such as cap receiving socket bottom panel tear panel 138, as that part of the bottom wall of the socket that is defined by a circular or loop-shaped score line. This tear panel can also be described as a "frangible area" because it breaks away from the rest of the bottom wall 138, 238, 338, 438 when the cap 160, 260, 360, 460 descends into the socket 130, 230, 330, 430. It is not required, however, for the tear panel 138, 238, 338, 438 or frangible area to be substantially circular or looped in shape, and indeed, a second illustrated embodiment is shown in FIG. 38. While all other aspects of the resealable container lid 310 are the same as in previous embodiments, including a cap receiving socket 330 having a cap receiving socket bottom wall 334, the bottom wall 334 is provided with an cap receiving socket bottom panel "S" shaped score line 344 which, when fractured by operation of the down movement of the cap and engagement of socket bottom panel ramp 390 and 391, the fracture forms two separate tear panels 338 which are pushed inwardly during the opening operation, with the two tear panels 338 being connected to the can by a hinge area 339 on opposite sides of the cap receiving socket bottom wall 334. During the opening process, the sharp protrusion in the middle of the bottom wall of the cap will puncture the center of the score line 344 at a score line fracture thinned initiation region 346. At about the same time, the ramps 390, 391, 392, 393 of the cap receiving socket 330 and the ramps 394, 395, 396 of the resealable container cap 360 cooperate to push the tear panels 338 at locations opposite what will become the hinges 339, in essentially the "loop" portions of the cap receiving socket bottom panel "S" shaped score line 344. Simultaneously, two tear panels 338 are formed and pushed into the interior of the container 100, 200.

During opening and closing operations, the resealable container cap handle or grip element 274, 480 is turned preferably ninety degrees (90°) in one direction, and then to withdraw the resealable container cap 260, 360, 460 from the socket, the grip 274, 480 is turned ninety degrees (90°) in the opposite direction, to the beginning point. In order to remove the resealable container cap 260, 360, 460 altogether from the lid, the grip is turned approximately another ten degrees (10°) until the grooves and protrusions are separated and the resealable container cap 260, 360, 460 is free to be lifted upwardly away from the container. Different combinations of embossed ramps 390, 392 and de-bossed ramps 391, 393, and different numbers of ramps, can be employed to achieve the desired effect. The space between the resealable container cap 260, 360, 460 and the cap receiving socket bottom wall 234, 334 of the cap receiving socket 230, 330, 430 is equal to the length of linear travel when the resealable container cap 260, 360, 460 is operated between the transport and open/resealed positions (in the case of aluminum beverage cans, approximately 0.055 inches). With the use of ramps that are embossed on the tear panel 238, 338, 438 that distance can be doubled, forcing the tear panel 238, 338, 438 to fold on its hinge 239, 339, 439 further away from the opening.

In all cases using ramps, it is preferred that the peak height of the ramps be disposed near or in close proximity to the hinge, as this will help push the tear panel 238, 338, 438 out of the way when the cap's cam body pushes through the opening. The ramps help propagate the ruptured score line along its length. There are corresponding ramps or other structures on the bottom of the cap that will interface with ramps on the tear panel 238, 338, 438 or panels. All ramps are embossed (rise up from the bottom socket surface), but they could equally be de-bossed ramps 391, 393 that start below the bottom socket surface and continue up the embossed ramp 390, 392. If the respective ramp on the cap starts inside the debossed ramp on the lid 210, 310, 410, during operation the effective linear travel of the cap 260, 360 460 can be doubled, tripled, and perhaps quadrupled.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

REFERENCE ELEMENT DESCRIPTIONS

Ref. No. Description

- 100 container
- 102 container cylindrical sidewall
- 104 container closed bottom wall
- 110 resealable container lid
- 114 resealable container lid upper surface
- 118 resealable container lid upper surface reinforcement formation
- 119 resealable container lid planar upper surface outer segment

127 axial direction reference
128 actuating member
129 angle off axial direction
130 cap receiving socket
132 cap receiving socket cylindrical sidewall
134 cap receiving socket bottom wall
136 cap receiving socket bottom panel circular score line
138 cap receiving socket bottom panel tear panel
139 tear panel hinge
140 cap receiving socket bottom panel flat annular surface
142 cap receiving socket bottom panel centered "X" shaped score line
148 circumferential tamper evidence actuating formation
150 socket sidewall cam engaging projections
160 resealable container cap
162 resealable container cap cylindrical sidewall
164 resealable container cap bottom surface
166 cam shaped cap bottom surface
167 flat annular cap bottom sealing surface
168 offset projecting incisor
169 centered projecting incisor
170 radially extending cap skirt
172 radially extending cap skirt frangible score lines
174 resealable container cap grip element
180 cam groove surface
181 first cam groove surface
182 second cam groove surface
183 third cam groove surface
184 sloped cam groove surface segment
186 embossed cam surface lower detent
188 embossed cam surface upper detent
200 container
202 container cylindrical sidewall
204 container closed bottom wall
210 resealable container lid
218 resealable container lid upper surface reinforcement formation
227 axial direction reference
228 actuating member
229 angle off axial direction
230 cap receiving socket
232 cap receiving socket cylindrical sidewall
234 cap receiving socket bottom wall
236 cap receiving socket bottom panel circular score line
238 cap receiving socket bottom panel substantially closed loop tear panel
239 tear panel hinge
242 cap receiving socket bottom panel centered score line
248 circumferential tamper evidence actuating formation
252 first socket sidewall cam engaging projection
254 second socket sidewall cam engaging projection
256 third socket sidewall cam engaging projection
260 resealable container cap
262 resealable container cap cylindrical sidewall
264 resealable container cap bottom surface
266 cam shaped cap bottom surface
267 flat annular cap bottom sealing surface
268 offset projecting incisor
269 centered incising projection
270 radially extending cap skirt
272 radially extending cap skirt frangible score lines
274 resealable container cap grip element
281 first embossed cam surface
282 second embossed cam surface
283 third embossed cam surface
290 first socket bottom panel ramp
291 second socket bottom panel ramp
292 third socket bottom panel ramp
294 first cap bottom surface projecting feature (ramp)
295 second cap bottom surface projecting feature (ramp)
296 third cap bottom surface projecting feature (ramp)
310 resealable container lid
314 resealable container lid upper surface
327 axial direction reference
328 actuating member
329 angle off axial direction
330 cap receiving socket
332 cap receiving socket cylindrical sidewall
334 cap receiving socket bottom wall
334 cap receiving socket bottom wall
339 tear panel hinge
340 cap receiving socket bottom panel flat annular surface
344 cap receiving socket bottom panel "S" shaped score line
346 score line fracture thinned initiation region
348 circumferential tamper evidence actuating formation
360 resealable container cap
364 resealable container cap bottom surface
365 cap sealing ring
367 flat annular cap bottom sealing surface
369 centered incising projection
370 radially extending cap skirt
372 radially extending cap skirt frangible score lines
381 first embossed cam surface
382 second embossed cam surface
383 third embossed cam surface
390 first socket bottom panel ramp
391 second socket bottom panel ramp
393 second socket bottom panel debossed ramp
394 first cap bottom surface ramp
395 second cap bottom surface ramp
396 third cap bottom surface ramp
400 container
410 resealable container lid
414 resealable container lid upper surface
418 resealable container lid upper surface reinforcement formation
427 axial direction reference
428 actuating member
429 angle off axial direction
430 cap receiving socket
432 cap receiving socket cylindrical sidewall
434 cap receiving socket bottom wall
436 cap receiving socket bottom panel circular score line
437 score line fracture thinned initiation region
438 cap receiving socket bottom panel tear panel
442 cap receiving socket bottom panel centered score line
446 score line fracture thinned initiation region
448 circumferential tamper evidence actuating formation
460 resealable container cap
468 offset projecting incisor
474 resealable container cap grip element
476 resealable container cap grip element first cross member
478 resealable container cap grip element second cross member
479 grip enhancing implement
490 first socket bottom panel ramp
491 second socket bottom panel ramp
492 third socket bottom panel ramp

What is claimed is:

1. A plug style closure cap for sealing an opening of a container, the plug style closure cap comprising:

a plug style closure cap body comprising:

a substantially circular sidewall, a traversing wall contiguous with the substantially circular sidewall isolating a product side from a public side of the plug style closure cap body, a motion translating feature that translates a rotational motion to an axial motion when engaged with a mating motion translating feature on a radially interior, product side surface of a substantially circular sidewall circumscribing an opening of the container, wherein the motion translating feature is provided on a radially exterior, product side surface of the substantially circular sidewall of the plug style closure cap body, at least one sealing surface, wherein the sealing surface is designed to engage with a mating sealing surface proximate the opening of the container, and a tamper evidence feature integral with the plug style closure cap body, the tamper evidence feature including an actuating member, the actuating member oriented at an acute angle from an axial direction, the acute angle being respective to a direction of axial motion to activate the tamper evidence feature, wherein the tamper evidence feature circumscribes a periphery of the plug style closure cap body, wherein, in use, the motion translating feature of the plug style closure cap body rotationally engages with a mating motion translating feature proximate the opening of the container resulting in an axial motion, the axial motion engages the actuating member of the tamper evidence feature and a circumferential tamper evidence actuating formation with one another, wherein the circumferential tamper evidence actuating formation circumscribes the opening of a container, wherein, during the axial motion, the engagement and the acute angle of the actuating member cause the tamper evidence feature to at least one of change in shape and fracture, wherein the at least one of change in shape and fracture is clearly visible to an end user indicating activation of the tamper evidence feature.

2. The plug style closure cap as recited in claim 1, wherein the tamper evidence feature is formed in at least one of:

(a) extending radially outward from the substantially circular sidewall of the plug style closure cap body, (b) extending radially outward and downward from the substantially circular sidewall of the plug style closure cap body, (c) extending radially outward and downward from an upper edge of the substantially circular sidewall of the plug style closure cap body, (d) extending radially outward from an upper surface of the plug style closure cap body, and (e) extending radially outward and downward from an upper surface of the plug style closure cap body.

3. The plug style closure cap as recited in claim 2, the tamper evidence feature further comprising at least one segment defined by frangible elements.

4. The plug style closure cap as recited in claim 1, the tamper evidence feature further comprising at least one segment defined by frangible elements.

5. The plug style closure cap as recited in claim 1, wherein the tamper evidence feature is segmented into multiple segments, wherein the tamper evidence feature identifies when a seal accessing contents of the container is initially breached by presenting the at least one segment of the multiple segments of the tamper evidence feature having at least one of:

(a) a deformed shape, and (b) fractures of frangible elements wherein the frangible elements are integral with the tamper evidence feature.

6. The plug style closure cap as recited in claim 1, further comprising an elastomeric material applied to the at least one sealing surface of the plug style closure cap.

7. The plug style closure cap as recited in claim 1, wherein the at least one sealing surface is provided by at least one of:

(a) the substantially circular sidewall of the plug style closure cap body, (b) a lower surface of an area extending radially outward from a top surface of the plug style closure cap body, (c) an underside surface of the plug style closure cap body, and (d) an underside annular surface of the plug style closure cap body.

8. A resealable container, including:

a container body, the container body comprising:

a tubular sidewall extending upward from a bottom to an upper portion of the container body, interior surfaces of the tubular sidewall, the bottom, and the upper portion collectively defining a storage cavity for storing contents therein, and a circumferential tamper evidence actuating formation circumscribing an opening of the container body enabling access to contents within the storage cavity; and a plug style closure cap, the plug style closure cap comprising:

a plug style closure cap body comprising:

a substantially circular sidewall, a traversing wall contiguous with the substantially circular sidewall isolating a product side from a public side of the plug style closure cap body, a motion translating feature that translates a rotational motion to an axial motion when engaged with a mating motion translating feature on a radially interior, product side surface of a substantially circular sidewall circumscribing the opening of the container, wherein the motion translating feature is formed on a radially exterior, product side surface of the substantially circular sidewall of the plug style closure cap body, at least one sealing surface, wherein the sealing surface is designed to engage with a mating sealing surface proximate the opening of the container, and a tamper evidence feature integral with the plug style closure cap body, the tamper evidence feature including an actuating member, the actuating member oriented at an acute angle from an axial direction, the acute angle being respective to a direction of axial motion to activate the tamper evidence feature, wherein, in use, the motion translating feature of the plug style closure cap body rotationally engages with a mating motion translating feature proximate the opening of the container resulting in an axial motion, the axial motion engages the actuating member of the tamper evidence feature and the circumferential tamper evidence actuating formation with one another, wherein, during the axial motion, the engagement and the acute angle of the actuating member cause the tamper evidence feature to at least one of change in shape and fracture, wherein the at least one of change in shape and fracture is clearly visible to an end user indicating activation of the tamper evidence feature.

9. The resealable container as recited in claim 8, wherein the tamper evidence feature of the plug style closure cap is formed in at least one of:

(a) extending radially outward from the substantially circular sidewall of the plug style closure cap body, (b) extending radially outward and downward from the substantially circular sidewall of the plug style closure cap body, (c) extending radially outward and downward from an upper edge of the substantially circular sidewall of the plug style closure cap body, (d) extending radially outward from an upper surface of the plug style closure cap body, and (e) extending radially outward and downward from an upper surface of the plug style closure cap body.

10. The resealable container as recited in claim 9, wherein the tamper evidence feature of the plug style closure cap further comprising at least one segment defined by frangible elements.

11. The resealable container as recited in claim 8, wherein the tamper evidence feature of the plug style closure cap further comprises at least one segment defined by frangible elements.

12. The resealable container as recited in claim 8, the tamper evidence feature of the plug style closure cap is segmented into multiple segments, wherein the tamper evidence feature identifies when a seal accessing contents of the container is initially breached by presenting at least one segment of the multiple segments of the tamper evidence feature having one of:

(a) a deformed shape, and (b) fractures of frangible elements wherein the frangible elements are integral with the tamper evidence feature.

13. The plug style closure cap as recited in claim 8, further comprising an elastomeric material applied to the at least one sealing surface of the plug style closure cap.

14. The resealable container as recited in claim 8, wherein the at least one sealing surface of the plug style closure cap is provided by at least one of:

(a) the substantially circular sidewall of the plug style closure cap body, (b) a lower surface of an area extending radially outward from a top surface of the plug style closure cap body, (c) an underside surface of the plug style closure cap body, and (d) an underside annular surface of the plug style closure cap body.

15. A method of using a resealable container, the method comprising steps of:

rotating a plug style closure cap inserted into an opening of a resealable container body, the resealable container comprising:

a container body, the container body comprising:

a tubular sidewall extending upward from a bottom to an upper portion of the container body, interior surfaces of the tubular sidewall, the bottom, and the upper portion collectively defining a storage cavity for storing contents therein, a circumferential tamper evidence actuating formation circumscribing an opening of the container body enabling access to contents within the storage cavity, and a container motion translating feature provided on a substantially circular sidewall of a radially interior, product side surface of the opening of the resealable container;

the plug style closure cap comprising a plug style closure cap body having:

a substantially circular sidewall, a traversing wall contiguous with the substantially circular sidewall isolating a product side from a public side of the plug style closure cap body, a cap motion translating feature provided on a radially exterior, product side surface of the substantially circular sidewall of the plug style closure cap body, at least one sealing surface, wherein the at least one sealing surface is designed to engage with a mating at least one sealing surface of the opening of the container, and a tamper evidence feature integral with the plug style closure cap body, the tamper evidence feature including an actuating member, the actuating member oriented at an acute angle to an axial direction, the acute angle being respective to a direction of axial motion to activate the tamper evidence feature, wherein the actuating member of the tamper evidence feature engages with a surface of a tamper evidence actuator located proximate the opening of the container body;

translating a rotational motion of the plug style closure cap to an axial motion, wherein the translation is caused by engagement between the cap motion translating feature and the container motion translating feature;

rotationally engaging the motion translating feature of the plug style closure cap body rotationally with the container motion translating feature resulting in an axial motion, engaging the actuating member of the tamper evidence feature and the circumferential tamper evidence actuating formation with one another during the axial motion, and causing the tamper evidence feature to at least one of change in shape and fracture as a result of the acute angle of the actuating member during the engagement between the actuating member of the tamper evidence feature and the circumferential tamper evidence actuating formation during the axial motion, wherein the at least one of the change in shape and the fracture is clearly visible to an end user indicating activation of the tamper evidence feature.

16. The method of using a resealable container as recited in claim 15, the tamper evidence feature further comprising multiple frangible score lines, the method further comprising a step of:

fracturing the frangible score lines during the step of changing the shape of the tamper evidence feature.

17. The method of using a resealable container as recited in claim 16, the tamper evidence feature further comprising segments, wherein each segments extends between adjacent frangible score lines, wherein the step of reshaping the tamper evidence feature includes a step of bending the sections of the tamper evidence feature.

18. The method of using a resealable container as recited in claim 15, the method further comprising a step of resealing the resealable container by:

rotating the plug style closure cap within the opening of a resealable container body;

translating the rotational motion of the plug style closure cap to an axial motion, wherein the translation is caused by engagement between the cap motion translating feature and the container motion translating feature;

seating the at least one sealing surface of the plug style closure cap against the mating at least one sealing surface of the opening of the resealable container body.

19. The method of using a resealable container as recited in claim 15, the plug style closure cap includes an elastomeric material applied to the at least one sealing surface thereof, the method further comprising a step of resealing the resealable container by:

rotating the plug style closure cap within the opening of a resealable container body;

translating the rotational motion of the plug style closure cap to an axial motion, wherein the translation is caused by engagement between the cap motion translating feature and the container motion translating feature;

seating the elastomeric material against the mating at least one sealing surface of the opening of the resealable container body.

20. The method of using a resealable container as recited in claim 15, the method further comprising a step of resealing the resealable container by:

rotating the plug style closure cap within the opening of a resealable container body;

translating the rotational motion of the plug style closure cap to an axial motion, wherein the translation is caused by engagement between the cap motion translating feature and the container motion translating feature;

seating the at least one sealing surface of the plug style closure cap against the mating at least one sealing surface of the opening of the resealable container body, wherein the at least one sealing surface is at least one of:

(a) the substantially circular sidewall of the plug style closure cap body, (b) a lower surface of an area extending radially outward from a top surface of the plug style closure cap body, (c) an underside surface of the plug style closure cap body, and (d) an underside annular surface of the plug style closure cap body.

21. The plug style closure cap as recited in claim 1, wherein the circumferential tamper evidence actuating formation is unitarily and integrally formed circumscribing the opening of the container.

22. The plug style closure cap as recited in claim 1, wherein an actuating surface of the circumferential tamper evidence actuating formation defines a substantially radially oriented plane.

23. The plug style closure cap as recited in claim 1, wherein the tamper evidence feature transitions from an acute angle from the axial direction to an obtuse angle from the axial direction indicating activation of the tamper evidence feature, wherein the acute angle and the obtuse angle are respective to the direction of axial motion during activation of the tamper evidence feature.

24. The plug style closure cap as recited in claim 8, wherein the circumferential tamper evidence actuating formation is unitarily and integrally formed circumscribing the opening of the container.

25. The plug style closure cap as recited in claim 8, wherein an actuating surface of the circumferential tamper evidence actuating formation defines a substantially radially oriented plane.

26. The plug style closure cap as recited in claim 8, wherein the tamper evidence feature transitions from an acute angle from the axial direction to an obtuse angle from the axial direction indicating activation of the tamper evidence feature, wherein the acute angle and the obtuse angle are respective to the direction of axial motion during activation of the tamper evidence feature.

27. The method of using a resealable container as recited in claim 15, the container body further comprising a contacting surface of the circumferential tamper evidence actuating formation, the contacting surface defining a substantially radially oriented plane, wherein the step of engaging the actuating member of the tamper evidence feature and the circumferential tamper evidence actuating formation with one another during the axial motion is accomplished by the actuating member of the tamper evidence feature engaging with the contacting surface of the circumferential tamper evidence actuating formation.

28. The method of using a resealable container as recited in claim 15, wherein the step of causing the tamper evidence feature to at least one of change in shape and fracture as a result of the acute angle of the actuating member during the engagement between the actuating member of the tamper evidence feature and the circumferential tamper evidence actuating formation during the axial motion causes the tamper evidence feature to change shape from an acute angle from the axial direction to an obtuse angle from the axial direction indicating activation of the tamper evidence feature, wherein the acute angle and the obtuse angle are respective to the direction of axial motion during activation of the tamper evidence feature.

* * * * *